US006690344B1

(12) United States Patent
Takeuchi et al.

(10) Patent No.: US 6,690,344 B1
(45) **Date of Patent: *Feb. 10, 2004**

(54) METHOD AND APPARATUS FOR DRIVING DEVICE AND DISPLAY

(75) Inventors: Yukihisa Takeuchi, Aichi-Pref. (JP); Tsutomu Nanataki, Toyoake (JP); Iwao Ohwada, Nagoya (JP); Takayoshi Akao, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/570,697

(22) Filed: May 12, 2000

Related U.S. Application Data

(60) Provisional application No. 60/191,907, filed on Mar. 24, 2000.

(30) Foreign Application Priority Data

May 14, 1999 (JP) ..... 11-134899
Mar. 10, 2000 (JP) ..... 2000-067638

(51) Int. Cl.[7] ..... G09G 3/34
(52) U.S. Cl. ..... 345/85; 345/204
(58) Field of Search ..... 345/84, 85, 102, 345/108, 88, 95, 89; 310/328, 330, 331, 332, 334; 359/290–297; 327/535

(56) References Cited

U.S. PATENT DOCUMENTS

| | | | | |
|---|---|---|---|---|
| 5,106,181 A | | 4/1992 | Rockwell, III | |
| 5,123,017 A | | 6/1992 | Simpkins et al. | |
| 5,191,455 A | * | 3/1993 | Hashimoto et al. | 327/535 |
| 5,210,455 A | | 5/1993 | Takeuchi et al. | |
| 5,469,026 A | | 11/1995 | Madsen | |
| 5,550,443 A | | 8/1996 | Lee | |
| 5,600,197 A | | 2/1997 | Takeuchi et al. | |
| 5,636,072 A | * | 6/1997 | Shibata et al. | 310/328 |

(List continued on next page.)

FOREIGN PATENT DOCUMENTS

| | | |
|---|---|---|
| DE | 39 13877 A1 | 10/1990 |
| EP | 0 378 465 A1 | 7/1990 |
| EP | 0 757 498 A1 | 2/1997 |
| EP | 0 852 371 A1 | 7/1998 |
| EP | 0 867 854 A2 | 9/1998 |
| EP | 0916985 | 5/1999 |
| EP | 0 953 958 A2 | 11/1999 |
| EP | 0 964 421 A1 | 12/1999 |
| GB | 2 251 511 A | 7/1992 |
| GB | 2 314 194 A | 12/1997 |
| JP | 6282241 | 10/1994 |
| JP | 7007709 | 1/1995 |
| JP | 7-287176 A | 10/1995 |
| JP | 9198007 | 7/1997 |
| JP | 10-78549 A | 3/1998 |
| JP | 11085104 | 3/1999 |
| JP | 11282420 | 10/1999 |
| WO | 98/54609 | 12/1998 |
| WO | 99/63515 | 12/1999 |

OTHER PUBLICATIONS

Kazuo Anzai, "*Preparation of Electronic Materials by Electrophoretic Deposition*," General Institute of Toshiba Corporation, Denki Kagaku 53, No. 1, 1985, pp. 63 to 68.

(List continued on next page.)

*Primary Examiner*—Chanh Nguyen
(74) *Attorney, Agent, or Firm*—Burr & Brown

(57) ABSTRACT

A display driving device drives a display which includes a plurality of actuators which control light emitted from specified parts of an optical wave guide plate. A first drive circuit controls the row electrodes, while a second drive circuit controls the column electrodes by outputting a data signal. The data signal includes a light emitting signal and a light extinguishing signal for each dot in the display, based on an input image signal. The column electrode drive circuit controls gradation only by a temporal modulation method. A signal processing circuit, which controls the first and second drive circuits, also controls brightness correction data. Brightness correction data are determined upon manufacture of the display and can be modified during the life of the display to correct for brightness deterioration.

116 Claims, 61 Drawing Sheets

U.S. PATENT DOCUMENTS

| | | | | |
|---|---|---|---|---|
| 5,668,569 | A | 9/1997 | Greene et al. | |
| 5,754,160 | A | 5/1998 | Shimizu et al. | |
| 5,771,321 | A | 6/1998 | Stern | |
| 5,774,101 | A | 6/1998 | Hirai et al. | |
| 5,861,863 | A | 1/1999 | Kudo et al. | |
| 5,862,275 | A | 1/1999 | Takeuchi et al. | |
| 5,953,469 | A | 9/1999 | Zhou | |
| 5,986,640 | A | 11/1999 | Baldwin et al. | |
| 6,020,868 | A | 2/2000 | Greene et al. | |
| 6,028,978 | A | 2/2000 | Takeuchi et al. | |
| 6,057,816 | A | 5/2000 | Eckersley | |
| 6,091,182 | A | 7/2000 | Takeuchi et al. | |
| 6,091,397 | A | 7/2000 | Lee | |
| 6,108,479 | A | 8/2000 | Takeuchi et al. | |
| 6,323,833 | B1 * | 11/2001 | Takeuchi et al. | 310/331 |

OTHER PUBLICATIONS

Atsushi Goto, et al., "*$PbZrO_3/PbTiO_3$ Composite Ceramics Fabricated by Electrophoretic Deposition*," Tokyo Metropolitan University, Tokyo Medical and Dental University, Proceedings of First Symposium on Higher–Order Ceramic Formation Method Based on Electrophoresis, 1998, pp. 5 and 6.

Kimihiro Yamashita, *Hybridizationof Ceramics by Electrophoretic Deposition,* Institute for Medical and Dental Engineering, Tokyo Medical and Dental University, Proceedings of First Symposium on Higher–Order Ceramic Formation Method Based on Electrophoresis, 1998, pp. 23 and 24.

U.S. patent application Ser. No. 09/803,744, Takeuchi et al., filed Mar. 8, 2001.

Database WPI, Section PQ, Week 199935, Derwent Publications Ltd., London, GB; AN 1999–411272, XP002181321 (JP 11 164035 A) *abstract*.

Database WPI, Section EI, Week 199928, Derwent Publications Ltd., London, GB; AN 1999–334233, XP002181322 (JP 11 122604 A) *abstract*.

U.S. patent application Ser. No. 10/280,106, Takeuchi et al., filed Oct. 24, 2002.

U.S. patent application Ser. No. 10/163,069, Takeuchi et al., filed Jun. 5, 2002.

Patent Abstracts of Japan, vol. 1996, No. 09, Sep. 30, 1996 & JP 08 125245 A (Sony Corp), May 17, 1996 *abstract*.

* cited by examiner

FIG. 14

| Offset Electric Potential | ON Signal | OFF Signal |
|---|---|---|
| | 0V | 60V |
| 10V | −10V (light emission) | 50V (light off) |

FIG. 19

| Offset Electric Potential | ON Signal | OFF Signal |
|---|---|---|
| | 0V | 60V |
| 0V | 0V | 60V |

FIG. 20

| Offset Electric Potential | ON Signal | OFF Signal |
|---|---|---|
| | 60V | 0V |
| 50V | −10V | 50V |

FIG. 31

| | | ON Signal | OFF Signal |
|---|---|---|---|
| | | 0V | 60V |
| Select Signal | 10V | −10V (light emission) | 50V (light off) |
| Nonselect Signal | −50V | 50V (light emission) | 110V (light off) |

FIG. 32

| | | ON Signal | OFF Signal |
|---|---|---|---|
| | | 0V | 60V |
| Select Signal | 0V | 0V | 60V |
| Nonselect Signal | −60V | 60V | 120V |

FIG. 33

| | | ON Signal | OFF Signal |
|---|---|---|---|
| | | 60V | 0V |
| Select Signal | 50V | −10V | 50V |
| Nonselect Signal | 110V | 50V | 110V |

One Frame

Column
MAX 60V
0V

Row
55V Fixed

Applied Voltage
55V
-5V
OFF
ON

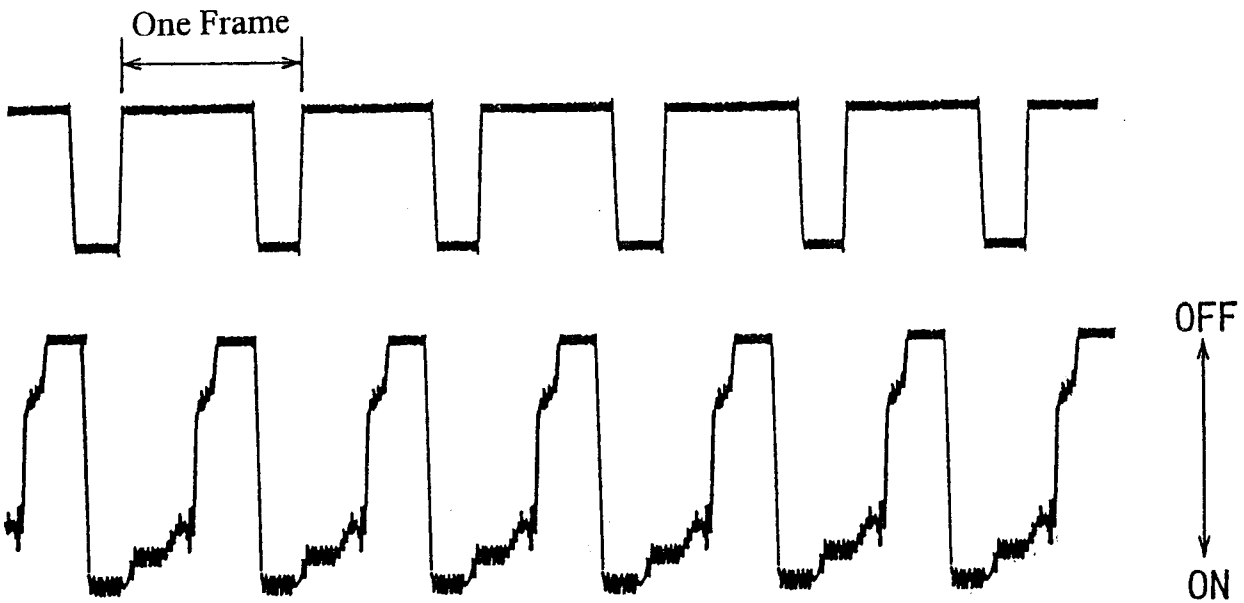
FIG. 55A Vc
FIG. 55B Ld

One Frame

Column
MAX 60V
Tp
0V
100V
or more

Row
55V
100V
or more
55V

Applied
Voltage
-5V
Tp
OFF
ON
Gradation
Expression
Interval

Vc

Ld

FIG. 66 - Prior Art
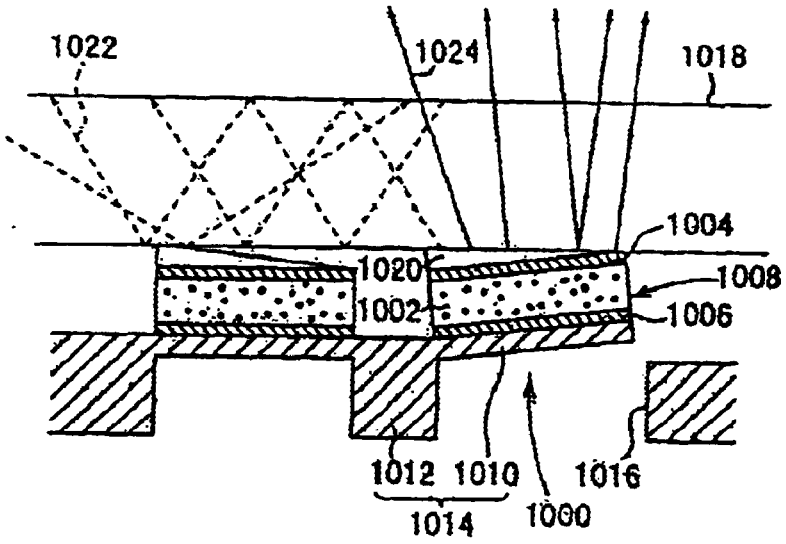
FIG. 67 - Prior Art
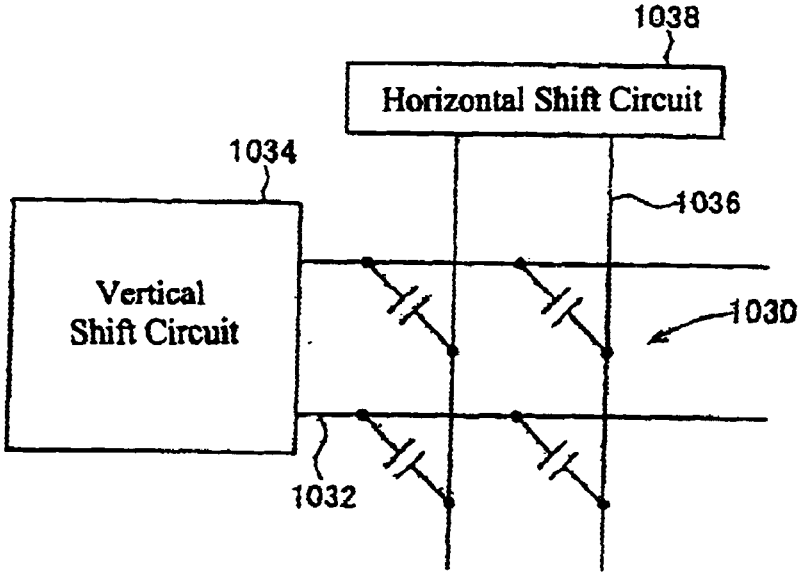

METHOD AND APPARATUS FOR DRIVING DEVICE AND DISPLAY

CROSS-REFERENCE TO RELATED APPLICATIONS

This application claims priority from Japanese Application No. 11-134899 filed May 14, 1999, from Japanese Application No. 2000-067638 filed Mar. 10, 2000, and from U.S. Provisional Application Ser. No. 60/191,907 filed Mar. 24, 2000, all of which are incorporated herein by reference.

FIELD OF THE INVENTION

The present invention relates to display devices having significant screen brightness (i.e., luminance) which consume a small amount of electric power, and in particular, to a display driving device which controls a variation of contact/separation directions of an actuator with respect to an optical wave guide plate in response to an input image signal input.

BACKGROUND OF THE INVENTION

Cathode ray tubes (CRT), liquid crystal devices and plasma display devices are known in the art. Cathode ray tubes are known as normal television receiving devices and monitor devices for computers. Although the screens are bright, they consume much electric power, and the overall depth of the display device relative to the size of the screen is great. In addition there are other problems such as diminished resolution in the peripheral portions of the display image, distorted images and graphics, lack of memory feature and an inability to achieve large scale displays. The reason for this is that the light emission point (beam spot) is broadened where electron beams reach the fluorescent face of the CRT diagonally because the electron beam is significantly deflected when fired from the electron gun that images are displayed obliquely. In addition, there are limits to maintaining vacuum in the large spaces of CRT's.

While liquid crystal displays have certain advantages such as being reduced in size and consuming little power, the brightness of the screen is inferior and the screen viewing angle is narrow. In addition, they have an additional disadvantage in that the configuration of the drive circuits has become very complex due to the fact that gradation expression (gray scale) is accomplished by changes in the voltage level. For example, when a digital data line is used, the drive circuit is configured to have a latch circuit which holds component RGB data (each 8 bits) for a specified period of time, a voltage selector, a multiplexer which switches the voltage level in response to the gradation number, and an output circuit for adding the data output from this multiplexer to a digital data line. In this case, if the gradation number increases, there is a need for the multiplexer to act to switch many levels, thus making the configuration more complex.

When an analog data line is used, the drive circuits are configured to have a shift register for aligning component RGB data (each 8 bits) successively input in a horizontal direction, a latch circuit which holds parallel data from the shift register a designated period of time, a level shifter which takes the voltage level adjustment, a digital to analog (D/A) converter which converts the data output from the level shifter to an analog signal, and an output circuit for adding the signal output for this D/A analog converter to an analog data stream. In this case, while a designated voltage is obtained in response to gradation by using an operating amplifier in the D/A converter, the use of an operating amplifier which outputs highly precise voltages becomes necessary as the range of gradation expands. This has the disadvantage that construction is more complex and more expensive.

Plasma displays are similar to liquid crystal display devices in that the display does not take up much space. In addition, since the plasma display is a flat surface, it has the advantage of being easy to view. In particular, with an alternating type plasma display, there is the added advantage that there is no need to have a refresh memory due to the cell memory function. However, there is a need to alternately switch the polarity of the voltage and have a continuous discharge in order to maintain the memory function in cells. Because of that, a first pulse generator that generates a sustained pulse in the X direction and a second pulse generator that generates a sustained pulse in the Y direction must be provided in the drive circuits. Thus there is a problem that the configuration of the drive circuits is more complex.

A recently developed display device, shown in FIG. 66, includes an actuator 1000. Actuator 1000 is configured with an actuator unit 1008 that has a piezoelectric/electrostriction layer 1002 sandwiched between an upper electrode 1004 and a lower electrode 1006 formed respectively on the upper and lower surfaces of piezoelectric/electrostriction layer 1002. A substrate 1014 includes a vibrator 1010 and a securing portion 1012. Vibrator 1010 is disposed on a lower part of actuator unit 1008. Lower electrode 1006 contacts vibrator 1010 such that actuator unit 1008 is supported by vibrator 1010.

Substrate 1014 is composed of ceramic. A concave portion 1016 is formed in substrate 1014 and of a size so that vibrator 1010 is relatively thin. A displacement transfer portion 1020 makes the area of contact with optical wave guide plate 1018 a designated size. Displacement transfer portion 1020 is connected to upper electrode 1004 of actuator unit 1008, and in the example in FIG. 66, displacement transfer portion 1020 is located close to optical wave guide plate 1018 when actuator 1000 is in a normal state (unmoved) and is disposed so that it contacts optical wave guide plate 1018 at a distance equal to or less than the wave length of light when in a state of excitation.

Then, for example, light 1022 is introduced from the end of optical wave guide plate 1018. In this case, all of light 1022 is totally reflected in the interior without passing the front face and back face of optical wave guide plate 1018 due to the index of refraction of optical wave guide plate 1018. In this state, a voltage signal corresponding to an image signal is selectively applied to actuator 1000 via upper electrode 1004 and lower electrode 1006. By performing the displacement due to normal and excited states of actuator 1000, the contact and separation of optical wave guide plate 1018 with displacement transfer portion 1020 is controlled. By virtue of this, the scattered light (leakage light) 1024 of optical wave guide plate 1018 is controlled and an image corresponding to the image signal is displayed on optical wave guide plate 1018.

This display device has the following advantages: (1) it reduces power consumption, (2) it increases screen brightness, and (3) when using a color screen, there is no need to increase the number of pixels as compared to a black and white screen.

The peripheral circuits of the display device as described above, shown in FIG. 67, are configured to have a display

1030 which has multiple arranged pixels, a vertical shift circuit 1034 which deduces the number of rows necessary for vertical selection line 1032 (which are common to the pixels comprising one column), and a horizontal shift circuit 1038 which deduces the number of columns necessary for signal line 1036, which are common to the pixels comprising one column. Because of that, the display information (output voltage) output for the pixel groups of a selected row from horizontal shift circuit 1038 is also applied to the pixel groups related to non-selected rows, thus driving unnecessary pixels. Thus, unnecessary power consumption occurs, which is a disadvantage in reducing the consumption of electric power.

In addition, in endeavoring to improve brightness and contrast with such things as memory effect while increasing the row selection number during the vertical scanning interval, there is a need to supply high voltage to the vertical shift circuit. Moreover, there is a necessity to supply at least three levels of voltage, thus making customization of an IC for the vertical shift circuit more difficult. Reducing the size of the IC's and making them have many outputs becomes difficult, and making displays thinner is hindered by the packaging space of driver IC.

SUMMARY OF THE INVENTION

Briefly stated, a display driving device drives a display which includes an optical wave guide plate and a drive section disposed opposite one face of the optical wave guide plate. The display includes a plurality of actuators which control light emitted from specified parts of the optical wave guide plate. The display driving device includes a first drive circuit which applies an offset potential (bias potential) to all actuators, a second drive circuit which outputs a data signal, and a signal processing circuit. The data signal includes a light emitting signal and a light extinguishing signal for each dot in the display, based on an input image signal. The signal processing circuit controls the row electrode drive circuit and the column electrode drive circuit. The column electrode drive circuit controls gradation by a temporal modulation method. Pixel brightness is controlled by the signal processing circuit to decrease the brightness variance between dots caused by the manufacturing process.

The row electrode drive circuit, the column electrode drive circuit, and the signal processing circuit are packaged in the periphery of the display. The row electrode drive circuit is configured so that it supplies offset electrical potential (bias potential) to the row electrodes of all actuators by virtue of a common wire, where each wire and one level of voltage for offset is supplied through the power source. The column electrode drive circuit includes a number of driver outputs corresponding to the total number of dots, and is configured so that it outputs a data signal to each data wire of the display in parallel so that it supplies respective data signals to all dots. Two levels of voltage for data are supplied to each driver output by the power supply.

In a feature of the invention, the signal processing circuit includes a linear correction mechanism for making display properties linear with respect to the gradation level. This facilitates an accurate display and improves contrast, resulting in a sharper image since the display properties change linearly in each dot in response to variations in the gradation level. In current color television formats, gamma correction on the transmitted image (transmission) side is performed to reduce the cost of receivers. This correction becomes unnecessary with a display which uses an optical wave guide as in this invention since the gamma correction is always focused on Braun tubes. Therefore, degradation of resolution of portions of an image with high color saturation does not occur even when displaying a television signal which has been gamma corrected. It is thus possible to evoke the appearance of a crisp display image, because the display properties with respect to the gradation level in the transmission can be corrected linearly.

In a feature of the invention, a light adjustment control mechanism switches the power of a light source in at least two stages at a desired timing in one frame when the display interval of one image is one frame. When applied to a display which uses linear subfields, the brightness level of each linear subfield varies with adjustment of the light source. For example, when the switches of the power of the light source are set to 100% and 25%, linear sub fields which have brightness level 4 and brightness level 1 are defined to correspond to power switch timing of the light source, and when 64 gradations are expressed just by brightness level 1, they can be expanded to 256 gradations. In addition, since it does not use all the power in one frame, consumption of electric power can be reduced.

In a feature of the invention, a preliminary interval separates all dots in one frame with respect to the optical wave guide plate when the display interval of one image is one frame. By virtue of this, there is no degradation of the responsiveness of the separation of the actuator because an image is displayed from the point that all dots are OFF by designating a preliminary interval before the actual image display interval. The preliminary interval is preferably formed coincidental to variations in the output level of the first drive circuit. The yield and reliability of the display is improved.

According to an embodiment of the invention, a display driving device for a display includes an optical wave guide plate which introduces light to the display; a drive section disposed opposite one face of the optical wave guide plate, the drive section including a plurality of actuators arranged corresponding to a plurality of pixels which in turn correspond to a plurality of dots, the drive section controlling a displacement of the plurality of actuators in contacting and separating directions with respect to the optical wave guide plate, the displacement corresponding to attributes of an input image signal, thereby causing an image to be displayed on the optical wave guide plate corresponding to the image signal by controlling a leakage light from specified parts of the optical wave guide plate; a first drive circuit which applies an offset potential to all of the actuators; a second drive circuit which outputs a data signal for each dot, the data signal being based on the image signal, the data signal comprising one of a light emitting signal and a light extinguishing signal; and a signal processing circuit which controls the first and second drive circuits wherein one dot is configured by one or more actuators and one pixel is configured by one or more dots, wherein the signal processing circuit controls at least the second drive circuit which in turn controls gradation by at least a temporal modulation method.

According to an embodiment of the invention, a display driving device for a display includes an optical wave guide plate which introduces light to the display; a drive section disposed opposite one face of the optical wave guide plate, the drive section including a plurality of actuators arranged corresponding to a plurality of pixels which in turn correspond to a plurality of dots, the drive section controlling a displacement of the plurality of actuators in contacting/separating directions with respect to the optical wave guide plate, the displacement corresponding to attributes of an input image signal, thereby causing an image to be displayed on the optical wave guide plate corresponding to the image signal by controlling a leakage light from specified parts of the optical wave guide plate; a first drive circuit which alternately selects pixels for odd numbered rows and even numbered rows; a second drive circuit which outputs a data signal for each dot, the data signal being based on image signal, the data signal including one of a light emitting signal and a light extinguishing signal; and a signal processing circuit which controls the first and second drive circuits, wherein one dot is configured by one or more actuators and one pixel is configured by one or more dots, and wherein the signal processing circuit controls at least the second drive circuit which in turn controls gradation by at least a temporal modulation method.

According to an embodiment of the invention, a method of driving displays includes introducing light in an optical wave guide plate; providing a plurality of actuators arranged corresponding to a plurality of pixels which in turn correspond to a plurality of dots; providing a drive section disposed opposite one face of the optical wave guide plate which controls a displacement of the actuators in contacting/separating directions with respect to the optical wave guide plate corresponding to attributes of an input image signal, thereby causing an image to be displayed on the optical wave guide plate corresponding to the input image signal by controlling leakage light of specified parts of the optical wave guide plate; configuring each dot by at least one actuator; configuring each pixel by at least one dot; applying an offset potential to the plurality of dots; outputting a data signal comprising a light emitting signal and a light extinguishing signal for each dot based on the input image signal; and controlling gradation by at least a temporal modulation method.

According to an embodiment of the invention, a method of driving displays includes the steps of introducing light in an optical wave guide plate; providing a plurality of actuators arranged corresponding to a plurality of pixels which in turn correspond to a plurality of dots; providing a drive section disposed opposite one face of the optical wave guide plate which controls a displacement of the actuators in contacting/separating directions with respect to the optical wave guide plate corresponding to attributes of an input image signal, thereby causing an image to be displayed on the optical wave guide plate corresponding to the input image signal by controlling leakage light of specified parts of the optical wave guide plate; configuring each dot by at least one actuator; configuring each pixel by at least one dot; alternately selecting pixels of odd number rows and even number rows; outputting display information to pixels of the selected rows for each dot based on the input image signal, wherein the display information includes a light emitting signal and a light extinguishing signal; and controlling gradation by at least a temporal modulation method.

According to an embodiment of the invention, a display driving device for a display includes an optical wave guide plate which introduces light to the display; a drive section disposed opposite one face of the optical wave guide plate, the drive section including a plurality of actuators arranged corresponding to a plurality of pixels which in turn correspond to a plurality of dots, the drive section controlling a displacement of the plurality of actuators in contacting/separating directions with respect to the optical wave guide plate, the displacement corresponding to attributes of an input image signal, thereby causing an image to be displayed on the optical wave guide plate corresponding to the image signal by controlling a leakage light from specified parts of the optical wave guide plate; a first drive circuit which selects dots of designated rows for the plurality of pixels; a second drive circuit which outputs a data signal for each dot, the data signal being based on the input image signal, the data signal including one of a light emitting signal and a light extinguishing signal; and a signal processing circuit which controls the first and second drive circuits, wherein one dot is configured by one or more actuators and one pixel is configured by one or more dots, and wherein the signal processing circuit controls the first and second drive circuits which in turn control gradation by at least a temporal modulation method.

According to an embodiment of the invention a method of driving displays includes the steps of introducing light in an optical wave guide plate; providing a plurality of actuators arranged corresponding to a plurality of pixels which in turn correspond to a plurality of dots; providing a drive section disposed opposite one face of the optical wave guide plate which controls a displacement of the actuators in contacting/separating directions with respect to the optical wave guide plate corresponding to attributes of an input image signal, thereby causing an image to be displayed on the optical wave guide plate corresponding to the input image signal by controlling leakage light of specified parts of the optical wave guide plate; configuring each dot by at least one actuator; configuring each pixel by at least one dot; selecting, in turn, dots of all pixels in designated rows; outputting a data signal comprising a light emitting signal and a light extinguishing signal for each dot based on the input image signal; and controlling gradation by at least a temporal modulation method.

According to an embodiment of the invention, a display driving device for a display includes an optical wave guide plate which introduces light to the display; a drive section disposed opposite one face of the optical wave guide plate, the drive section including a plurality of actuators arranged corresponding to a plurality of pixels which in turn correspond to a plurality of dots, the drive section controlling a displacement of the plurality of actuators in contacting and separating directions with respect to the optical wave guide plate, the displacement corresponding to attributes of an input image signal, thereby causing an image to be displayed on the optical wave guide plate corresponding to the image signal by controlling a leakage light from specified parts of the optical wave guide plate; a first drive circuit which applies an offset potential to all of the actuators; a second drive circuit which outputs a data signal for each dot, the data signal being based on the image signal, the data signal comprising one of a light emitting signal and a light extinguishing signal; a signal processing circuit which controls the first and second drive circuits wherein one dot is configured by one or more actuators and one pixel is configured by one or more dots; wherein the signal processing circuit includes means for controlling gradation; and wherein the signal processing means includes correction means for correcting brightness to compensate for brightness variations between each of the dots.

According to an embodiment of the invention, a method of driving displays includes the steps of introducing light in an optical wave guide plate; providing a plurality of actuators arranged corresponding to a plurality of pixels which in turn correspond to a plurality of dots; providing a drive section disposed opposite one face of the optical wave guide plate which controls a displacement of the actuators in contacting/separating directions with respect to the optical wave guide plate corresponding to attributes of an input image signal, thereby causing an image to be displayed on the optical wave guide plate corresponding to the input image signal by controlling leakage light of specified parts of the optical wave guide plate; configuring each dot by at least one actuator; configuring each pixel by at least one dot; applying an offset potential to the plurality of dots; outputting a data signal comprising a light emitting signal and a light extinguishing signal for each dot based on the input image signal; controlling gradation; and performing brightness correction processing to correct brightness variations between each of the dots.

According to an embodiment of the invention, a display driving device for a display includes an optical wave guide plate which introduces light to the display; a drive section disposed opposite one face of the optical wave guide plate, the drive section including a plurality of actuators arranged corresponding to a plurality of pixels which in turn correspond to a plurality of dots, the drive section controlling a displacement of the plurality of actuators in contacting and separating directions with respect to the optical wave guide plate, the displacement corresponding to attributes of an input image signal, thereby causing an image to be displayed on the optical wave guide plate corresponding to the image signal by controlling a leakage light from specified parts of the optical wave guide plate; each of the actuators including a shape retaining portion consisting of at least first and second layers, wherein the first and second layers are partially separated by a row electrode, and wherein the shape retaining portion is bounded on an upper and lower side by a column electrode; a first drive circuit which applies an offset potential to all of the actuators; a second drive circuit which outputs a data signal for each dot, the data signal being based on the image signal, the data signal comprising one of a light emitting signal and a light extinguishing signal; and a signal processing circuit which controls the first and second drive circuits wherein one dot is configured by one or more actuators and one pixel is configured by one or more dots.

BRIEF DESCRIPTION OF THE DRAWINGS

FIG. 14 is a table showing the relationship between the offset electric potential (bias electrical potential ) output from a low electrode drive circuit and the electrical potential of an ON signal output from a column electrode drive circuit and low electrode and the voltage applied between column poles.

FIG. 19 is a table showing another example of the relationship between the offset electric potential (bias electrical potential) output from a low electrode drive circuit and the electrical potential of an ON signal output from a column electrode drive circuit and low electrode and the voltage applied between column poles.

FIG. 20 is a table showing still another example of the relationship between the offset electric potential (bias electrical potential) output from a low electrode drive circuit and the electrical potential of an ON signal output from a column electrode drive circuit and low electrode and the voltage applied between column poles.

FIG. 31 is a table showing the relationship between the electrical potentials of a selected and a non-selected signal output from a low electrode drive circuit and the electrical potential of an ON signal output from a column electrode drive circuit and low electrode and the voltage applied to between column poles.

FIG. 32 is a table showing another example of the relationship between the electrical potentials of a selected and a non-selected signal output from a low electrode drive circuit and the electrical potential of an ON signal output from a column electrode drive circuit and low electrode and the voltage applied between column poles.

FIG. 33 is a table showing still another example of the relationship between the electrical potentials of a selected and a non-selected signal output from a low electrode drive circuit and the electrical potential of an ON signal output from a column electrode drive circuit and low electrode and the voltage applied between column poles.

FIG. 55A shows the applied voltage wave form in normal operation.

FIG. 55B shows the light intensity distribution of FIG. 55A.

FIG. 66 is a schematic diagram showing the display device of a prior art example.

FIG. 67 is a block diagram showing the peripheral circuits of a prior art display device.

DETAILED DESCRIPTION OF THE INVENTION

The preferred embodiments of the display driving device and method of driving a display of the present invention are explained with reference to FIGS. 1 through 65. However, we explain the configuration of a display to which the driving device of a preferred embodiment is to be applied with reference to FIGS. 1 through 13.

Figure 1:
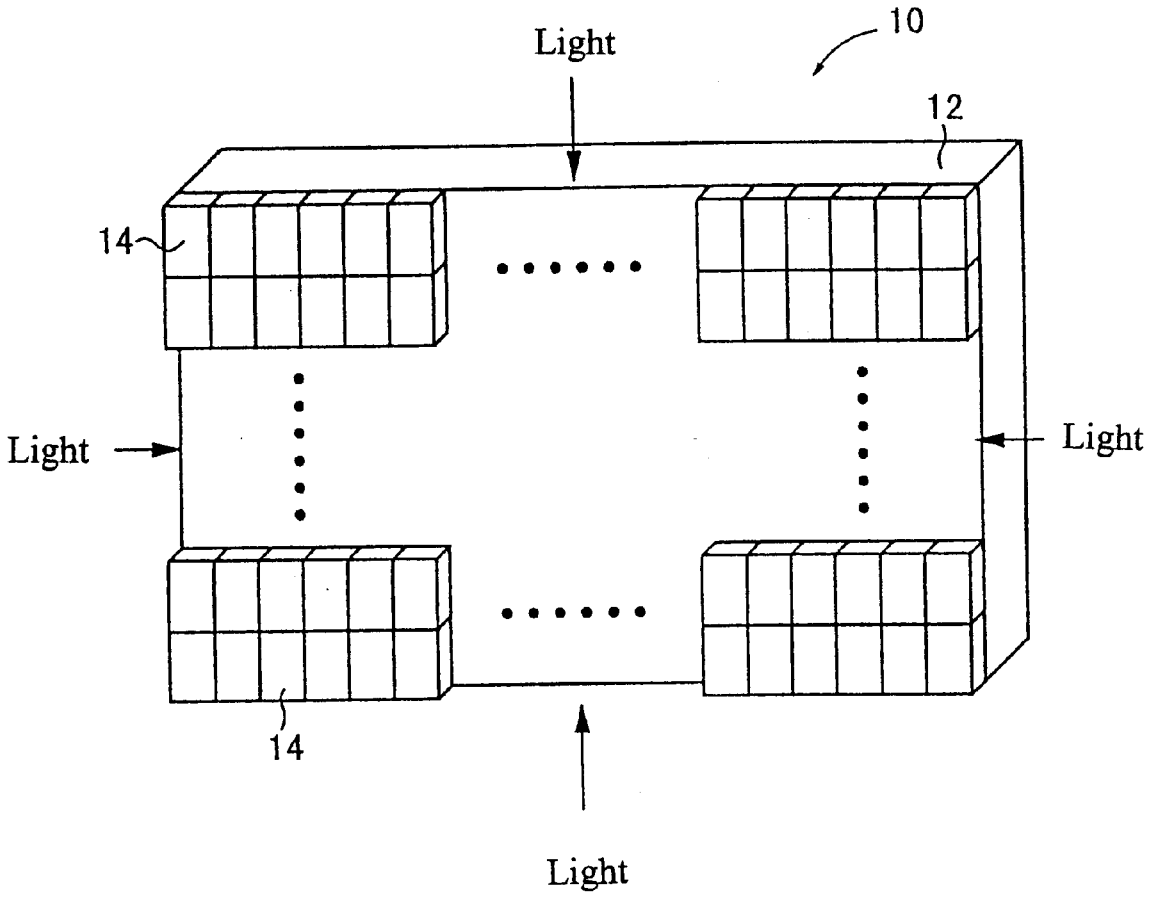
FIG. 1 is an oblique view of a schematic diagram of a display to which the display driving device of an embodiment of the present invention is applied.

Referring to FIG. 1, a display 10 with numerous display elements 14 is arranged in rows on the back of light guide plates 12 having a display area. For example, with VGA standards, forty display elements 14 are arranged in a horizontal direction and thirty display elements 14 are arranged in a vertical direction on the back of light guide plate 12 so that 640 pixels (1920 dots) are lined up in the horizontal direction and 480 pixels (480 dots) are lined up in the vertical direction. Light guide plate 12 uses a uniform material of glass plate or acrylic plate etc. which transmits visible light. Each display element 14 is such that it supplies signals with others by being connected by wire bonding, soldering, end connectors, back connectors etc.

Figure 2:
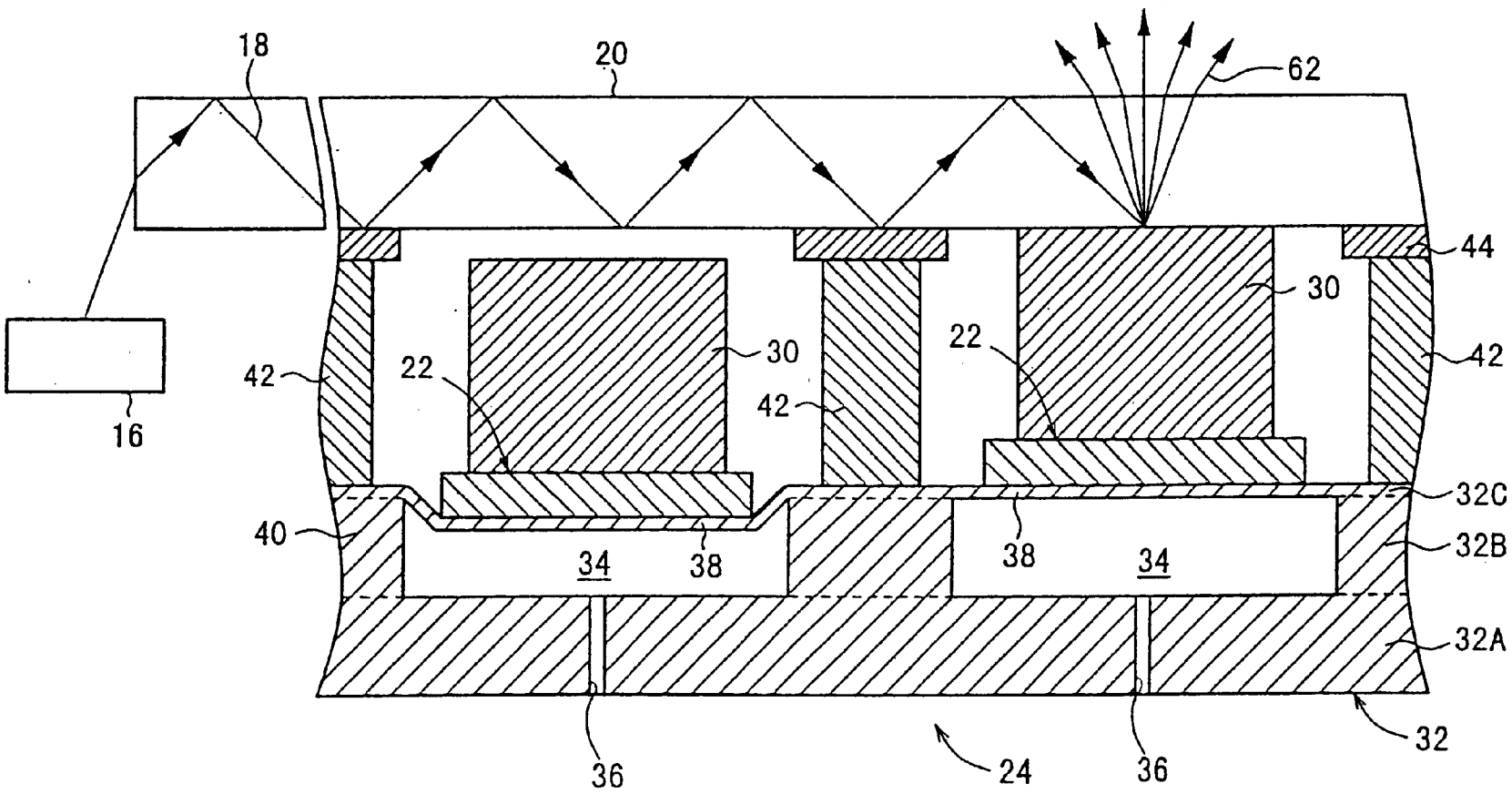
FIG. 2 is a cross-sectional drawing of the configuration of a display element.

Referring to FIG. 2, each display element 14 is configured to have an optical wave guide plate 20 which introduces light 18 from a light source 16. Each display element 14 also has a drive section 24, provided opposite to the back of optical wave guide plate 20, which has numerous actuators 22 arranged in the shape of a matrix or zigzag shape corresponding to pixels. The optical wave guide plate 20 of each display element 14 and light guide plate 12 preferably have similar refraction indexes. When light guide plate 12 and optical wave guide plate 20 are mounted together, a transparent bonding agent may be used. This bonding agent, like the light guide plate 12 and optical wave guide plate 20, should preferably be uniform in visible light ranges and have a high transmittance rate. Specifying something with a refraction index close to that of light guide plate 12 and optical wave guide plate 20 is preferable in terms of guaranteeing brightness of the screen.

Pixel structural units 30 are laminated on each actuator 22 in each display element 14. Pixel structural units 30 increase the contact area with optical wave guide plate 20 and function to make an area which corresponds to the pixel. Drive portion 24 has an actuator substrate 32 composed of ceramic material, with actuators 22 placed in positions corresponding to each pixel 28 of actuator substrate 32. The main surface of actuator substrate 32 is disposed in a continuous face (flush face) opposite to the back face of optical wave guide plate 20. Hollow places 34 for forming respective vibrators are provided in locations corresponding to each pixel 28 in the interior of actuator substrate 32. Each of these hollow places 34 is linked to the exterior via a through hole 36 which has a small bore and is provided on the other end of actuator substrate 32.

The portion where hollow place 34 is formed in actuator substrate 32 is thin with the remainder of actuator substrate 32 being thick. The thin portion has a structure which easily vibrates with external stress to function with vibrator 38 while the thicker portions function as securing portions 40 which support vibrators 38. In other words, actuator substrate 32 is a laminated unit of a substrate layer 32A, the lowest layer, an intermediate spacer layer 32B, and a thin plate layer 32C, the top most layer. Actuator substrate 32 can be thought of as a unitary structure with hollow places 34 in spacer layer 32B formed in positions corresponding to actuators 22.

Figure 3:
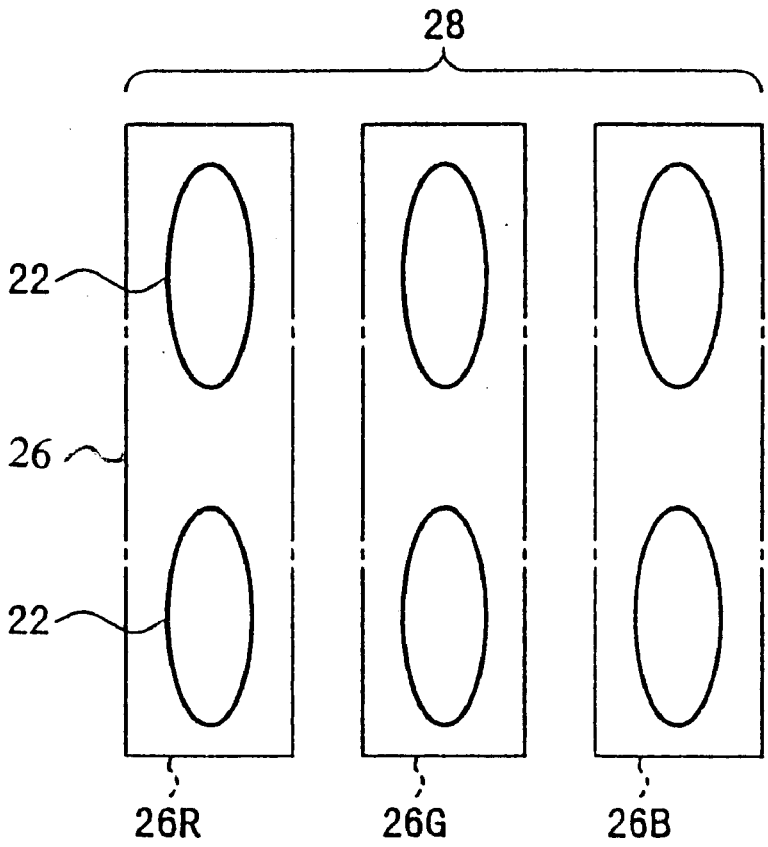
FIG. 3 is an explanatory diagram showing the pixel configuration of a display element.

Referring to FIG. 3, a pixel 28 has three horizontal dots 26R, 26G, and 26B with each dot 26 having two actuators 22 lined up in a vertical direction. Display element 14 (FIG. 1) consists of sixteen lines of pixels 28 (48 dots) in a horizontal direction and 16 lines of pixels (16 dots) in a vertical direction.

Figure 4:
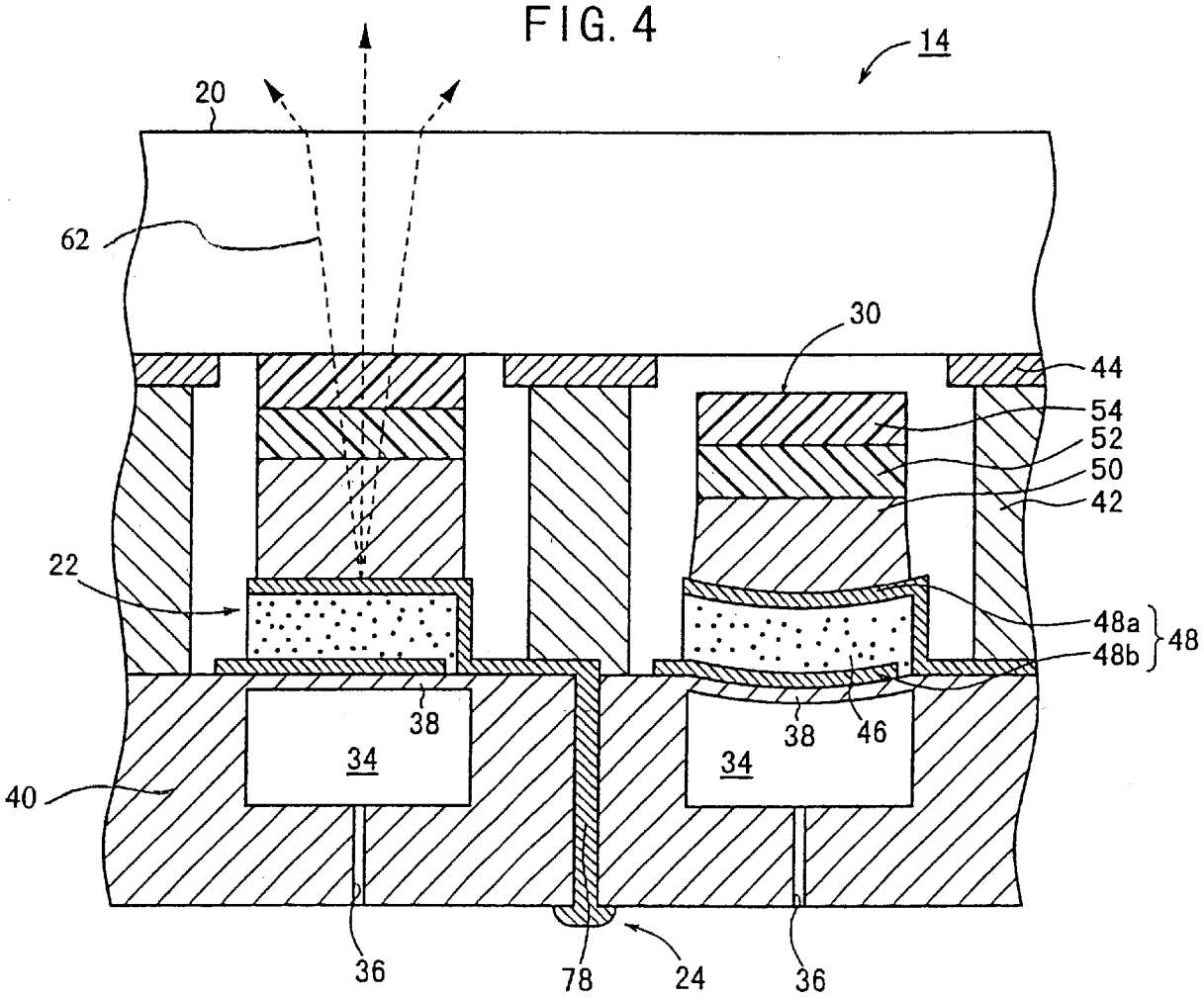
FIG. 4 is a cross sectional drawing showing the first example of the configuration of the actuator and pixel structural unit.

Referring to FIG. 4, actuator 22 includes a shape retaining layer 46 composed of a piezoelectric/electrostrictive layer or an anti-ferroelectric layer etc. formed directly on vibrator 38. A pair of electrodes 48 (row electrode 48*a* and column electrode 48*b*) are formed on the upper and lower faces of shape retaining layer 46.

The pair of electrodes 48 optionally have a structure formed above and below shape retaining layer 46 or alternately on only one side of it, or electrodes 48 may be formed only in the upper part of shape retaining layer 46. A gap forming layer 44 is provided between bar 42 and optical wave guide plate 20. Pixel structural unit 30 can be configured as a laminated unit of white diffuse 50 and color filter 52 with a transparent layer 54 acting as the displacement transfer portion (reference numeral 420 in FIG. 44) formed on actuator 22.

Figure 5:
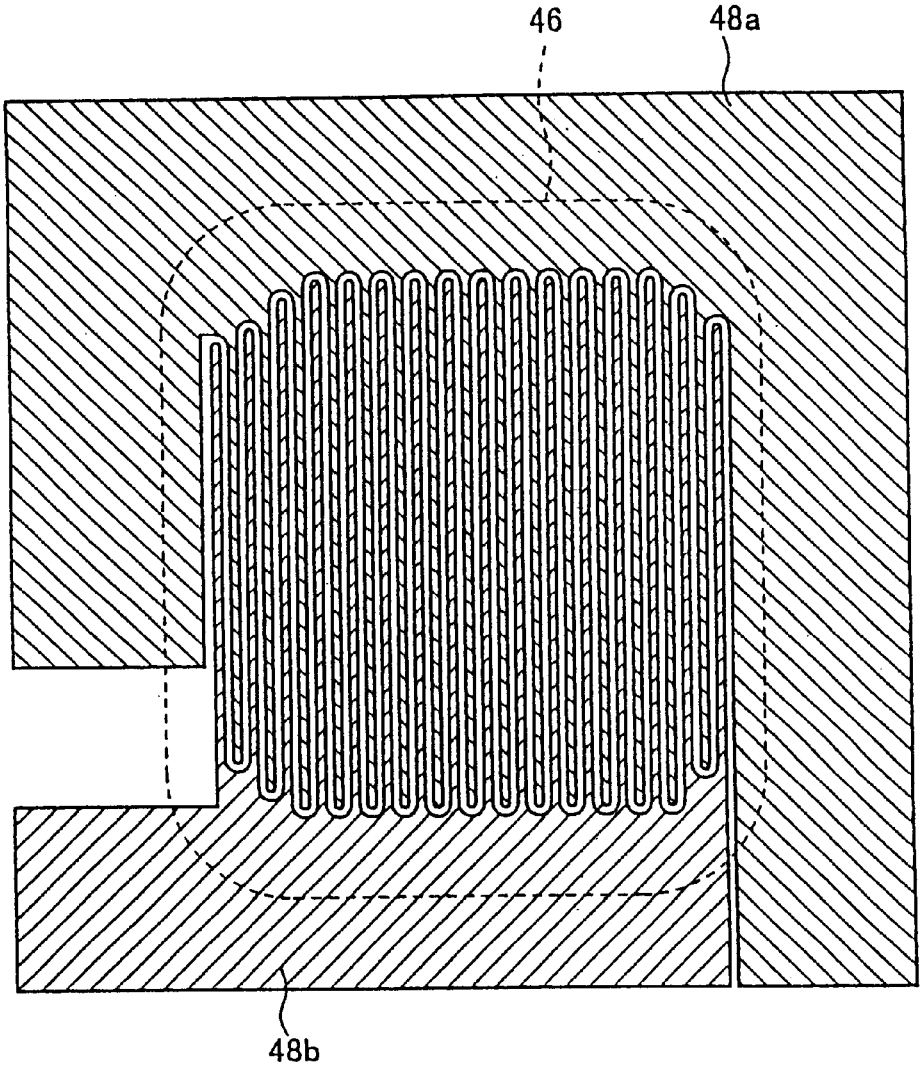
FIG. 5 is a diagram showing one example of the flat configuration of a pair of electrodes formed in the actuator.

When forming the pair of electrodes 48 only in the upper part of shape retaining layer 46, the planar configuration of the pair of electrodes 48 may have a configuration in which numerous comb teeth are juxtaposed complementarily as shown in FIG. 5 or alternately one may adopt a spiral or branched configuration. When the planar configuration of shape retaining layer 46 is an oval configuration and a pair of electrodes 48 are configured as comb teeth, then the comb teeth of the pair of electrodes 48 may be arranged along the major axis of shape retaining layer 46 as shown in FIGS. 6A and 6B or the comb teeth of the pair of electrodes 48 may be arranged along the minor axis of shape retaining layer 46 as shown in FIGS. 7A and 7B.

Figure 6A:
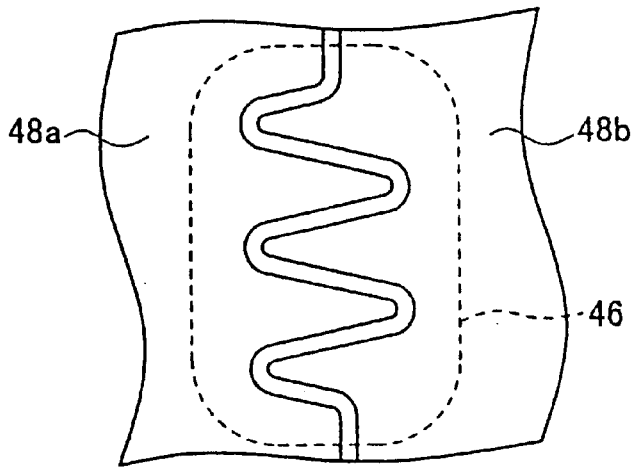
FIG. 6A is an explanatory diagram showing an example of comb teeth of a pair of electrodes arranged following a major axis of shape retaining layer.
Figure 6B:
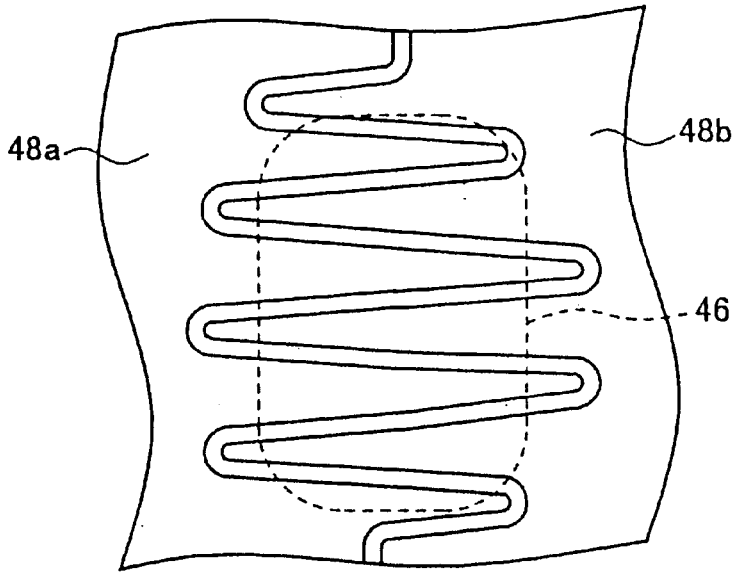
FIG. 6B is an explanatory diagram showing another example of comb teeth of a pair of electrodes arranged following a major axis of shape retaining layer.
Figure 7A:
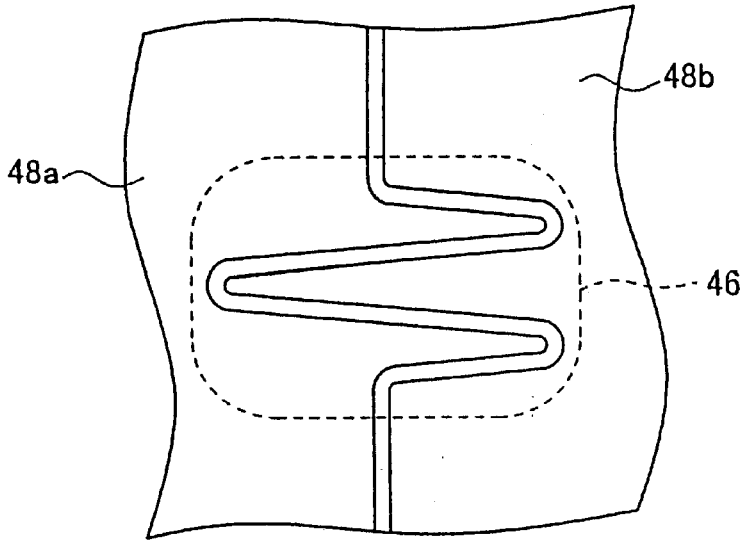
FIG. 7A is an explanatory diagram showing an example of comb teeth of a pair of electrodes arranged following a minor axis of shape retaining layer.
Figure 7B:
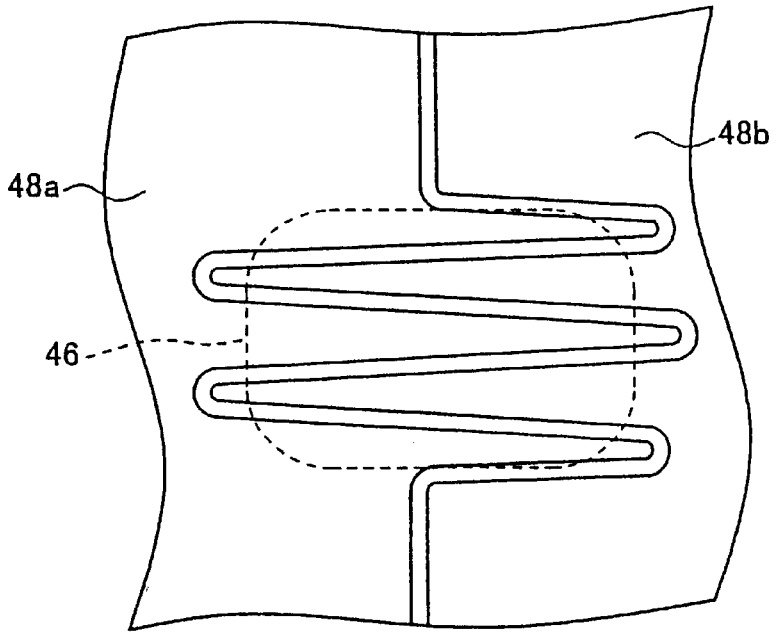
FIG. 7B is an explanatory diagram showing another example of comb teeth of a pair of electrodes arranged following a minor axis of shape retaining layer.

As shown in FIGS. 6A and 7A, the comb teeth configured portion of the pair of electrodes 48 may be included within the planar configuration of shape retaining layer 46 or as shown in FIGS. 6B and 7B, the comb teeth configured portion of the pair of electrodes 48 may protrude from the planar configuration of shape retaining layer 46. The forms shown in FIGS. 6B and 7B are advantageous in the bending and displacement of actuator 22.

Figure 8:
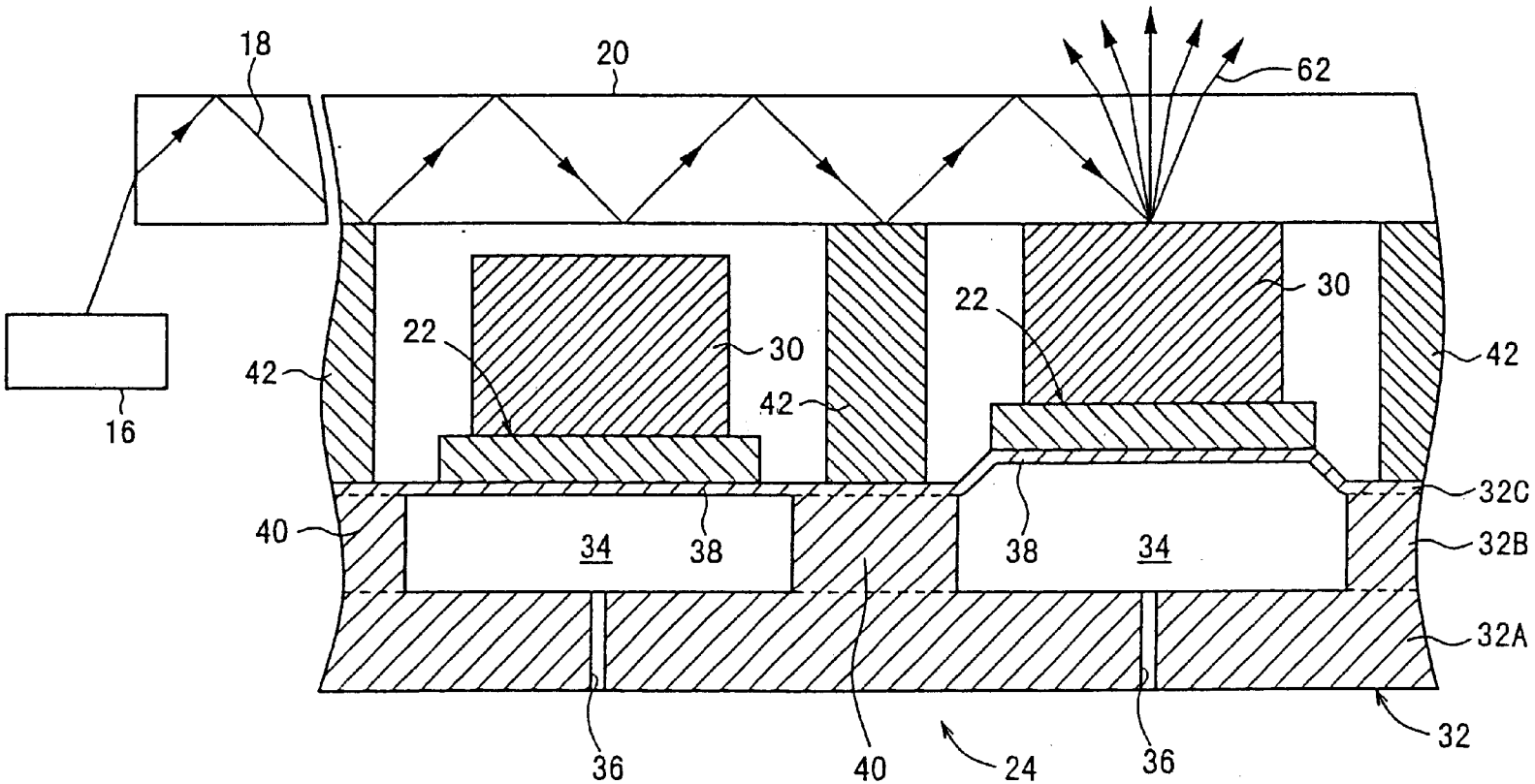
FIG. 8 is a cross-sectional drawing showing another configuration of a display element.

If the pair of electrodes 48 is arranged so that the upper face of shape retaining layer 46 forms row electrode 48*a* and the lower face of shape retaining layer 46 forms column electrode 48*b*, as shown in FIG. 4, it is possible to displace actuator 22 bending it in one direction convex to hollow place 34. Alternately, as shown in FIG. 8, it is possible to displace actuator 22 in another direction so that it will be convex to optical wave guide plate 20. The embodiment shown in FIG. 8 is an instance when gap forming layer 44 (see FIG. 4) is not formed.

Figure 9:
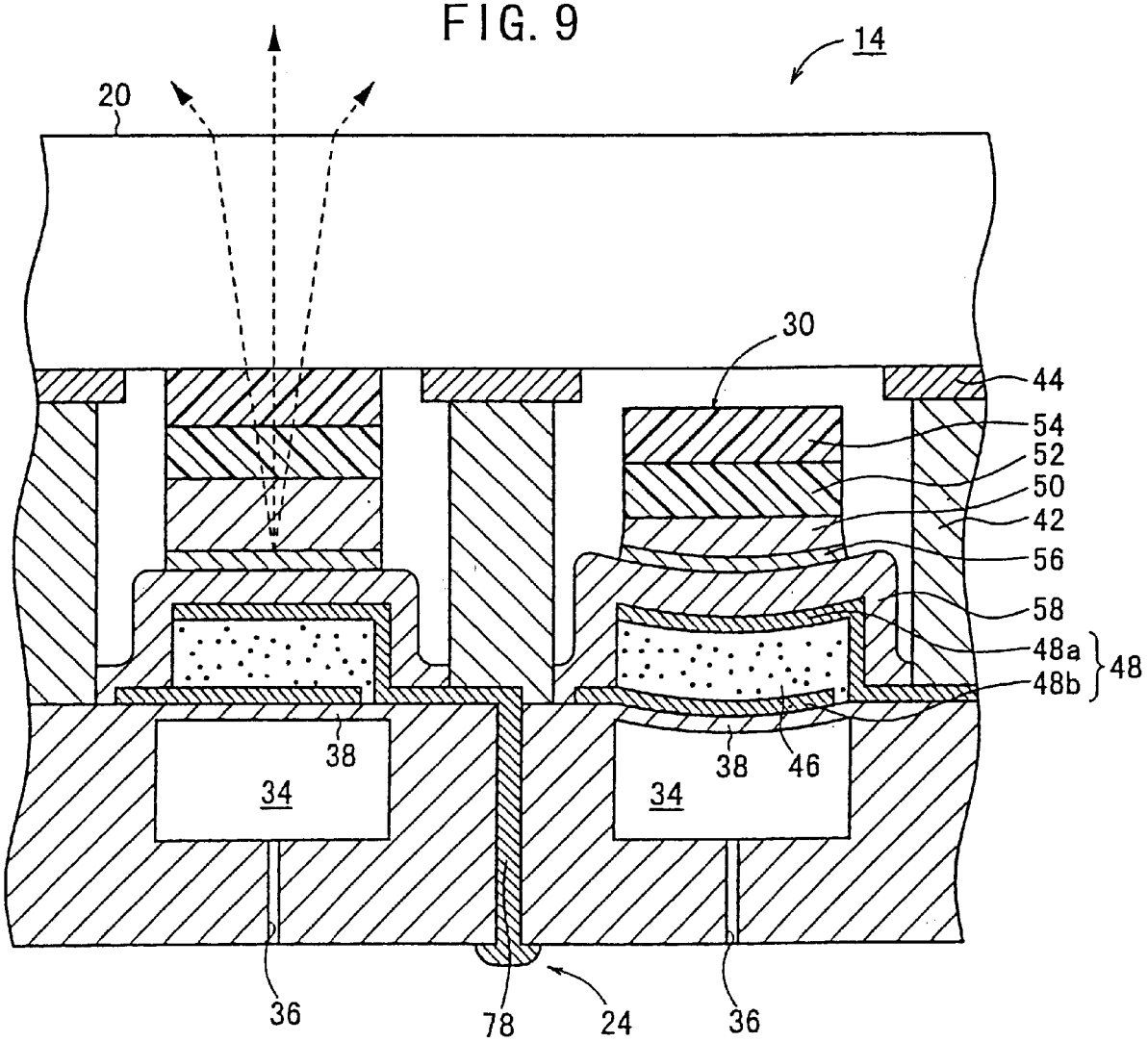
FIG. 9 is a cross-sectional drawing showing a second example of the configuration of the actuator and pixel structural unit.

As shown in FIG. 9, a light reflecting layer 56 may be placed as a layer below white diffusing layer 50. In this case, it is preferable to form insulation layer 58 between light reflecting layer 56 and actuator 22.

Figure 10:
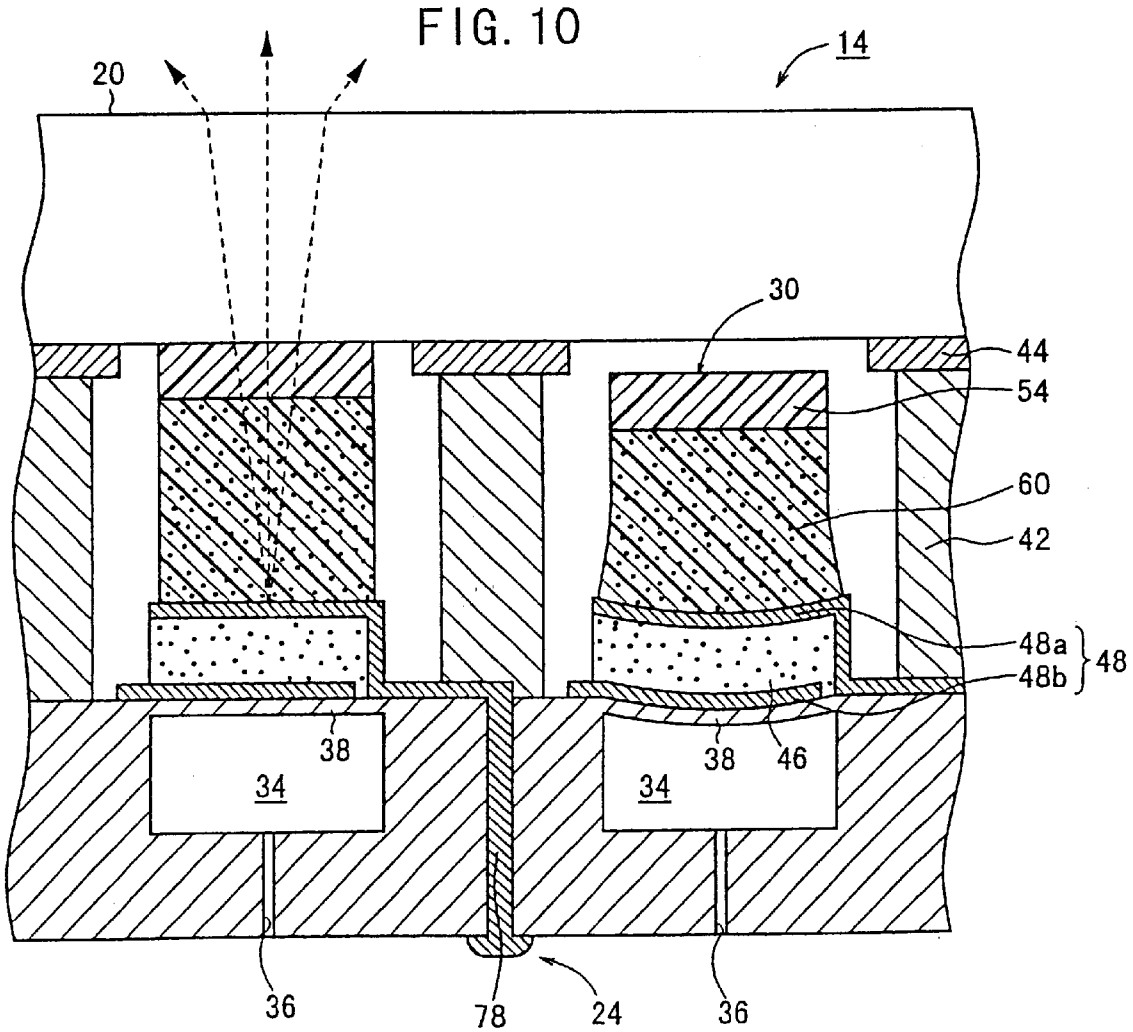
FIG. 10 is a cross-sectional drawing showing a third example of the configuration of the actuator and pixel structural unit.
Figure 11:
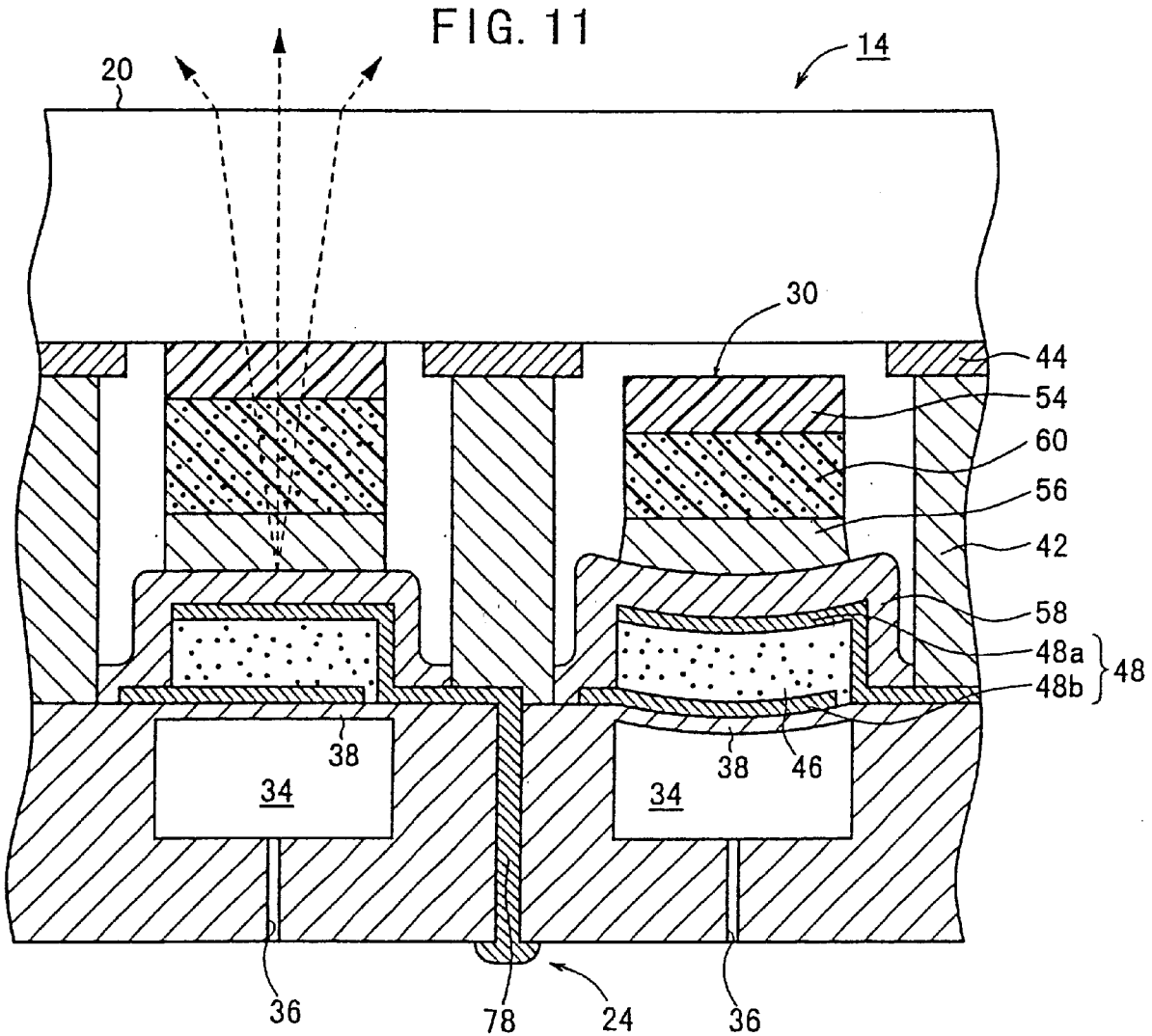
FIG. 11 is a cross-sectional drawing showing a fourth example of the configuration of the actuator and pixel structural unit.
Figure 12:
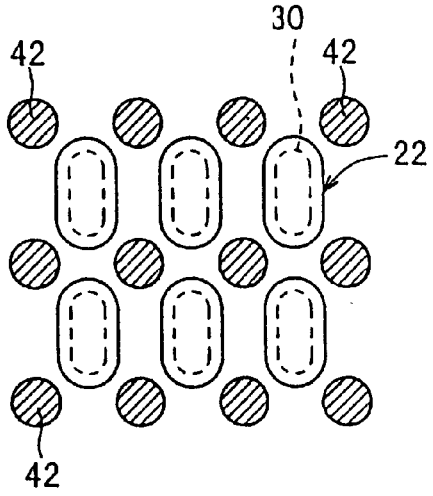
FIG. 12 is an explanatory diagram showing the configuration when respective bars are formed in the four directions of the pixel structural unit.

As shown in FIG. 10, pixel structural unit 30 may also be configured with a laminated unit of color diffuser 60, also functioning as a displacement transfer portion, and transparent layer 54. In this case, light reflecting layer 56 and insulation layer 58 may be interposed between actuator 22 and color diffuser 60.

In addition, display element 14, as FIGS. 2, 4, and 8 show, may be configured to have a bar 42 formed in a portion other than in pixel structural unit 30 between optical wave guide plate 20 and actuator substrate 32. In the embodiment shown in FIG. 8, optical wave guide plate 20 is secured to the top face of bar 42. The material of bar 42 should preferably not be misshapen by heat or pressure.

Bar 42 may be formed in the four directions of pixel structural unit 30, for example. Here the four directions refer to a position corresponding to each corner if pixel structural unit 30 is, for example, a plane nearly rectangular or oval. Each bar 42 has a shape common with adjacent pixel structural units 30.

Figure 13:
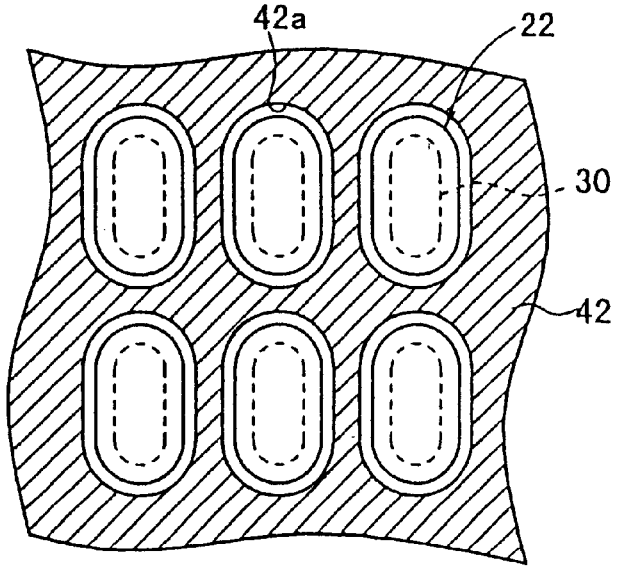
FIG. 13 is an explanatory diagram showing another configuration of bars.

Bar 42 may be configured as shown in FIG. 13 to have a window portion 42*a* which encloses at least one pixel structural unit 30. For a representative example of configuration, for example, bar 42 itself is formed as a plate and in addition, forms window portion (opening) 42*a* which has a configuration similar to the external configuration of pixel structural unit 30 in a position corresponding to pixel structural unit 30. Thus, all of the sides of pixel structural unit 30 will be enclosed by bar 42 and the bond with actuator substrate 32 and optical wave guide plate 20 will be further strengthened.

Here we explain each of the parts configuring display element 14, and in particular, the selection of materials etc. of each of the constituent parts. First, the light incident on optical wave guide plate 20 may be either ultra-violet, visible, or infra-red. For light source 16, incandescent lamps, deuterium discharge lamps, fluorescent lamps, mercury lamps, metal halide lamps, halogen lamps, xenon lamps, tritium lamps light emitting diodes, lasers, plasma light sources, hot cathode tubes, and cold cathode tubes etc. are used.

Vibrator 38 is preferably of high heat resistant material. The reason for this is that when making actuator 22 into a structure which directly supports vibrator 38 by virtue of securing portion 40, and materials inferior in heat resistance such as organic glues are not used, vibrator 38 should preferably be made of high heat resistant material so that vibrator 38 does not change qualitatively while shape retaining layer 46 is forming. Vibrator 38 should preferably be an electrically insulating material in order to separate the circuits to row electrode 48*a* and column electrode 48*b* (for example data circuits) in the pair of electrodes formed on actuator substrate 22. Thus, vibrator 38 may be a highly heat resistant metal or a hollow etc. material whose metal surface is covered with a ceramic material such as glass but ceramics are most suitable.

The ceramic material comprising vibrator 38 can be stabilized zirconium oxide, aluminum oxide, magnesium oxide, titanium oxide, spinel, mullite, aluminum nitride, silicon nitride, glass, or compounds of the above. Stabilized zirconium oxide is particularly preferable for various reasons: it has exceptional mechanical strength even though vibrator 38 may be thin, it is very tough, and there is very little chemical reactivity with shape retaining layer 46 and the pair of electrodes 48. Stabilized zirconium oxide includes stabilized zirconium oxide as well as partially stabilized zirconium oxide. Since the ceramic will have a cubic etc. crystalline structure with stabilized zirconium oxide, phase changes will not occur.

On the other hand, zirconium oxide phase changes to monoclinic or tetragonal at around 1000° C. and at the time of this phase change cracks may occur. Stabilized zirconium oxide contains 1–30 mol % of stabilizing agents of such things as calcium oxide, magnesium oxide, yttrium oxide, scandium oxide, ytterbium oxide, cerium oxide or oxides of rare earth metals. To enhance the mechanical strength of vibrator 38, the stabilizing agent should include yttrium oxide. For this it should contain 1.5–6 mol % yttrium oxide and more preferably should contain 2–4 mol %. Still more preferably, it should contain 0.1–5 mol % of aluminum oxide.

Crystal phase may be a compound phase of cubic plus monoclinic, a compound phase of tetragonal plus monoclinic or a compound of cubic plus tetragonal plus monoclinic etc. but those in which the principal crystal is either tetragonal or tetragonal plus cubic are preferable from the standpoint of strength, toughness and durability.

When vibrator 38 comprises a ceramic material, numerous crystal grains configure vibrator 38, and in order to enhance the mechanical strength of vibrator 38, the mean particle size should preferably be from 0.05 to 0.2 $\mu$m and still more preferably be from 0.1 to 1 $\mu$m.

Securing portion 40 should preferably consist of ceramic material which may be the same ceramic as the material comprising vibrator 38 or may be different. For the ceramic material configuring securing portion 40, similar to the material of vibrator 38, there may be used stabilized zirconium oxide, aluminum oxide, magnesium oxide, titanium oxide, spine, mullite, aluminum nitride, silicon nitride, glass, or compounds thereof. In particular, the actuator substrate 32 used in display element 14 should preferably be a material whose main constituent is zirconium oxide, a material whose main constituent is aluminum oxide or a material whose main constituent is a compound of these. Most preferable would be a material whose main constituent is zirconium oxide.

While clay is sometimes added as a sintering agent, there is a need to adjust the composition of the sintering agent so that it does not include excess amounts of things such as silicon oxide and boron oxide which are easily vitrified. The reason for this is that while these easily vitrified materials are advantageous in uniting actuator substrate 32 and shape retaining layer 46, they accelerate the reaction between actuator substrate 32 and shape retaining layer 46 and it becomes difficult to maintain a specified composition of a shape retaining layer so that they become causes for degradation of the characteristics of the element. More specifically, it is preferable to restrict the proportion by weight of silicon oxide to 3% or less and even more preferable to restrict it to 1% or less. Here the main constituent refers to a constituent which exists in a proportion of 50% or more by weight.

As noted earlier shape retaining layer 46 may use a piezoelectric/electrostrictive layer or anti-ferroelectric layer. When a piezoelectric/electrostrictive layer is used as shape retaining layer 46 any of the following ceramics or a ceramic containing a combination of any them may be used for a piezoelectric/electrostrictive layer: lead zirconate, lead magnesium niobate, lead nickel niobate, lead zinc niobate, lead manganese niobate, lead magnesium tantalate, lead nickel tantalate, lead antimony stannate, lead titanate, barium titanate, lead magnesium tungstate and lead cobalt niobate. Anything in which the main constituent contains 50% or more of these compounds by weight will suffice. In addition, of the ceramic materials noted above, ceramic materials containing lead zirconate are the most frequently used constituent material comprising the piezoelectric/electrostrictive layer which configures shape retaining layer 46.

When the piezoelectric/electrostrictive layer is composed of ceramic material, in addition oxides of lanthanum, calcium, strontium, molybdenum, tungsten, barium, niobium, zinc, nickel and manganese or any combination of these or other compounds may be suitably added to the ceramic materials noted earlier. For example, it is preferable to use a ceramic in which the main constituent consists of lead magnesium niobate, lead zirconate and lead titanate and in addition contains lanthanum and strontium.

The piezoelectric/electrostrictive layer may be fine and may also be porous and when it is porous, porosity should be preferably 40% or less. When an anti-ferroelectric layer is used for shape retaining layer 46, it is desirable to use something in which the main constituent is lead zirconate, something in which the main constituent is a constituent composed of lead zirconate and lead stannate, in addition a something which has added lanthanum oxide to lead zirconate, and something which has added lead zirconate and lead niobate to constituents composed of lead zirconate and lead stannate. It is particularly desirable when an anti-ferroelectric film containing constituents composed of lead zirconate and lead stannate (as in the composition $Pb_{0.99}Nb_{0.02}[(Zr_x\ Sn_{1-x})_{1-y}\ Ti_y]_{0.98}O_3$ where $0.5<x<0.6$, $0.05<y<0.063$, $0.01<Nb<0.03$) is applied as a film type element like actuator 22, since it can drive comparatively low voltages. In addition this anti-ferroelectric film may be porous and if it is porous, porosity should preferably be 30% or less.

For forming shape retaining layer 46 on vibrator 38, various methods of forming thick film may be used such as screen printing, dipping, paint application, and electrophoresis as well as various methods of forming thin film such as ion beam, sputtering, vacuum evaporation, ion plating, chemical vapor deposition (CVD) and plating. The most suitable methods for forming shape retaining layer 46 on vibrator 38 in this embodiment are methods for forming thick films such as screen printing, dipping, paint application and electrophoresis. These methods are best because they form using a paste, slurry, suspension, emulsion or sol with piezoelectric ceramic particles with a mean particle size of 0.01 to 5 $\mu$m, or 0.05 to 3 $\mu$m and can obtain good piezoelectric operating characteristics. Particularly, electrophoresis can form a very dense film moreover it can do so with great precision with characteristics described in technical literature such as the article by Kazuo Anzai on pages 63–68 of *Denki Kagaku Oyobi Kogyo Butsurigaku* (Electrochemistry and Industrial Physical Sciences) (1985), or the articles on pages 5–6 and 23–24 in Advance Manuscripts, Proceedings of first Symposium on Advanced Methods of forming Ceramics (1998). Thus the most suitable methods may be selected taking into consideration precision and reliability.

The thickness of vibrator 38 and the thickness of shape retaining layer 46 should preferably be of the same dimension. The reason for this is that if the thickness of vibrator 38 is much thicker than the thickness of shape retaining layer 46, i.e., if they differ by one or more columns, stress where shape retaining layer 46 and actuator substrate 22 meet increases and they tend to come apart more easily since vibrator 38 works against the firing shrinkage of shape retaining layer 46. Conversely, if the thickness is of the same dimension, their unification is optimal since the actuator substrate (vibrator 38) easily follows the firing shrinkage of shape retaining layer 46. More specifically, the preferred thickness for vibrator 38 is from 1 to 100 $\mu$m, even better is a thickness from 3 to 50 $\mu$m, and better yet is a thickness of from 5 to 20 $\mu$m. On the other hand, the preferred thickness for shape retaining layer 46 is from 5 to 100 $\mu$m, while from 5 to 50 $\mu$m is better and still better is a thickness of from 5 to 30 $\mu$m.

The appropriate thickness of row electrode 48*a* and column electrode 48*b* which are formed on the upper face and lower face of shape retaining layer 46 or the pair of electrodes 48 which are formed on shape retaining layer 46 is chosen according to use but should preferably be from 0.01 to 50 $\mu$m thick and better yet should be from 0.1 to 5 $\mu$m thick. Row electrode 48*a* and column electrode 48*b* are solid at room temperature and should preferably be composed of conductive metals, such as, for example, metals containing aluminum, titanium, chrome, iron, cobalt, nickel, copper, zinc, niobium, molybdenum, ruthenium, rhodium, silver, tin, tantalum, tungsten, iridium, platinum and lead or alloys. Needless to say these elements may be combined as desired.

Optical wave guide plate 20 must be one which in its front face and back face have a light refraction index such that (1) light 18 introduced into its interior is completely reflected without being transmitted to the exterior of optical wave guide plate 20, (2) it has a uniform transmission factor in the wave length range of the introduced light 18, and (3) must be high. If it fulfills these characteristics there are no particular restrictions on the material from which it may be made but more specifically this includes such things as glass, quartz, translucent plastics such as acrylic, translucent ceramics etc. or laminated units of materials which have different indexes of refraction or objects which have a coating on the surface.

The colored layers of color filter 52 and color scatterer 60 contained in pixel structural unit 30 are layers which are used for extracting light of specific wave length ranges, for example, those which generate a color by absorbing, transmitting, or dispersing light of a specific wave length and those which cause incident light to be converted to that of another wave length. Transparent bodies, translucent bodies and opaque bodies may be used singly or in combination. Pigments and fluorescent bodies such as dyes, cosmetics and ions which are dispersed and dissolved in rubber, organic resins, translucent ceramics, glass, liquids and things which are applied to their surfaces, and in addition powders of the pigments and fluorescent bodies mentioned earlier which are sintered, pressed and solidified etc may be used singly or in combination.

The difference between color filter 52 and color scatterer 60 is that when light 18 introduced into optical wave guide plate 20 contacts pixel structural unit 30 and generates light, if the brightness value of leakage light due to reflection and scattering only at the colored layer is 0.5 times or greater of the brightness value due to leakage light reflection and scattering of the entire structural unit including pixel structural unit 30 and actuator 22, that color layer is defined as color scatterer 60; whereas if it is less than 0.5 times then that color layer is defined as color filter 52.

To give a specific example of the method of measurement, when light 18 contacts the color layer on the back of optical wave guide plate 20, the front brightness of light leaked to the front face passing this optical wave guide plate 20 from this color layer is A(nt). If the front brightness of light leaked to the front face when light 18 contacts pixel structural unit 30 on the opposite face adjacent to optical wave guide plate 20 of this color layer is B(nt), then when $A \leqq 0.5 \times B$ is satisfied, then the color layer is color scatterer 60, but when $A < 0.5 \times B$ is satisfied, then the color layer is color filter 52. The front brightness refers to the brightness measured when a line connecting a brightness meter and the color layer is perpendicular to the plane contacting the color layer of the optical wave guide plate, i.e, when the detecting plane of the brightness meter is parallel to the plate face of optical wave guide plate 20.

The advantage of color scatterer 60 is that it is difficult for tone and brightness to vary due to the thickness of a layer. While strict control of layer thickness is difficult in forming layers, they are inexpensive and multiple applications such as screen printing are possible. In addition, due to color scatterer 60 also functioning as a displacement transmitter, the layer forming process can be simplified. Since the overall layer thickness can be thinner, it is possible to make display element 14 thinner overall. It is also possible to prevent reduction in the amount displacement of actuator 22 and to improve the speed of response.

The advantages of having color filter 52 are that layer formation is easy when forming a layer on the side of optical wave guide plate 20 because optical wave guide plate 20 is flat and the surface is very smooth, there are more options in selection of processes, it is inexpensive, and the layer thickness, which affects tone and brightness, is easy to control.

There are no particular restrictions on methods of forming films of color layers of color filter 52 and color scatterer 60 and various well-known methods of film formation may be used. For example, besides the film affixing method in which a film shaped color layer is directly affixed on the faces of optical wave guide plate 20 and actuator 22 in a chip configuration there are various methods by which films can be formed with powders, pastes, liquids, gases and ions and color layers formed by various methods of thick film formation such as screen printing, photo-lithography, spraying dipping, paint application, and electrophoresis as well as various methods of forming thin films such as ion beam, sputtering, vacuum evaporation, ion plating, chemical vapor deposition (CVD) and plating.

A light emitting layer may be provided on all or a part of pixel structural unit 30. A fluorescent light body layer may be this light emitting layer. This fluorescent light body layer may be excited by invisible light (ultra-violet or infra-red light), may emit visible light, or may be excited by visible light and emit visible light. Fluorescent pigment materials may be used for the light emitting layer. Brightness exhausting fluorescent bodies, phosphorescent bodies, or light accumulating pigments may also be used. Organic or inorganic forms of these materials may be used.

The light emitting materials described above are preferably used to form a light emitting layer by themselves. The light emitting materials dispersed in a resin may be used to form a light emitting layer, or the light emitting material dissolved in a resin may be used to form a light emitting layer. The afterglow time of light emitting materials should be preferably one second or less and preferably less than thirty milliseconds. Still better would be a few milliseconds.

If all or part of pixel structural unit 30 is used as the light emitting layer, there are no particular restrictions on light source 16 as long as it has sufficient energy density to for excitation, including light of a wave length which excites the light emitting layer. For example, cold cathode tubes, hot cathode tubes, metal halide lamps, xenon lamps, lasers including infra-red lasers, black lights, halogen lamps, incandescent lamps, deuterium discharge lamps, fluorescent lamps, mercury lamps, tritium lamps, light emitting diodes, plasma light sources etc. may be used.

Referring back to FIGS. 2 and 4, the operation of display element 14 is explained. An offset voltage of 10 V is used for the offset electrical potential which is applied to row electrode 48*a* of each actuator 22, while 0 V and 60 V are used for the electrical potential applied to column electrode 48*b* of each actuator for the ON signal and OFF signal, respectively, as shown in FIG. 14. Thus, in actuators 22 in which an ON signal is applied to column electrode 48*b*, there is a low level voltage (−10 V) between column electrode 48*b* and row electrode 48*a* while in actuators 22 in which an OFF signal has been applied to column electrode 48*b*, there is a high level voltage (50 V) between column electrode 48*b* and row electrode 48*a*.

Light 18 is introduced to the system, for example, from the end of optical wave guide plate 20. With an OFF signal applied to column electrode 48*b* of the actuator shown on the right side of FIG. 4, pixel structural unit 30 does not contact optical wave guide plate 20, thus causing all of light 18 to be completely reflected internally without being transmitted through the front and back surfaces of optical wave guide plate 20. The refraction index of optical wave guide plate should be preferably from 1.3 to 1.8 and better yet from 1.4 to 1.7.

In a natural state of actuator 22, i.e., when an ON signal is applied to column electrode 48*b* of the actuator shown on the left side of FIG. 4, light 18 is reflected by the surface of pixel structural unit 30, becoming scattered light 62 because the end of pixel structural unit 30 contacts the back face of optical wave guide plate 20 at a distance which is equal to or less than the wave length of light 18. This scattered light 62 is partially reflected again in optical wave guide plate 20 while the greater portion of scattered light 62 passes the front face (surface of optical wave guide plate 20) without being reflected by optical wave guide plate 20. By virtue of this, all of actuator 22 comes into an ON state and that ON state is manifested by emitting light. Moreover, the color of the emitted light is a color corresponding to the colors of color filter 52 or color scatterer 60 (FIGS. 10 and 11) contained in pixel structural unit 30 or to the colors of the light emitting layer. When all the dots of pixel 28 are on, i.e., dots 28R, 28G, and 28B, white is displayed from the screen of display 10 because all of the actuators 22 are in an ON state.

When an OFF signal is applied to an actuator 22 corresponding to a certain dot 26, this actuator 22 bends and displaces/changes position so that it is convex to hollow place 34 as shown in FIG. 2. In other words, it bends and displaces to one direction, thus causing the end of pixel structural unit 30 to separate from optical wave guide plate 20. The actuator 22 goes into an OFF state which manifests in the light being extinguished. In other words, display 10 controls whether or not light is emitted (leaked) in the front face of optical wave guide plate 20 by whether or not pixel structural unit 30 contacts optical wave guide plate 20.

In particular, a color image (character or graphic etc.) can be displayed corresponding to an image signal in the front surface, i.e., the display surface, of optical wave guide plate 20 in the same way as a cathode ray tube, liquid crystal display device, or plasma display by controlling the displacement action of each pixel corresponding to the attributes of an input image signal.

Figure 15:
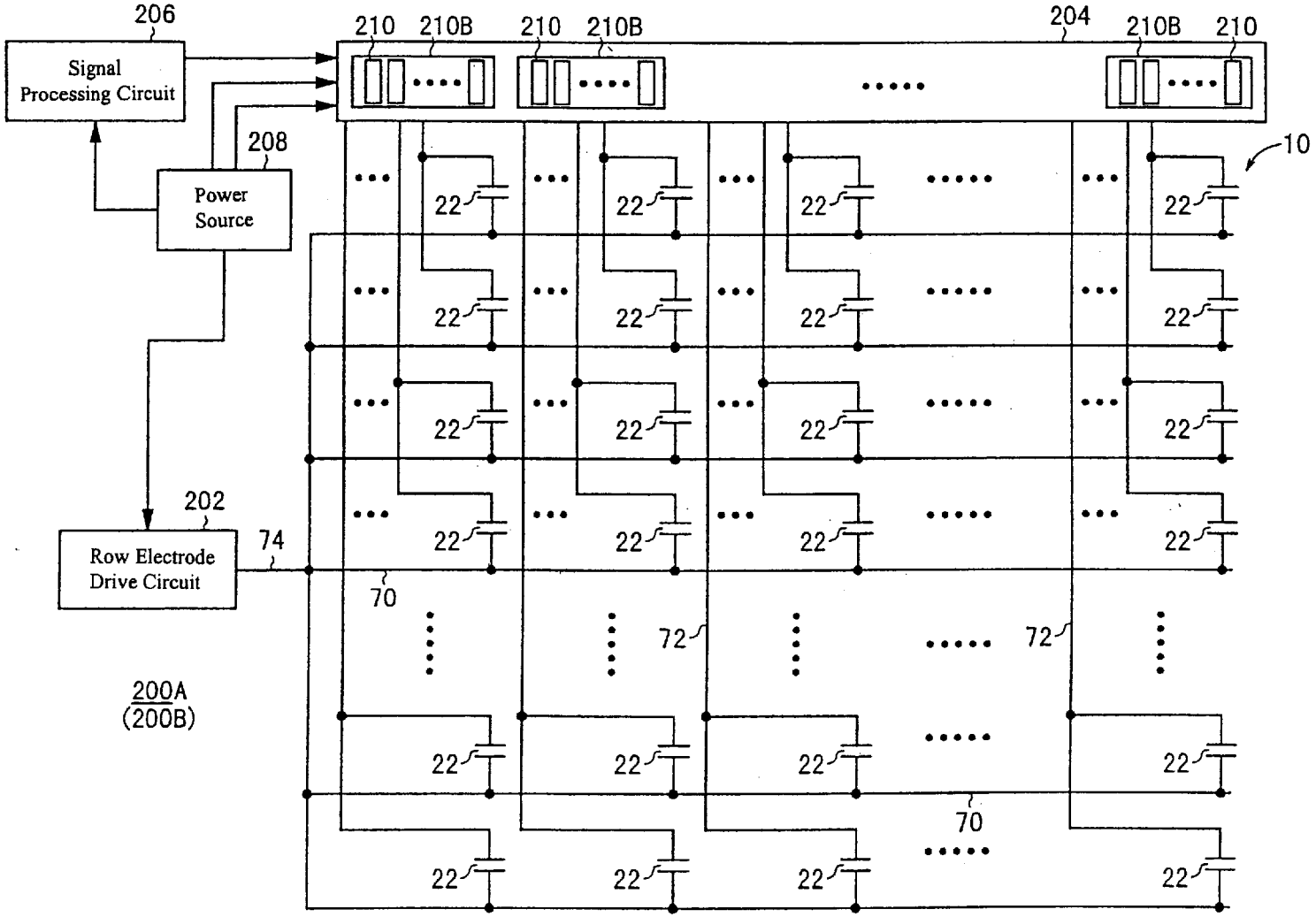
FIG. 15 is a circuit diagram showing the configuration of the drive device of the first and second embodiments.

Referring also to FIG. 15, the wiring to row electrode 48*a* and column electrode 48*b* includes a wire 70 for each row of multiple actuators and a data wire 72 for each dot. All the wires 70 are joined into a common wire 74. Column electrode 48*b* of actuator 22 and data wire 72 are connected, while wire 70 is connected to all actuators 22 of each row. Data wire 72 is formed on the back side of actuator substrate 32. Wire 70 is drawn from row electrode 48*a* and is wired in series for each row. Column electrode 48*b* and data wire 72 are connected electrically through hole 78 formed in actuator substrate 32. An insulation film of silicon oxide, glass or resin (not shown) is interposed where each wire 70 and data wire 72 intersect in order to provide insulation between wires 70 and 72. Referring to FIG. 15, a drive device 200A of the first embodiment is configured to have a row electrode drive circuit 202 packaged in the periphery of display 10, a column electrode drive circuit 204, and a signal processing circuit 206 which controls at least column electrode drive circuit 204. Row electrode drive circuit 202 is configured so that it supplies an offset electrical potential (bias potential) to row electrodes 48*a* of actuators 22 via common wire 74 and respective wires 70. Offset power voltage is provided through an electric power source 208. Column electrode drive circuit 204 is configured to have a multiple driver IC 210B which includes a specified number of driver outputs 210 corresponding to the total number of dots. Driver IC 210B outputs a data signal in parallel to each data wire of display 10.

Each driver IC 210B has a shift register 212 (FIG. 16) configured with 240 bits for example, and is configured so that respective data transfer sections 230 and driver outputs 210 are connected for each bit of this shift register 212. Each bit data of the data of the 240 bits (block data Db) supplied to shift register 212 is dot data Dd for supplying respective corresponding dots.

Figure 16:
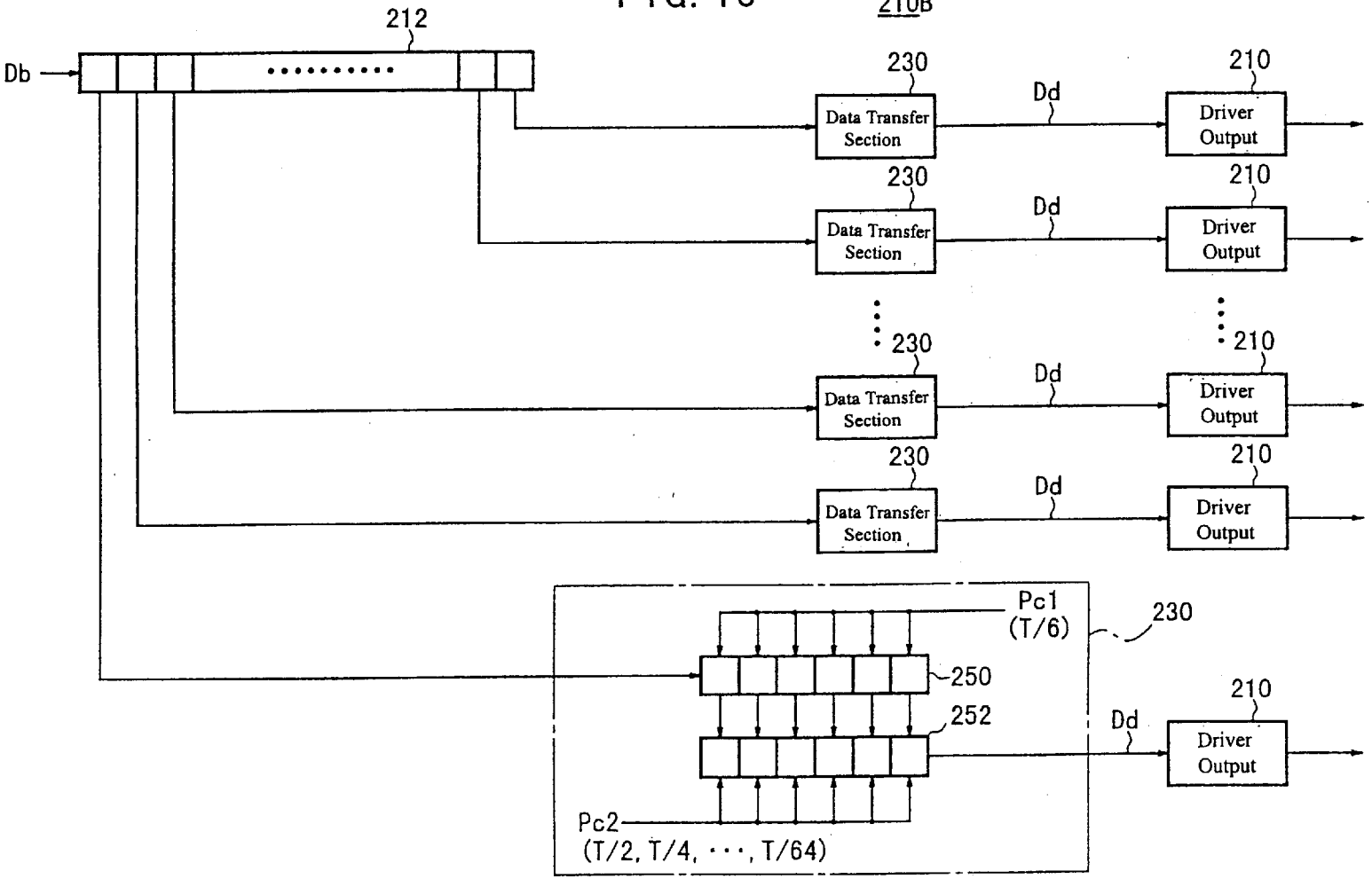
FIG. 16 is a block diagram showing the configuration of driver IC in column electrode drive circuits of the drive device of the first embodiment.
Figure 17:
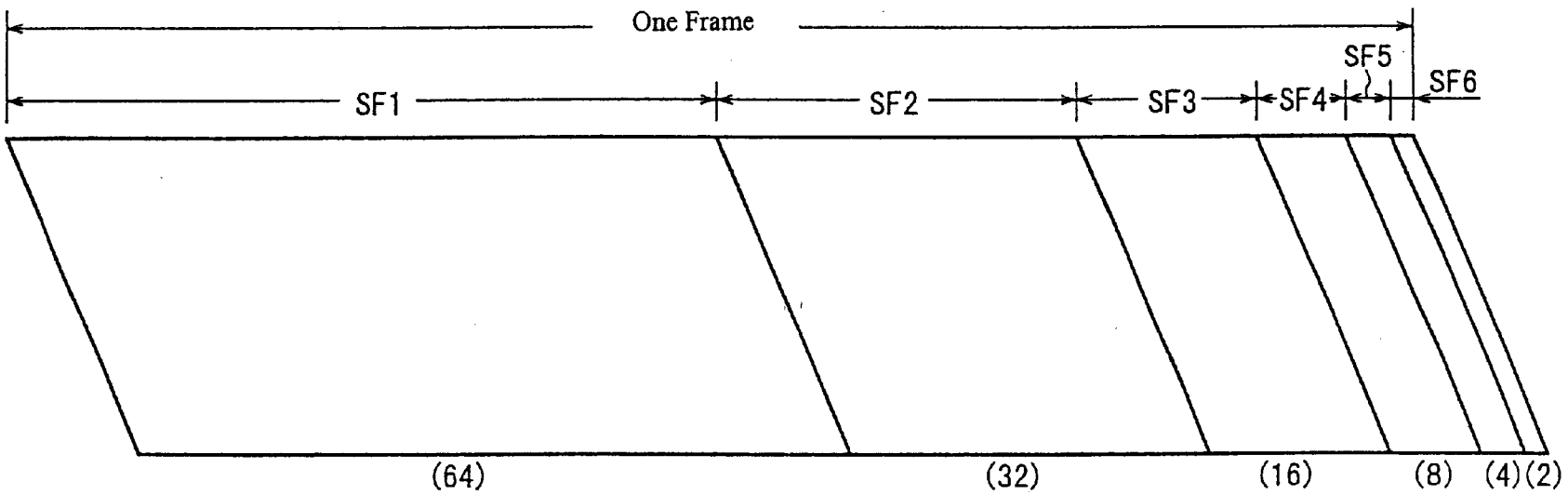
FIG. 17 is a diagram showing examples in which one frame in particular is divided up into numerous sub-fields in order to explain gradation control in the drive device of the first embodiment.

Referring to FIG. 16, a data transfer section 230 is optionally configured with two shift registers, first shift register 250 and second register 252. First shift register 250 receives dot data Dd in series due to bit shifting action based on a constant shift clock Pc1 (=T/6), and at the stage where 6-bit dot data Dd has been received may be configured with a serial input parallel output shift register which outputs the 6-bit dot data in parallel. Second shift register 252 receives dot data Dd stored in first shift register 250 in parallel, and may be configured with a parallel input serial output shift register which successively outputs the bit information of dot data Dd based on shift clock Pc2 which has timing (T/2, T/4, . . . , T/64) corresponding to the time duration of subfields SF1–SF6 as shown in FIG. 17.

That is to say, the bit information of the zero bit stored in the LSB (least significant bit) is supplied as is to a corresponding driver output 210 of column electrode drive circuit 204 in this second shift register 252 when transferred from first shift register 250. When the first shift clock Pc2 (=T/2) has elapsed, all bit information is bit shifted to the right side, and bit information of the first bit located in the LSB will be supplied, as is, to driver output 210. Then, when shift clock Pc2 (=T/4) has elapsed, all bit information is shifted to the right side and the bit information of the second bit in the LSB is supplied, as is, to driver output 210. In the same way, when shift clock Pc2 successively elapses to T/8, T/16, T/32 and T/64, all bit information bit shifts and the bit information of the third, fourth, fifth and sixth bits which become positioned in the LSB is successively supplied to driver output 210.

Then, two levels of power source voltages for data are supplied through power source 208 to each driver output 210. As data wire 72 is connected to all dots from column electrode drive circuit 204, it is necessary to maintain a wide area for directing data wire 72. In addition, there is a need to take wiring circuit capacity and resistance into consideration which comes with increasing the wiring length of data wire 72 as well as the influence of the decay time constant (attenuation etc. of the signal). However, in this embodiment, for the direction of data wire 72 from column electrode drive circuit 204 it is sufficient to think in terms of display element 14 units and it is not necessary to maintain an area for broad wiring since this display is divided into 1200 display elements 14. In addition, since it is sufficient to think in terms of display element 14 units for wiring capacity and wiring resistance as well, attenuation of signals does not occur.

The two voltages for data must include one voltage of a sufficiently high level to bend and displace actuator 22 downward and one voltage of a sufficiently low level to restore actuator 22 to its original state. Signal processing circuit 206 uses the time modulated method and is configured so that it controls the column electrode drive circuit that must control gradation.

Figure 18:
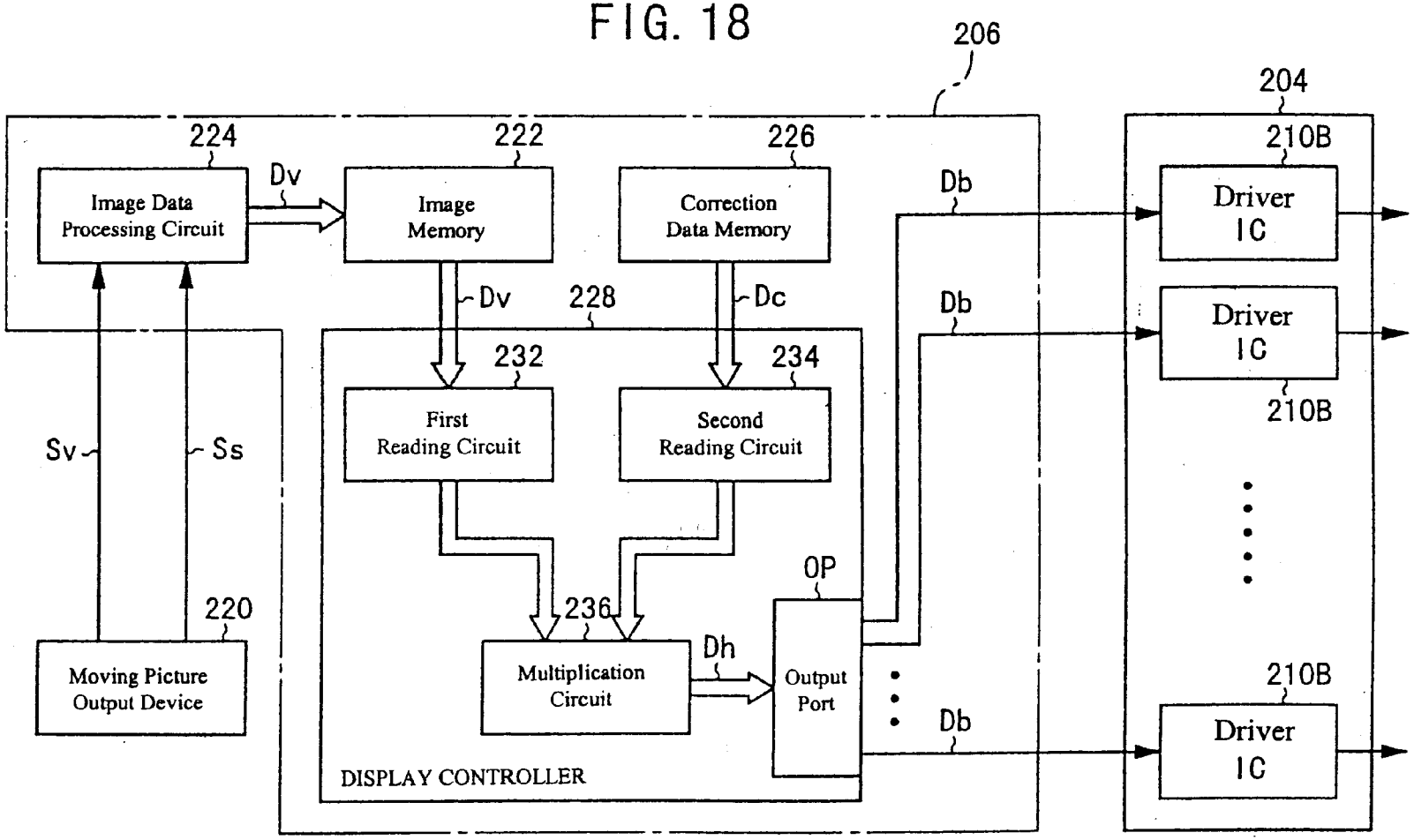
FIG. 18 is a block diagram showing signal processing circuits in the drive device of the first embodiment.

Referring to FIGS. 17–18, gradation control using the temporal modulation method is explained. Assume that the display period or interval of one image is one frame, and that when this one frame is divided, for example into six intervals, that one of these intervals is a subfield. Assume it is specified that the initial subfield (first subfield SF1) is of the longest duration with each subfield shorter than the previous one by one-half. If the duration of these subfields is expressed in terms of data values, as shown in FIG. 17, where the duration of first subfield SF1 is assumed to be "64" for example, second subfield SF2 would be designated as "32," the third subfield SF3 would be designated as "16," the fourth subfield would be designated as "8," the fifth subfield as "4," and the sixth as "2."

Then, signal processing circuit 206 allocates/assigns/allots display times corresponding to respective gradation levels for all dots for each subfield SF1 through SF6, creates dot data, and outputs this dot data as respective data signals to each subfield SF1 through SF6 through column electrode drive circuit 204. Here, in the case of data for one dot, since the display time corresponding to that dot's gradation level is apportioned to the time width allotted to each subfield, there are times when they are apportioned to all subfields as well as times when they are apportioned to a number of subfields. For example, when the gradation level for this dot is 126, all subfields SF1 through SF6 are selected and the dot data is bit string "000000." Again, when the gradation level is 78, first, fourth, fifth, and sixth subfields, SF1, SF4, SF5 and SF6, are selected and the dot data is bit string "011000."

The data signal is an analog signal which varies from high level to low level corresponding to each bit information of bit strings configuring dot data. If the bit information is logically "0" it is made a low level voltage (ON signal), but if the bit information is logically "1" then it is a high level voltage (OFF signal). That is to say, the output form of data signals output to the relevant actuator 22 is an ON signal (low level voltage) output for selected subfields, and an OFF signal (high level voltage) output for subfields not selected.

Signal processing circuit 206 is configured with a display controller 228. A progressive type moving picture signal Sv (such as, for example, an analog moving picture signal) and a synchronizing signal Ss from a moving picture output device 220 are input to an image data processing circuit 224 which converts it into digital moving image data Dv in frame units which is written to an image memory 222 (frame buffer). A correction data memory 226 records gradation correction data Dc specified in dot units. Display controller 228 inputs image data Dv from image memory 222 and gradation correction data Dc from correction data memory 226, multiplies these, and creates corrected image data Dh.

Moving picture output device 220 may be, for example, a VTR (video tape recorder, also known as a VCR), or personal computer etc. which receives moving pictures recorded in a recording medium or moving pictures sent and received by a transmission such as radio, broadcast TV, and cable.

Display controller 228 includes a first reading circuit 232 which reads image data Dv from image memory 222 and a second reading circuit 234 which reads gradation correction data Dc from correction data memory 226. Display controller 228 also includes a multiplication circuit 236 which multiplies image data Dv and gradation correction data Dc read from first and second reading circuits 232 and 234 to create corrected image data Dh (image data in which the bit data of bit numbers corresponding to maximum gradation are arranged in dot units). An output port 238 outputs corrected image data Dh obtained from multiplication circuit 236 in parallel.

The data transfer rate in driving device 200A of this embodiment is computed as $$43\ \text{Hz}\times 6\ \text{bit}\times(640\times 3\times 480)=238\ \text{Mbps}$$

from the need to transfer 6 bits of data per dot in a period of one frame T. Then, if the clock for column electrode drive circuit 204 uses a 1 MHz IC, then 238 bits in parallel are necessary (238 MHz/1 MHz=238).

Thus, an output port OP in display controller 228 has 238 output terminals for data transfer and rearranges corrected image data Dh output from multiplication circuit 236 to correspond to respective output terminals so that respective block data Db is output from each output terminal in parallel. In this case, the rate at which respective one bit units are transferred from each output terminal (the transfer rate) is 1 MHz.

Referring also to FIGS. 15–16, block data Db sent from output port OP are supplied to shift register 212 by each driver IC 210B. When 240 bit strings are complete in shift register 212, these bit strings are sent in parallel to respective corresponding data transfer sections 230 as dot data Dd. That is to say, each data transfer section 230 reads dot data Dd which is sent from shift register 212 at constant shift clock Pc1 and outputs dot data Dd corresponding to the initial timing of each subfield SF1 through SF6 (T/2, T/4, . . . , T/64). Dot data Dd output from each data transfer section 230 is supplied to respective corresponding driver outputs 210. Driver output 210 converts these into a data signal based on bit information containing dot data Dd and outputs this to corresponding dots via data wire 72. That is to say, for each dot bit information containing corresponding dot data, Dd is synchronized with the initial timing of each subfield SF1 through SF6 and while being incremented is supplied as a data signal. Color images corresponding to image data Dv are thereby displayed on the screen of display 10.

Thus, in driving device 200A of the first embodiment, one dot 26 is configured with one or more actuators 22. When one pixel 28 is configured with one or more dots 26, it has row electrode drive circuit 202 which applies an offset electrical potential (bias electrical potential) to all actuators, column electrode drive circuit 204 which outputs a data signal consisting of an ON signal and OFF signal for each dot based on image data Dv, and signal processing circuit 206 which controls row electrode drive circuit 202 and column electrode drive circuit 204. Since this signal processing circuit 206 is made to control column electrode drive circuit 204 which controls gradation by the temporal modulation method, there is just one level of offset power source voltage as the power source voltage that supplies row electrode drive circuit 202. Because of this, customizing the IC of row electrode drive circuit 202 is simple, there is greater freedom of design and manufacture of driving device 200A, and it is possible to make the device consume less electrical power.

In addition, there is no need to have an IC with many features such as PWM (pulse width modulation), for example, for the column driver IC (column electrode drive circuit 204) and a multi-output, low cost IC that basically has only a data input shift register and a level shift can be used. These factors are advantageous in terms of reducing the size of the package external dimension sizes of such things as bare chip and TCP etc. Since reducing the space for the portion in which driver IC is packaged is easy, it is easier to make display 10 thinner, thus reducing the cost of manufacturing display 10.

Referring to FIG. 19, the offset voltage may be set as 0 V. In this case, one power source can be eliminated since ground potential may be used as the offset potential.

Referring to FIG. 20, the polarities of the applied voltage may be reversed. For example, if the offset potential is set as +50 V, the potential of ON signal and OFF signal may be 60 V and 0 V, respectively. In this case, the direction of polarity of shape retaining layer 46 is also reversed.

Figure 21:
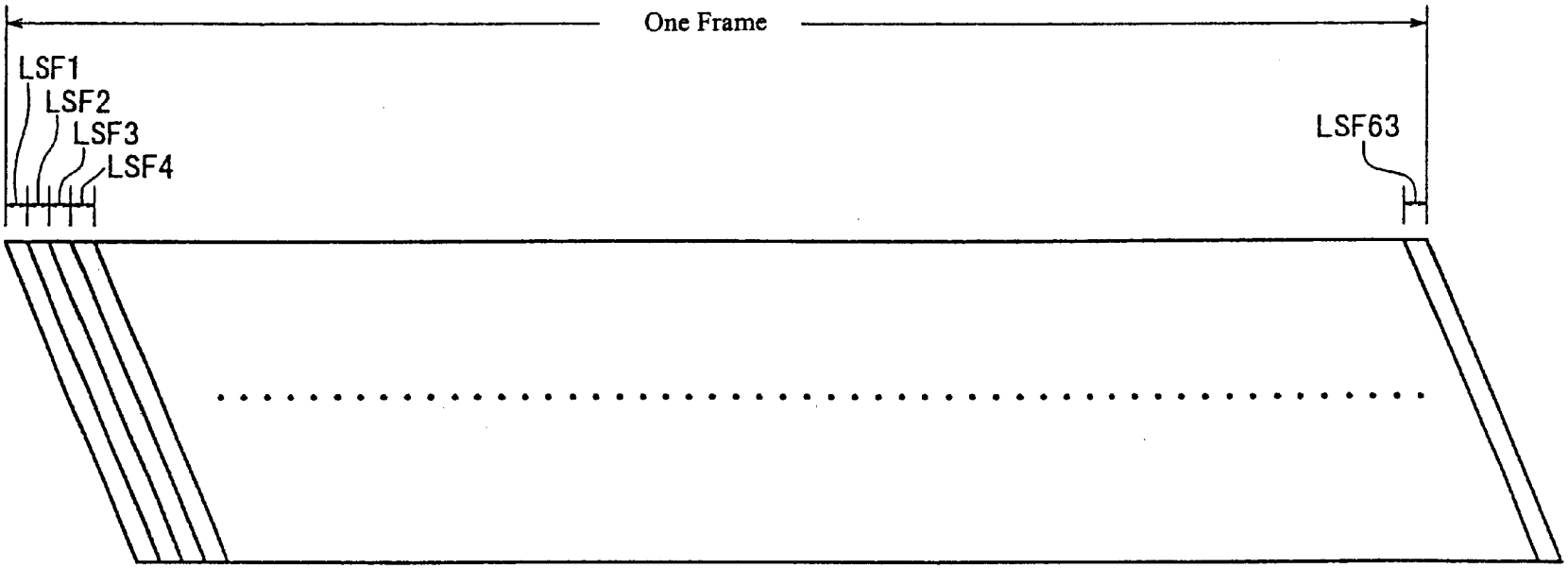
FIG. 21 is a diagram showing examples in which one frame in particular is divided up into numerous linear sub-fields in order to explain gradation control in the drive device of the second embodiment.

Referring to FIGS. 21–27, drive device 200B of the second embodiment is explained. Gradation control in drive device 200B of the second embodiment differs in part due to the temporal modulation method in signal processing circuit 206, and as shown in FIG. 21, when a display period of one image is one frame, which is partitioned into linear subfields, signal processing circuit 206 is such that, for each dot, the display time corresponding to respective gradation levels is continuously allotted to the necessary linear subfields, thereby creating dot data.

Figure 22A:
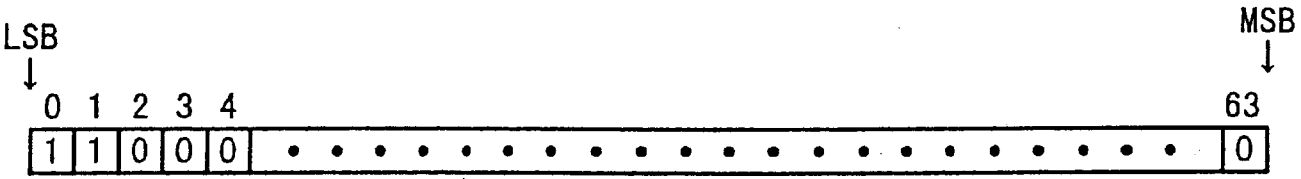
FIG. 22A is an explanatory diagram showing the bit arrangement when the gradation level is sixty-two in the dot data created by the drive device of the second embodiment.
Figure 22B:
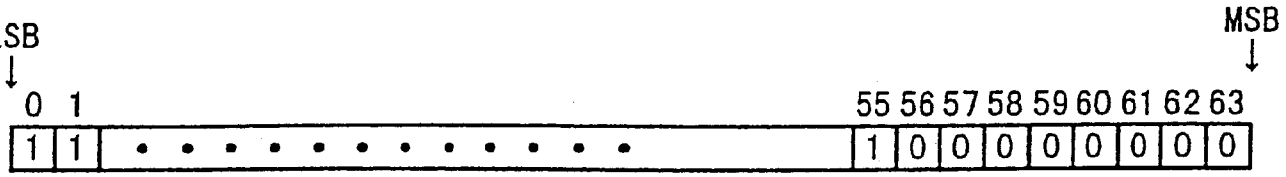
FIG. 22B is an explanatory diagram showing the bit arrangement when the gradation level is eight in the dot data created by the drive device of the second embodiment.

For example, if the maximum gradation is 64, 63 linear subfields LSF 1 through LSF 63 are allotted in one frame period while dot data Dd configure one bit of data per linear subfield. More specifically, if the gradation level of a certain dot is 62, as depicted in FIG. 22A, dot data bit 0 and bit 1 are "1" while the remaining continuous bits from bit 2 to bit 63 are "0." If the gradation level is 8, as depicted in FIG. 22B, dot data are created such that bits from 0 to 55 are all "1" while the remaining bits from 56 to 63 are "0." Since only 63 bits are needed for dot data Dd but 8 bytes are used for the data register, there is an extra dummy bit.

Figure 23:
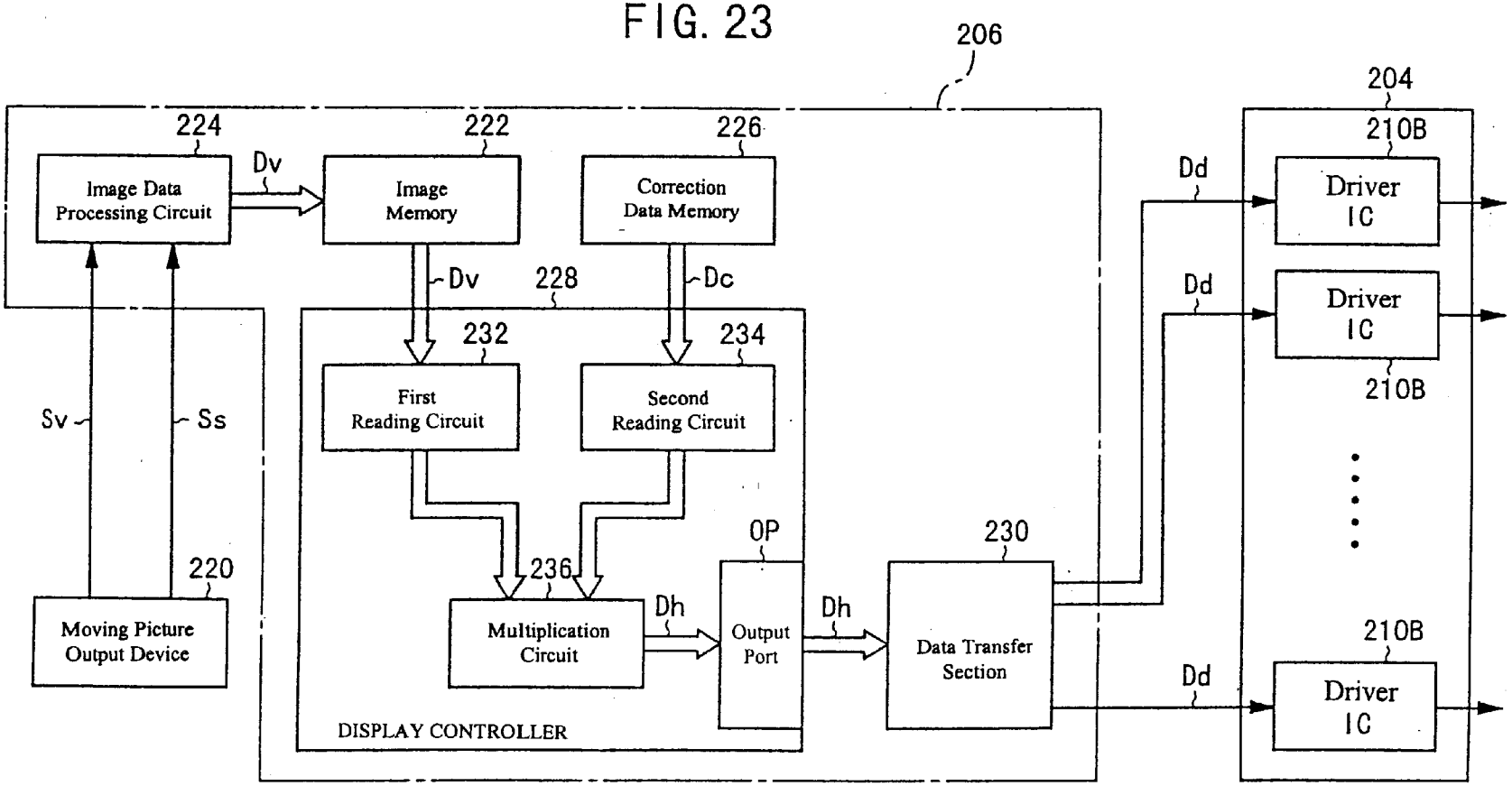
FIG. 23 is a block diagram showing the signal processing circuits in drive devices of the second and fourth embodiments.

Thus, drive device 200B of the second embodiment, as shown in FIG. 23, has nearly the same configuration as drive device 200A of the first embodiment, although the configuration of the data output system of signal processing circuit 206 and the configuration of each driver IC 210B in column electrode drive circuit 204 differ as follows. A data transfer portion 230 is connected to the data output system of signal processing circuit 206 at the later stage of display controller 228. After multiplication circuit 236 multiplies the image data Dv and gradation correction data Dc to create corrected image data Dh, data Dh are output to data transfer portion 230 via output port OP.

Figure 24:
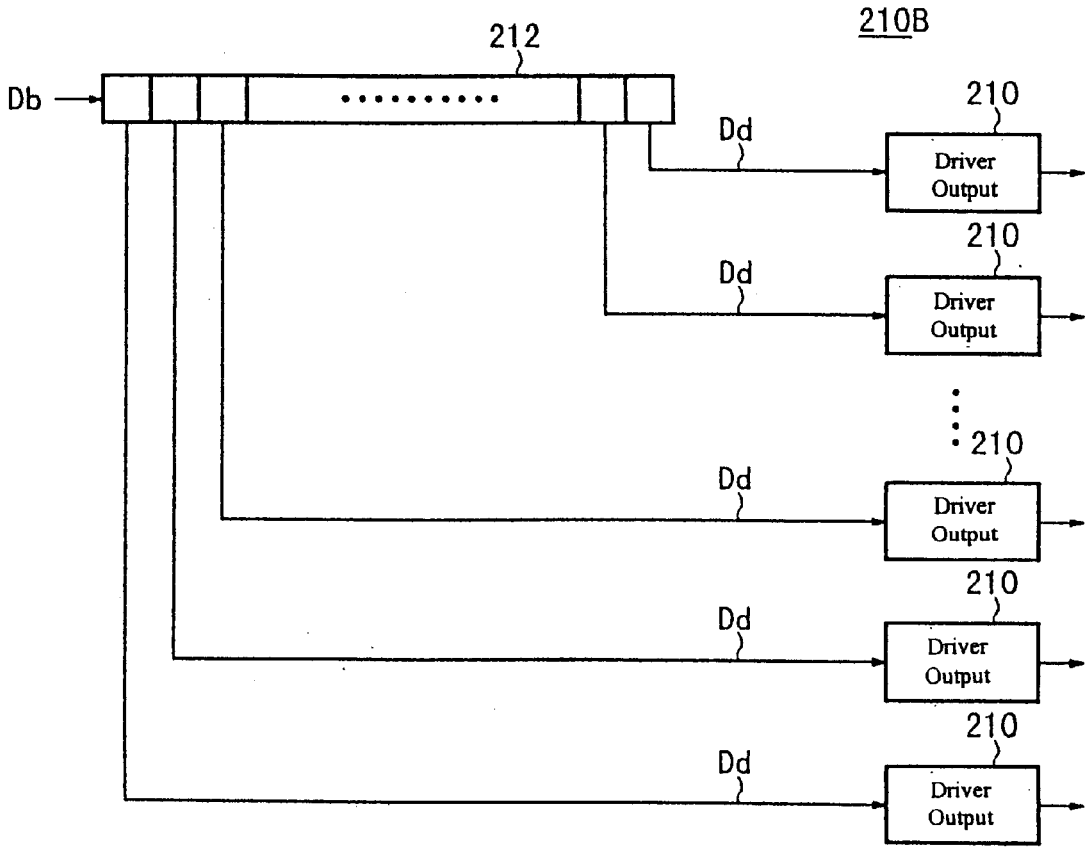
FIG. 24 is a block diagram showing the configuration of the driver IC used by the driving device of the second embodiment.

Referring to FIG. 24, driver IC 210B includes a shift register 212 which is configured, for example, with 240 bits, and in this instance, is configured with one driver output 210 connected for each bit in shift register 212. If we consider the data transfer rate in drive device 200B, since one bit of data needs to be transferred in a period of 1/63 frame (T/63), we have (43×63 Hz)×1 bit x(640×3×480)=2.5 Gbps.

Thus, when the clock in column electrode drive circuit 204 uses a 1 MHz IC, 1 bit transfers of 2.5 GHz/1 MHz=2500 parallel bits are necessary. Thus, the circuit configuration which outputs bit information configuring dot data Dd in line with the initial timing of each linear subfield LSF 1 through LSF 63 is adapted for data transfer portion 230.

Figure 25:
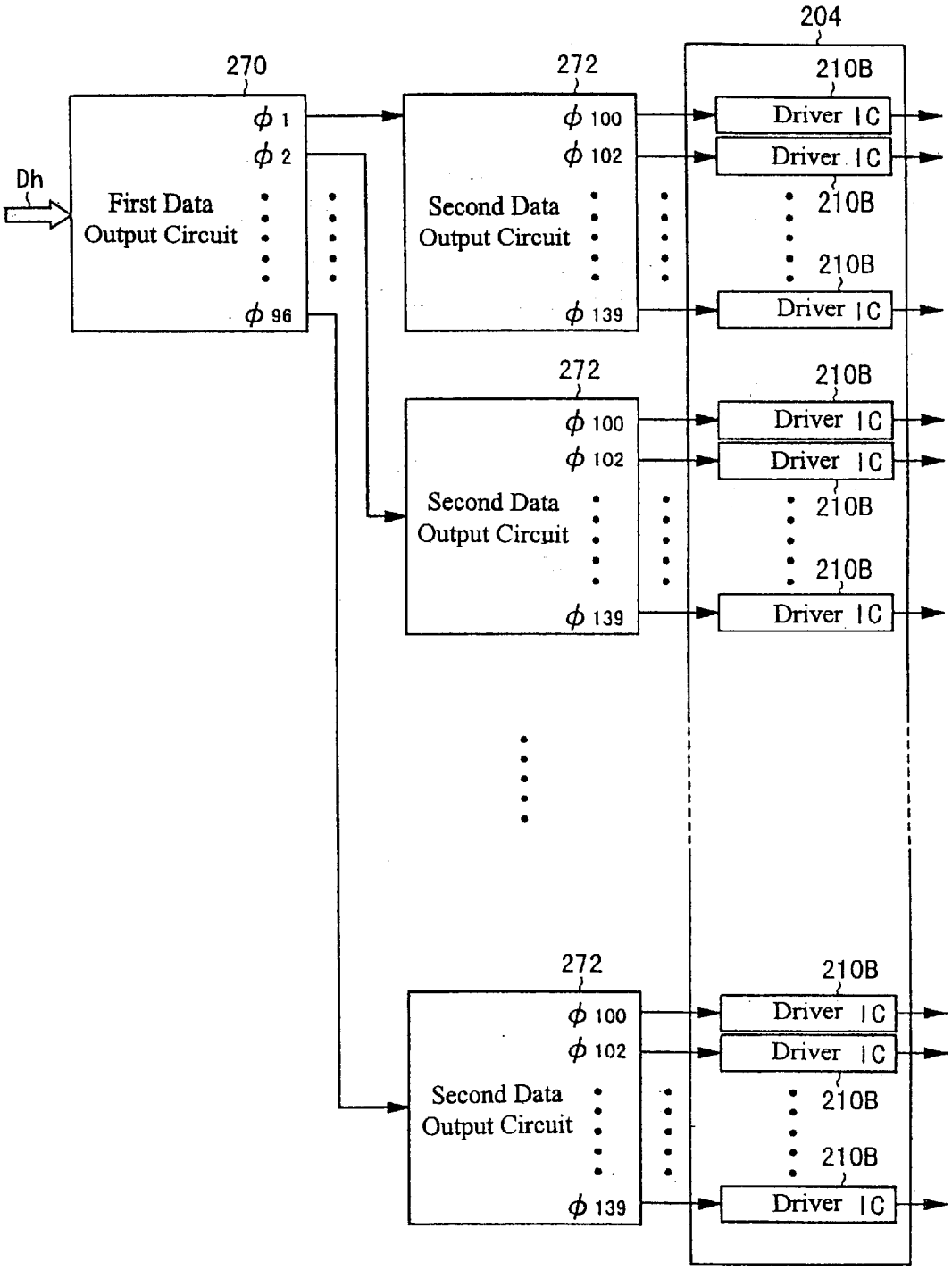
FIG. 25 is a block diagram showing the configuration of the data transfer portion used by the driving device of the second embodiment.

Referring to FIG. 25, the circuit configuration is configured to have a plurality of second data output circuits 272 corresponding to the number of terminal outputs of first data output circuit 270. First data output circuit 270 divides all drivers IC 210B into multiple groups. When the number of outputs (the number of dots that driver IC 210B outputs) per driver IC 210B is k, the number of driver ICs 210B allotted in one group is m, and the number of bits corresponding to the maximum gradation is n, a data group configured by k×m×n is allotted for each output terminal to one frame period T, and is configured so that in each output terminal, data sets are output in dot succession for each specified timing.

Data output circuit 272 has output terminals corresponding to the number of driver ICs 210B allotted and is configured so that data supplied from first data output circuit 270 is output to the allotted driver ICs 210B in parallel via the multiple output terminals. For example, when the number of outputs per driver IC (the number of bits that driver IC 210B outputs) is 240, 40 driver ICs are allotted to each group, and the number of output terminals of first data output circuit 270 is 96, second data output circuit 272 having respectively 40 output terminals ϕ100 through ϕ139 is connected to each output terminal ϕ1 through ϕ96 of first data output circuit 270. In this case 96×40=3840 parallel outputs are possible.

Figure 26:
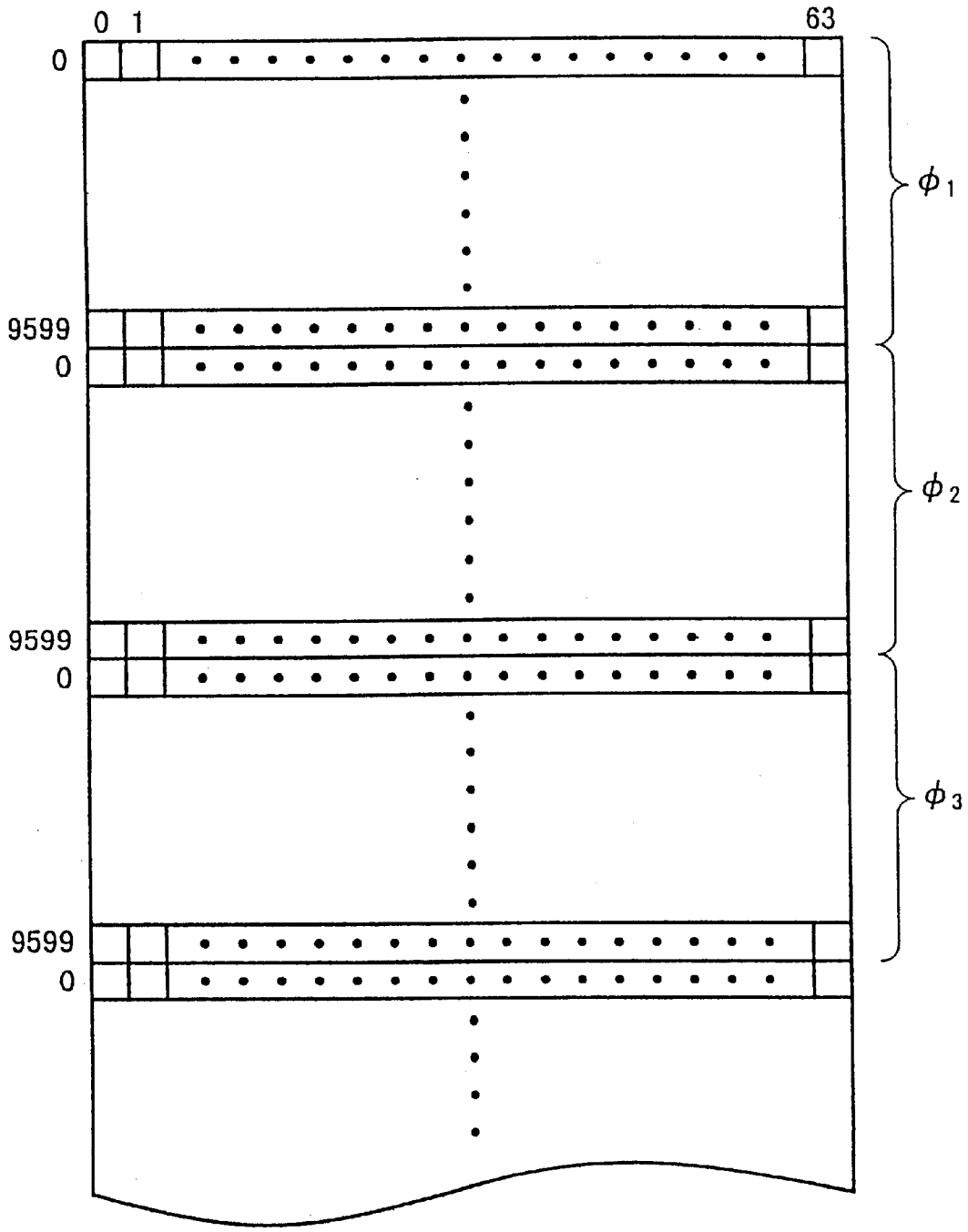
FIG. 26 is an explanatory diagram showing the data partition of the first data output circuit.

Referring to FIG. 26, first data output circuit 270 then divides corrected image data Dh supplied from display controller 228 into 240×40=9600 dot data and allots each 9600 dot datum to each output terminal ϕ1 through ϕ96.

Figure 27:
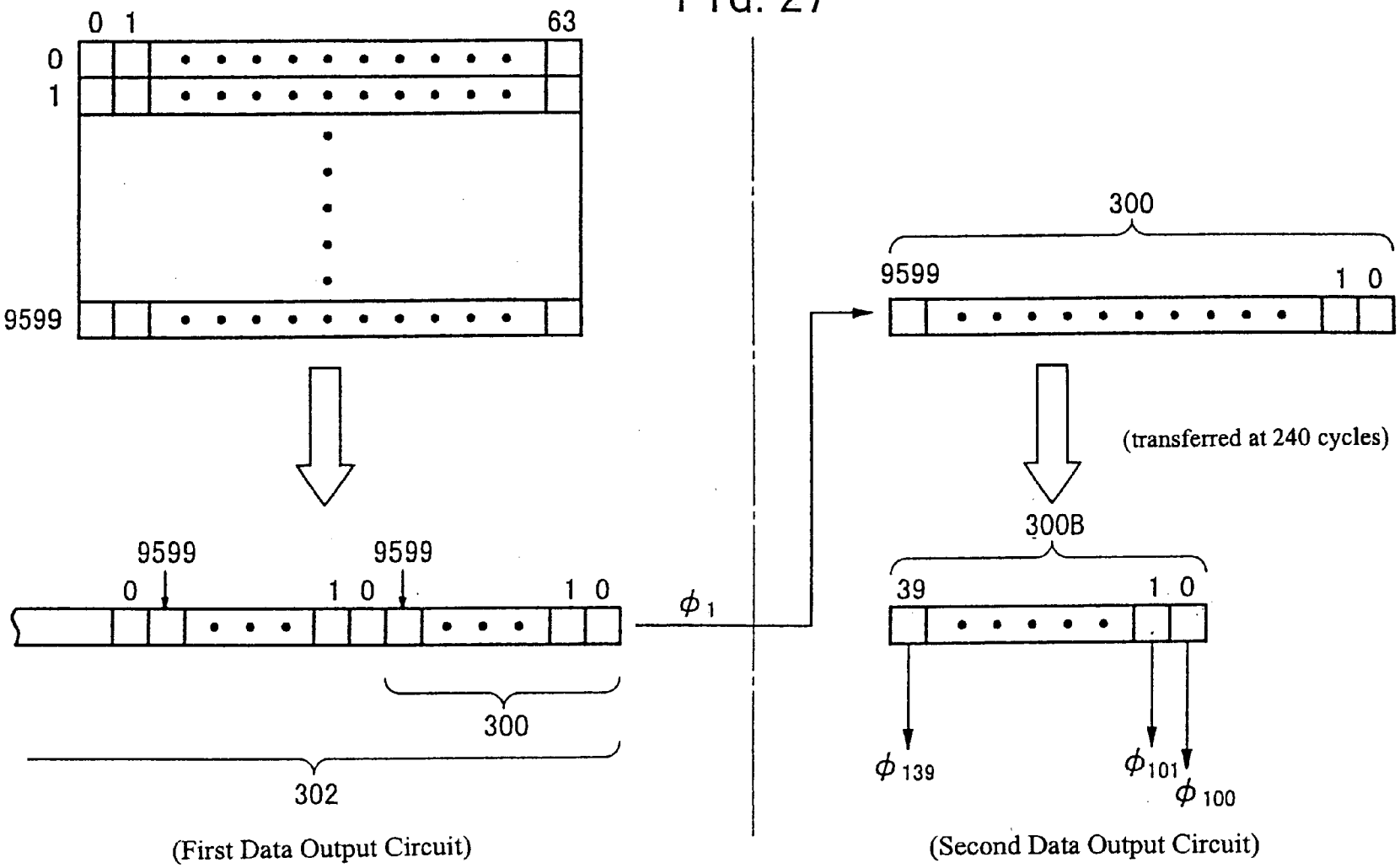
FIG. 27 is an explanatory diagram showing the data transfer format to the second output circuit from the first output circuit.

Referring to FIG. 27, in the case of one output terminal (for example, output terminal ϕ1), a bit string 300 of 9600 bits is created which lines up bit information in the same bit position of 9600 dot data Dd in bit units relating to bits 63 through 1 and then creates bit string data 302 lining up these bit strings in 63 to 1 bit order. In this case, dot data Dd is 64 bits (8 bytes), and bit string 300 in the bit position of the LSB of Dd is not used in creating bit string data 302.

Then bit string data 302 is synchronized with just 240×40=9600 bits (bit string length) in the time of T/63 to the reference clock of first data output circuit 270, and while shifting bits, outputs the bit string from output terminal ϕ1. When the reference clock is 40 MHz, for example, the transmission frequency of a 40 bit configured bit string 300B configuring the 9600 bit configured bit string 300 is 1 MHz, which can be made the same as the transmission frequency of column electrode drive circuit 204. Thus, by the reference clock using a 40 MHz or greater IC (for example, 44.9 MHz) for first data output circuit 270, the circuit can transmit bit string 300 within a specified margin of time.

Second data output circuit 272 outputs in parallel, from 40 output terminals ϕ100 through ϕ139, to 40 driver ICs 210B corresponding to column electrode drive circuit 204 every time a 40-bit configured bit string 300B is latched. This continuous action is repeated 240 times so that 240-bit configured bit strings are stored in shift register 212 of each driver IC 210B. The bit information of bit strings stored in shift register 212 become respective dot data Dd. At this point 240 units of dot data Dd from shift register 212 are output in parallel to the respective corresponding 240 driver outputs 210. Driver outputs 210 are converted into data signals based on bit information contained in dot data Dd and output through data line 72 to respective corresponding dots.

By the above action being repeated in succession for all dots, color images corresponding to the image data are displayed on the screen of display 10. Thus, with drive device 200B of the second embodiment, customizing IC's of row electrode drive circuit 202 is easy in the same way as previously described for the drive device of the first embodiment 200A, the degree of freedom of designing and manufacturing drive device 200B can be increased, and it is possible to save on power consumption. In addition, high costs items that have high functionality such as PWM modulation are not necessary in the IC itself or for the column driver IC, and high output, low cost ICs which only have basic data input shift registers and level shifters can be used. This is advantageous in reducing the packaging exterior size of such things as bare chip and TCP etc. Due to the ease of reducing space of the packaged portion of the drive IC, it is easier to make display 10 thinner, thus reducing the cost of manufacturing display 10.

Referring to FIGS. 28–33, a drive device 200C of the third embodiment is explained. The drive device 200C of the embodiment has the same configuration as drive device 200A of the first embodiment and differs from it in that (1) it is configured so that row electrode drive circuit 202 is set to an interlace type image signal so that it alternately selects an odd number row pixel and an even number row pixel, and (2) the number of driver ICs 210B configuring column electrode drive circuit 204 is half the total number of dots, i.e., the number of driver ICs 210B is one-half that of the number of driver ICs 210B in drive device 200A of the first embodiment.

Figure 28:
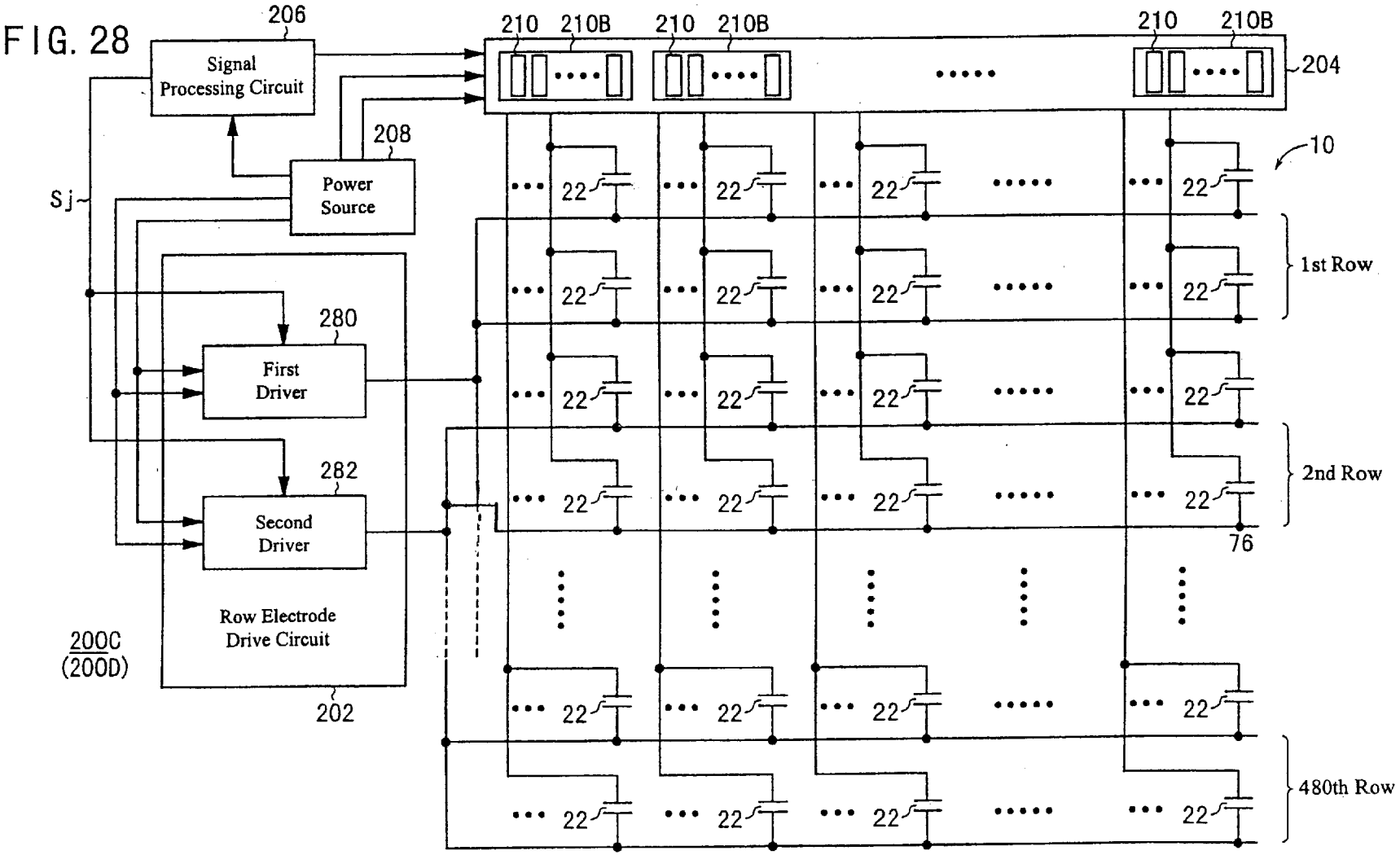
FIG. 28 is a circuit diagram showing the configuration of the driving devices of the third and fourth embodiments.
Figure 29:
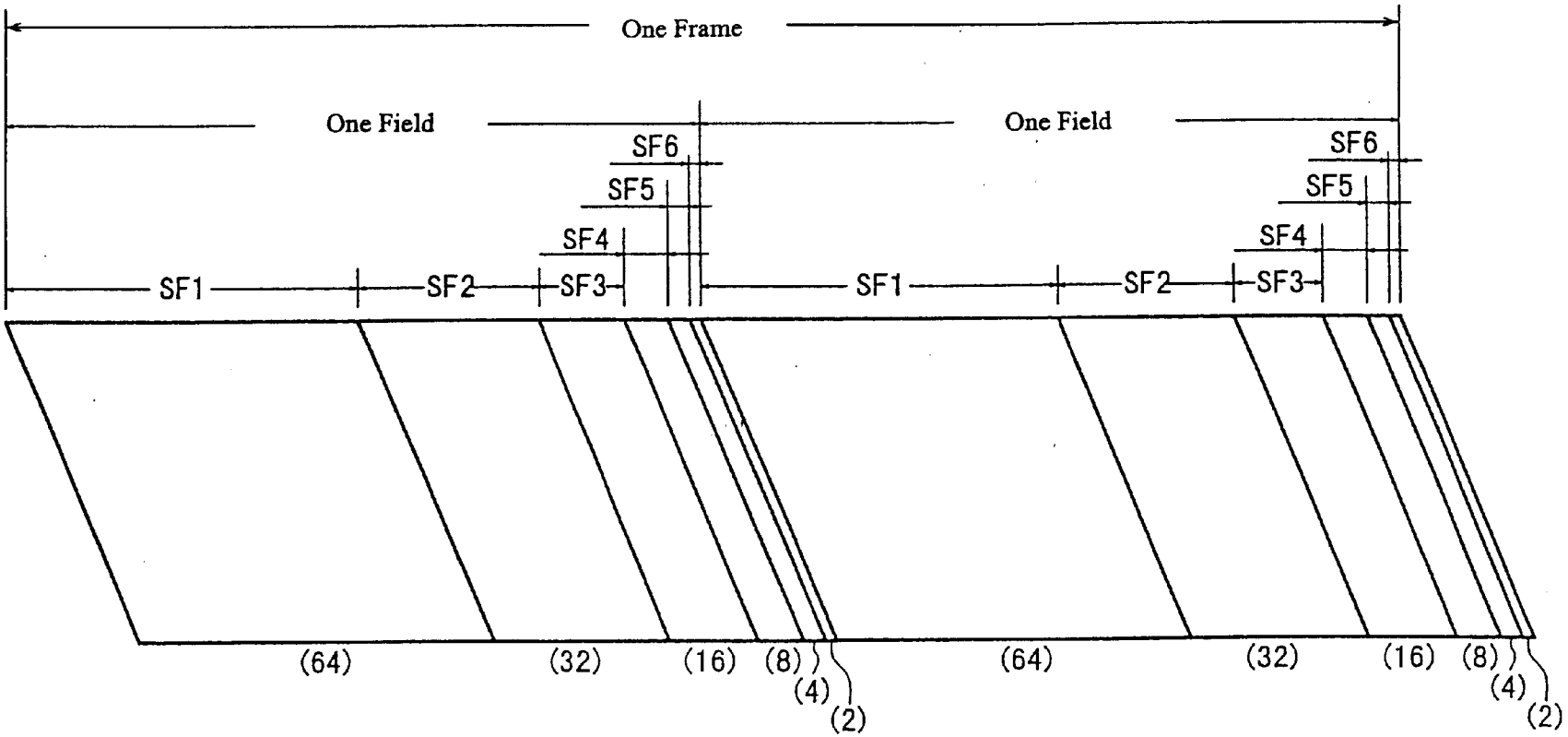
FIG. 29 is a drawing showing, in particular, an example of one frame divided into two fields and a further single field divided into numerous subfields for the purpose of explaining gradation control in the driving device of the third embodiment.

Referring to FIGS. 28–29, gradation control with temporal modulation by signal processing circuit 206 of drive device 200C is accomplished by having the display period or interval of one image be one frame, and when the one frame is divided, for example into two separate intervals, one of these intervals is one field. When this one field is further subdivided into six subfields, one of these subfields is specified as the initial subfield (first subfield SF1) with the longest duration, with each succeeding subfield becoming shorter by one-half.

Row electrode drive circuit 202 has a first driver 280 provided in common for odd number rows and a second driver 282 provided in common for even number rows, with each driver 280 and 282 being configured so that it alternately outputs a select and a nonselect signal for each field. When circuit 202 selects an odd number row, a select signal and a nonselect signal are output from first and second drivers 280 and 282, respectively. When circuit 202 selects an even number row, a nonselect signal and select signal are output from first and second drivers 280 and 282, respectively.

Figure 30:
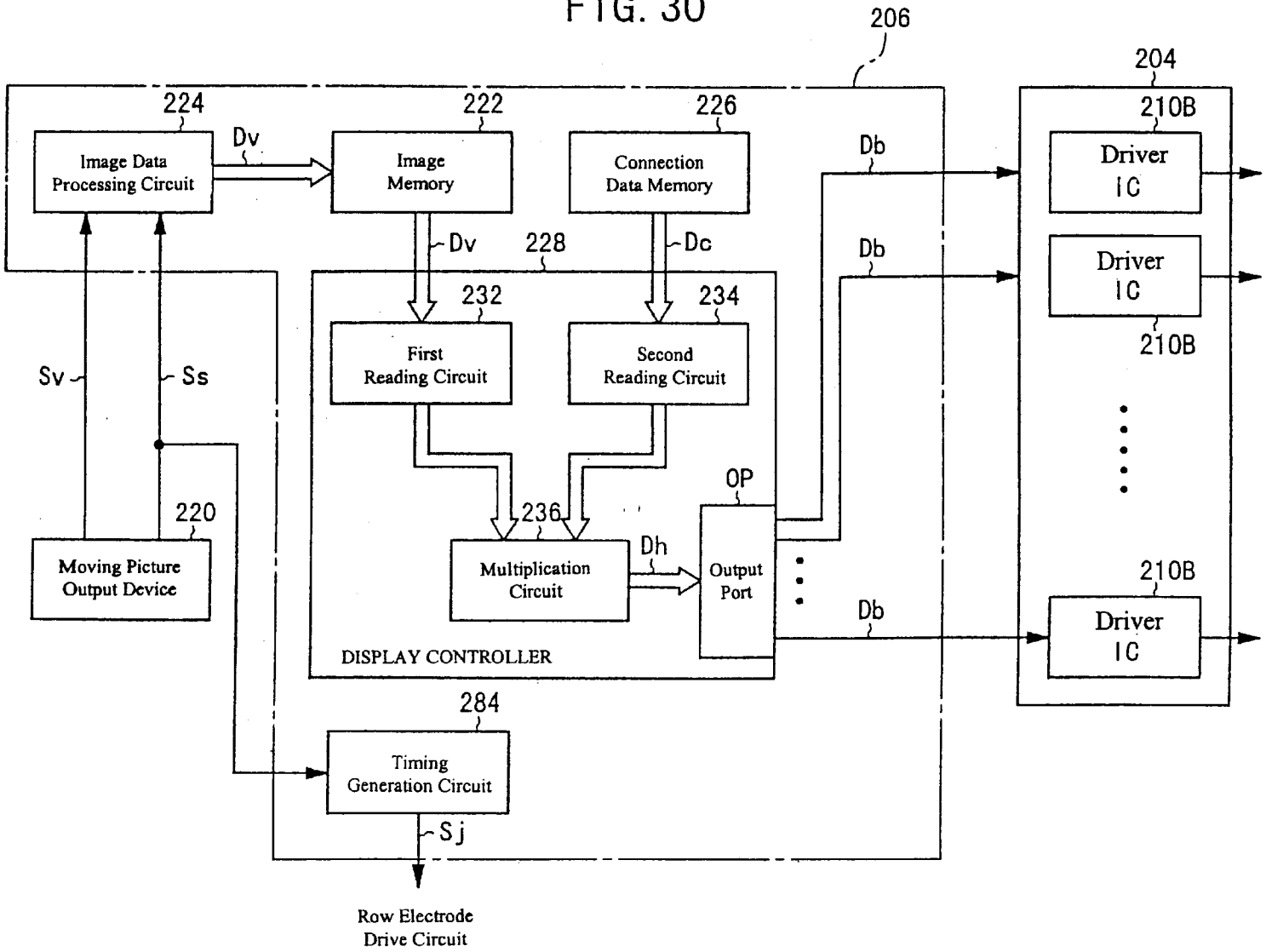
FIG. 30 is a block diagram showing a signal processing circuit in the driving device of the third embodiment.

Referring to FIG. 30, switching of select signals and nonselect signals by first and second drivers 280 and 282 is performed based on the input of sensing signal Sj from timing generation circuit 284 provided in signal processing circuit 206. Timing generation circuit 284 is a circuit which senses the initial timing of a field interval based on synchronization signal Ss supplied from moving picture output device 220. For a data transfer section to correspond to driver output 210 of column electrode drive circuit 204, the data transfer section 230 (See FIG. 16) of drive device 200A of the first embodiment may be used. As one driver output 210 is assigned for two dots lined up vertically (four actuators), dot data Dd output from data transfer section 230 becomes data for two dots.

Referring to FIG. 31, an example uses 10 V as a select signal and −50 V as a nonselect signal output from first and second drivers 280 and 282 of row electrode drive circuit 202, and uses 0 V for an ON signal and 60 V for an OFF signal output through each driver output 210 of column electrode drive circuit 204. Thus, if a select signal is applied to the row electrode for an actuator 22 and an ON signal is applied to the column electrode for that actuator 22, there is a low level voltage (−10 V) between the column electrode and the row electrode, thus leaving the actuator 22 in its natural state, i.e., light emitting. When a select signal is applied to the row electrode for actuator 22 and an OFF signal is applied to the column electrode for that actuator, there is a high level voltage (50 V) between the column electrode and the row electrode, thus causing actuator 22 to bend or displace in one direction, thereby extinguishing the light.

When a nonselect signal is applied to the row electrode, there is a high level voltage (50 V or 110 V) between the column electrode and the row electrode regardless of whether the signal applied to the column electrode is an ON signal or an OFF signal, thus bending or displacing the affected actuator 22 in one direction, thereby extinguishing the light.

The operation of this third embodiment is now explained. As shown in FIG. 30, an interlace type moving picture signal Sv (for example, an analog moving picture signal) and a synchronizing signal Ss from moving picture output device 220 are input to image data processing circuit 224, while synchronizing signal Ss is also input to timing generating circuit 284. Image data processing circuit 224 converts the input moving picture signal Sv into digital image data Dv in field units based on synchronization signal Ss and is written to image memory 222 (field buffer). Timing generating circuit 284 senses the initial timing of one field interval Tf from synchronizing signal Ss and outputs it to row electrode drive circuit 202 as sensing signal Sj.

Display controller 228 reads image data Dv from image memory 222 and gradation correction data Dc from correction data memory 226, multiplies these, and creates corrected image data Dh (image data in which 6 bits of dot data is arranged in 1 dot units). Corrected image data Dh, after being rearranged in data forms corresponding to respective output terminals in output port OP, are output from output port OP in 238 parallel bits at a transfer rate of 1 bit/1 MHz and supplied to corresponding driver IC 210. Then, when 240 bit strings are complete in shift register 212 in each driver IC 210B, these bit strings are sent in parallel to their respective corresponding data transfer sections 230. Data transfer section 230, provided in two-dot units, reads dot data Dd sent from display controller 228 with constant clock (Tf/6) and outputs dot data Dd with timing corresponding to the initial timing of subfields SF1 through SF6. Dot data Dd output for every two dots is supplied to respective corresponding driver output 210.

Meanwhile, row electrode drive circuit 202 alternately selects odd and even numbers for each field based on sensing signal Sj from timing generating circuit 284. Then, column electrode drive circuit 204 converts dot data Dd into a data signal based on bit information which includes dot data Dd and outputs it in two-dot units lined up vertically through data wire 72. That is, while bit information contained in corresponding dot data Dd is synchronized to the initial timing of subfields SF1 through SF6 and incremented, it is supplied to two dots lined up in a vertical direction as a data signal, and of the two dots lined up vertically, the data signal is supplied to dots of the row selected by row electrode drive circuit 202. In the next field interval, a data signal is supplied to the dot of the row not selected the previous time.

By repeating the above action, a color image corresponding to image data Dv is displayed on display 10. Thus, in driving device 200C of the third embodiment, one dot 26 is configured with one or more actuators 22. When one pixel 28 is configured with one or more dots 26, it has row electrode drive circuit 202 which alternately selects odd and even number pixels and column electrode drive circuit which outputs a light emitting signal and a light extinguishing signal for each dot as data signals. These data signals are based on the image signal and signal processing circuit 206 which in turn controls row electrode drive circuit 202 and column electrode drive circuit 204. Since signal processing circuit 206 controls column electrode drive circuit 204, which must control gradation by temporal modulation and row electrode drive circuit 202, there are just two levels of power source voltage that must supply row electrode drive circuit 202.

Because customizing the IC of row electrode drive circuit 202 is simple, there is greater freedom of design and manufacture of driving device 200C, rendering it possible to make the device consume less electrical power. In addition, there is no need to have an IC with many features such as PWM modulation for the column driver IC (column electrode drive circuit 204), so that a multi-output, low cost IC that only has a data input shift register and a level shift can be used. This is advantageous in terms of reducing the size of the package external dimension sizes of such things as bare chip and TCP etc. Since reducing the space for the portion in which driver IC is packaged is easy, it is easier to make display 10 thinner, thus reducing the cost of manufacturing display 10.

In the example described earlier (FIG. 31), 10 V is used for the select signal output from first and second drivers 280 and 282 of row electrode drive circuit 202 and −50 V is used for the nonselect signal. Alternately, as shown in FIG. 32, the select signal is set as 0 V and the nonselect signal is set as −60 V. In this instance, one power source can be eliminated since ground potential may be used as the offset potential.

Referring to FIG. 33, the polarities of the applied voltage may be reversed. For example, if 50 V is used for the select signal and 110 V is used for the nonselect signal, the potential of the ON signal and the OFF signal are 60 V and 0 V. In this instance the direction of polarity of shape retaining layer 46 is also reversed.

Figure 34:
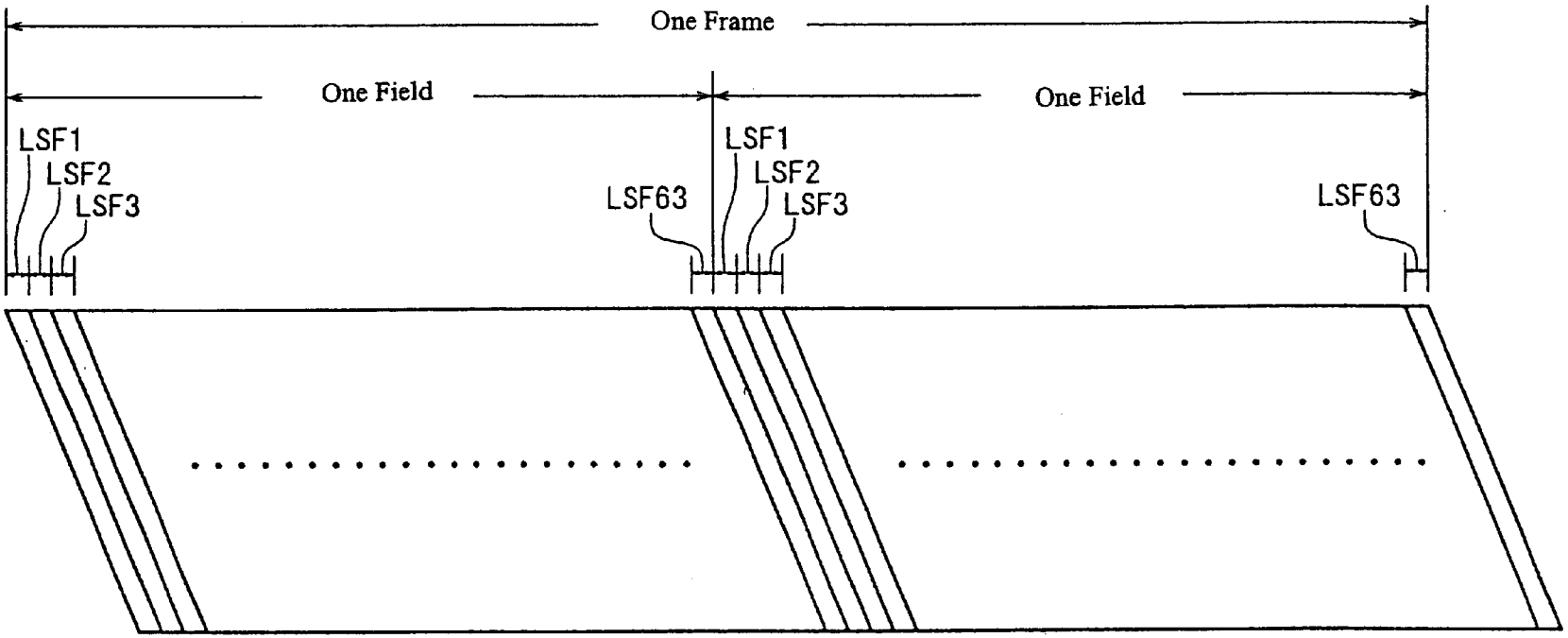
FIG. 34 is a drawing showing an example of one frame divided into two fields and further one field equally divided into numerous linear subfields for the purpose of explaining gradation control in the driving device of the fourth embodiment.
Figure 35:
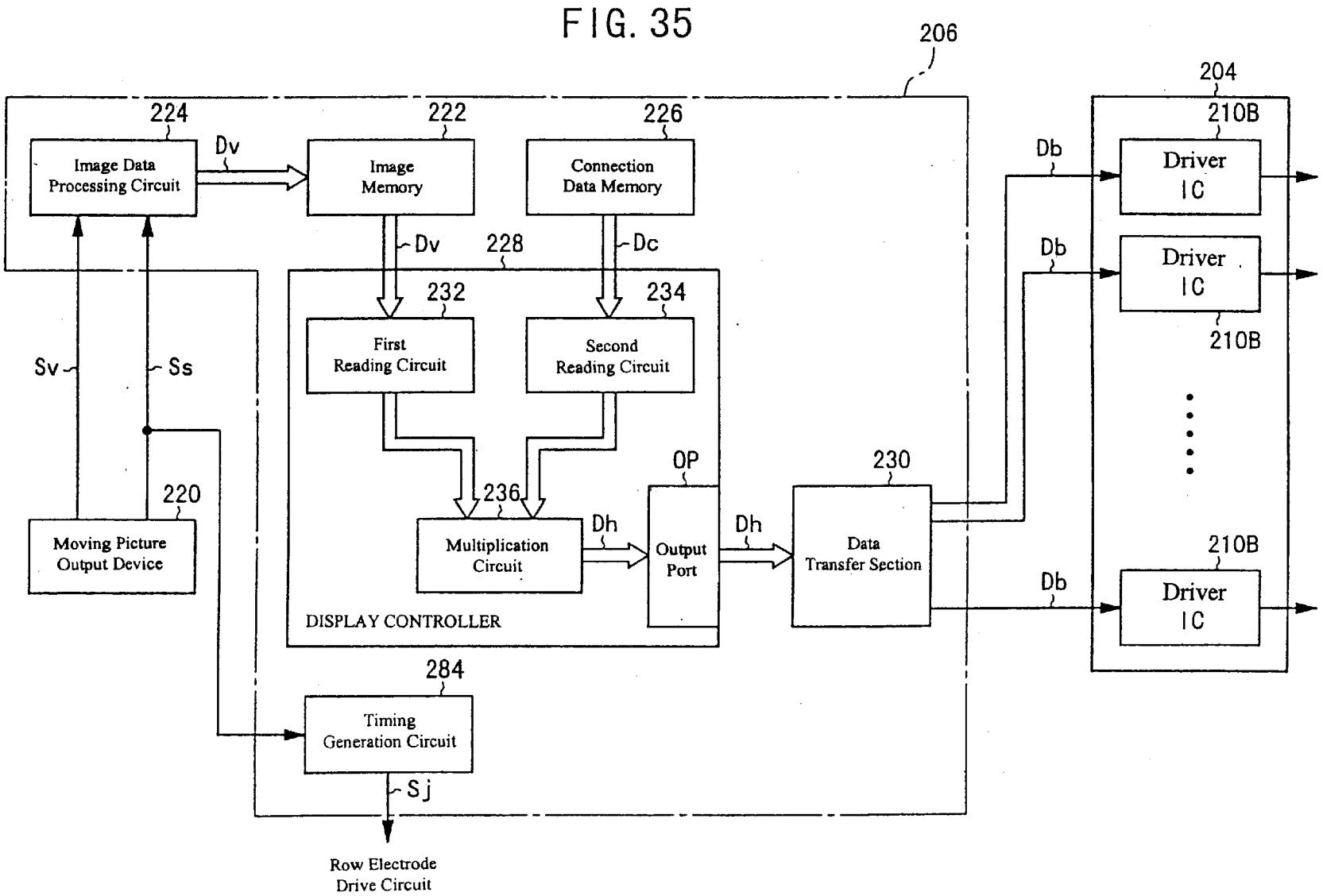
FIG. 35 is a block diagram showing a signal processing circuit of the driving device of the fourth embodiment.
Figure 36:
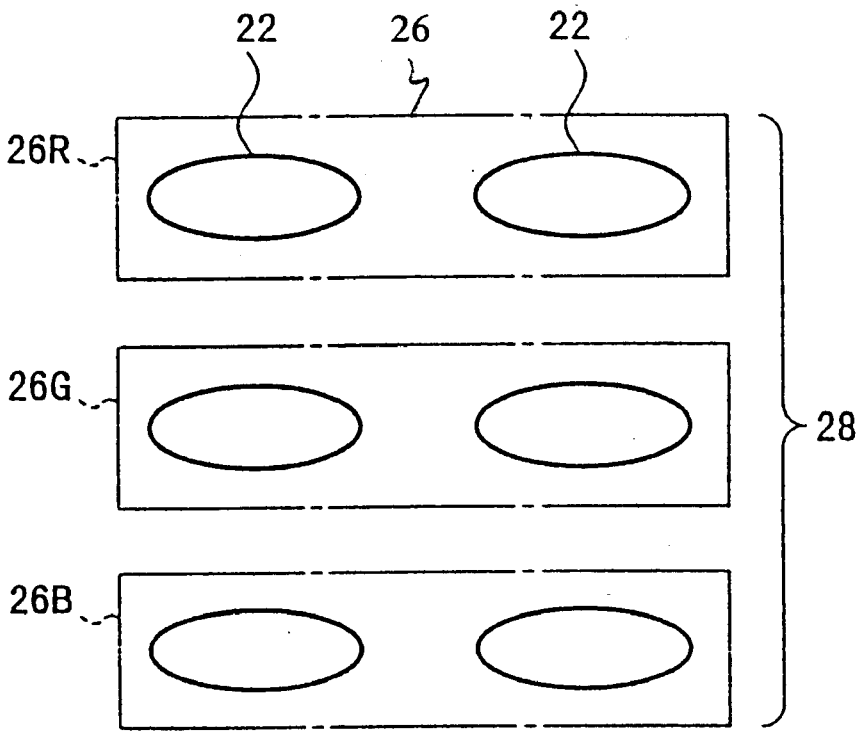
FIG. 36 is an explanatory diagram showing the pixel configuration of a display element that is applied by the driving device of the fifth embodiment.

Referring to FIGS. 34–35, drive device 200D of the fourth embodiment is explained. Gradation control in the fourth embodiment differs in part due to the time modulation method in signal processing circuit 206. As shown in FIG. 34, a display period of one image is one frame, the frame is separated into two separate intervals called fields, while each field is equally partitioned into multiple linear subfields. Signal processing circuit 206 is such that, for each two dots, the display time corresponding to respective gradation levels is continuously allotted to the necessary linear subfields to create dot data.

Signal processing circuit 206 in drive device 200D of this fourth embodiment is configured nearly the same as the signal processing circuit 206 of drive device 200B of the second embodiment (see FIG. 23), but differs in that it has a timing generating circuit 284 which senses the initial timing of field intervals based on a synchronizing signal Ss supplied from a moving picture output device 220. Then, the embodiment of data transfer section 230 of drive device 200B of the second embodiment may be used as the data transfer section which is connected to a later stage of display controller 228 in this embodiment. Thus, with drive device 200D, customizing the IC's of row electrode drive circuit 202 is easy, the degree of freedom of designing and manufacturing drive device 200D can be increased, and it is possible to save on power consumption. Further, for the column driver IC as well, high cost items that have high functionality such as PWM modulation are not necessary in the IC itself, so that high output, low cost IC's which have only basic data input shift registers and level shifters can be used. This is advantageous in reducing packaging exterior size of such things as bare chip and TCP etc. Because it is easy to reduce the size of the packaged portion of the drive IC, it is easier to make display 10 thinner, thus reducing the cost of manufacturing display 10.

In drive devices 200C and 200D of the third and fourth embodiments, row electrode drive circuit 202 is made to alternately select pixels of odd and even numbers, but it is possible to design the circuit so that row electrode drive circuit 202 pixels of three rows or more are selected in turn.

Figure 37:
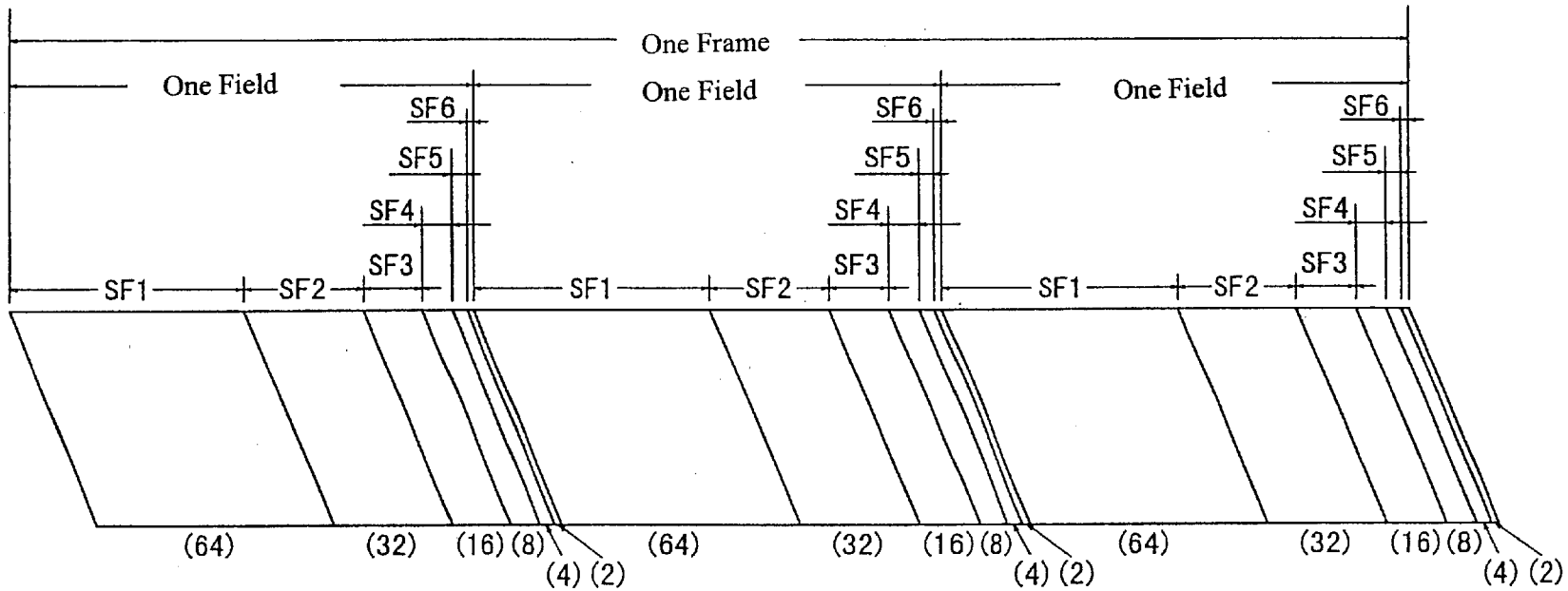
FIG. 37 is a drawing showing an example of one frame divided into two fields and further one field divided into numerous subfields for the purpose of explaining gradation control in the driving device of the fifth embodiment.

Referring to FIGS. 36–39, drive device 200E according to the fifth embodiment is explained. In this embodiment, each dot 26 is configured with two horizontal actuators 22 while each pixel 28 is configured with three dots 26 in a vertical direction (red dot 26R, green dot 26G and blue dot 26B). In gradation control by temporal modulation of signal processing circuit 206 of drive device 200E of the fifth embodiment, as shown in FIG. 37, a display interval of one image is one frame and the three separate intervals this frame is separated into are fields (first field, second field, and third field). When one of these fields is divided, for example into six, each of the divisions is a subfield. The initial subfield (first subfield SF1) is the longest in duration with the other subfields set so that each succeeding subfield is shorter by one-half.

Figure 38:
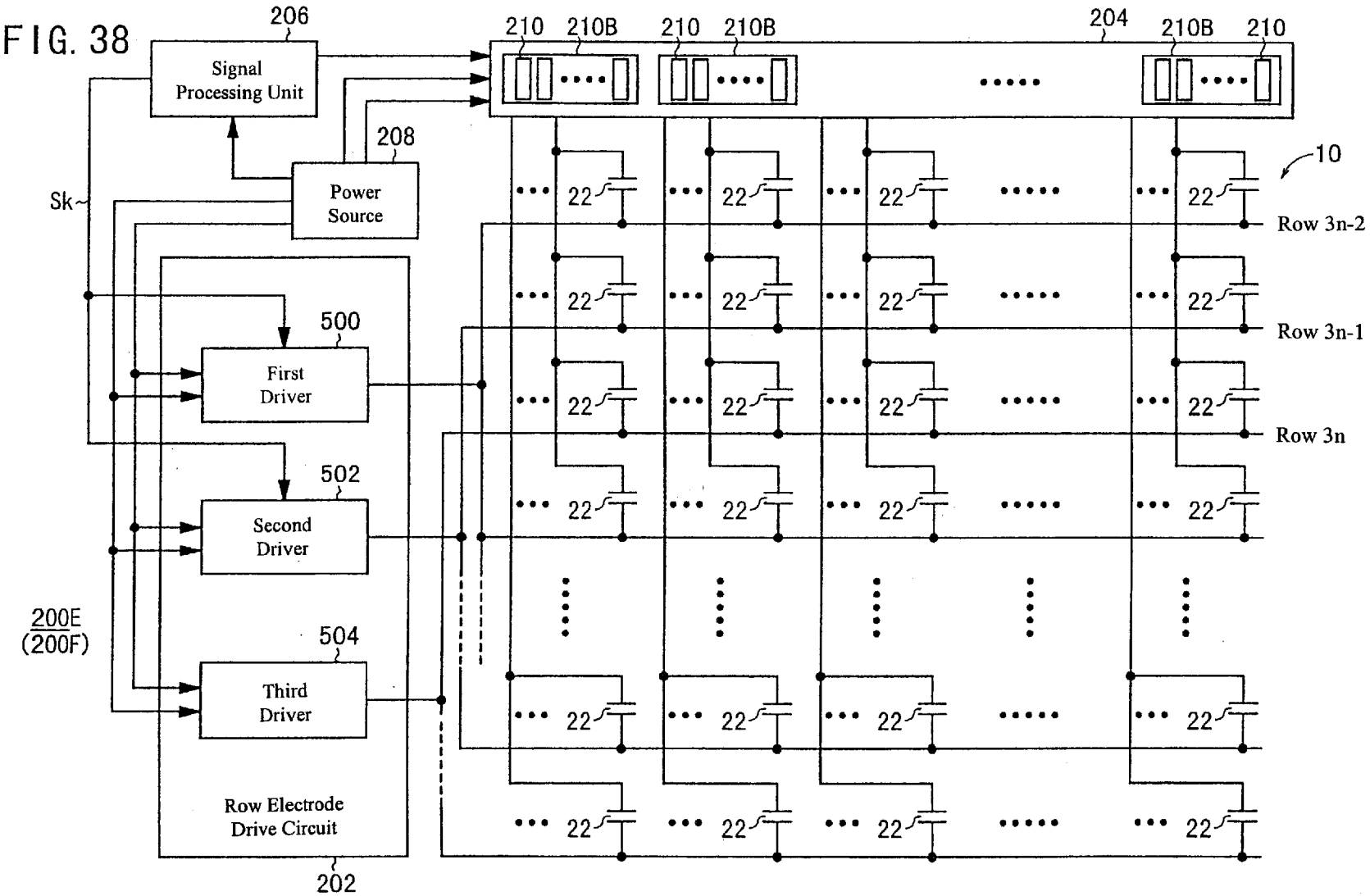
FIG. 38 is a circuit diagram showing the configuration of the driving device of the fifth and sixth embodiments.

As FIG. 38 shows, row electrode drive circuit 202 has a first driver 500 provided in common to rows 3n−2, a second driver 502 provided in common to rows 3n−1, and a third driver 504 provided in common to rows 3n. Each driver 500, 502 and 504 is configured so that it outputs a select signal and nonselect signal in turn for each field. When rows 3n−2 are selected, a select signal, a nonselect signal, and a nonselect signal are output from drivers 500, 502, and 504 respectively. When rows 3n−1 are selected, a nonselect signal, a select signal, and a nonselect signal are output from drivers 500, 502, and 504 respectively. When rows 3n are selected, a nonselect signal, a nonselect signal, and a select signal are output from drivers 500, 502, and 504 respectively.

Figure 39:
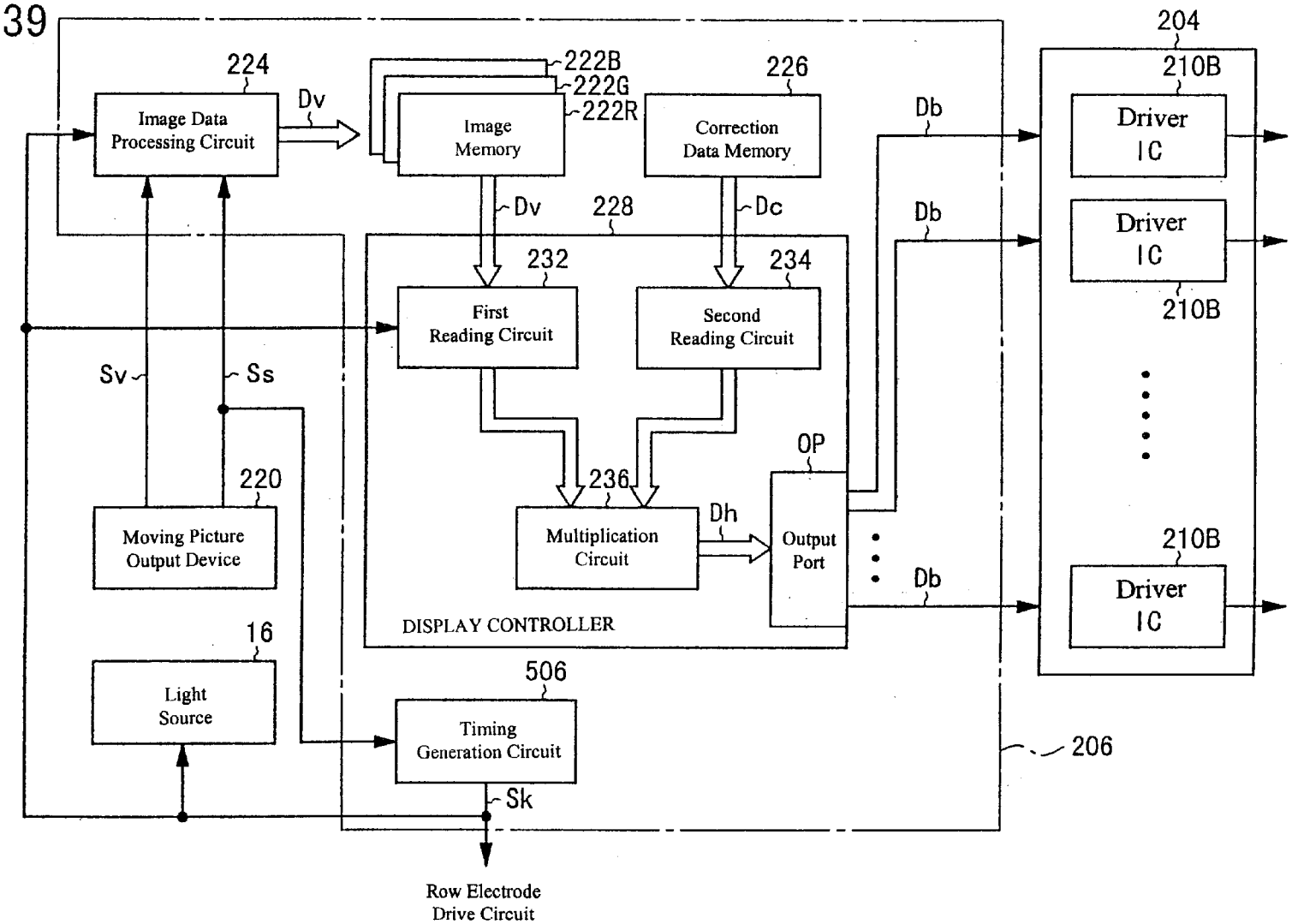
FIG. 39 is a block diagram showing a signal processing circuit in the driving device of the fifth embodiment.

As FIG. 39 shows, switching of select signals and nonselect signals by first, second, and third drivers 500, 502, and 504 is performed based on the input of a sensing signal Sk from a timing generation circuit 506 provided in signal processing circuit 206. Row electrode drive circuit 202 thus selects dots of rows 3n−2, 3n−1, and 3n (n=1, 2, . . . ) in turn, in conformance with a synchronizing signal Ss supplied from moving picture output device 220. Timing generating circuit 506 generates and outputs sensing signal Sk which partitions one frame into three parts based on synchronizing signal Ss.

Image data processing circuit 224 of signal processing circuit 206 is configured so that, for example, a progressive type moving picture signal Sv (for example, an analog moving picture signal) and synchronizing signal Ss from moving picture output device 220, along with sensing signal Sk from timing generating circuit 506 are input and converted into digital image data Dv in three colors (red, green, and blue). Digital image data Dv is then written to red image data memory 222R, green image data memory 222G, and blue image data memory 222B. A first reading circuit 232 is configured to read successive image data Dv from three types of image memory 222R, 222G, and 222B based on the input of sensing'signals Sk from timing generating circuit 506.

Light source 16 is configured so that it successively switches and emits three types of light (for example, red light, green light, and blue light) based on the input of sensing signal Sk from timing generating circuit 506. Column electrode drive circuit 204 is such that the number of driver outputs 210B is one third of the total number of dots. The number of driver IC's 210B is one third of the number of driver IC's 210B in drive device 200A of the first embodiment, so that one driver IC 210B accepts and holds drivers of three dots lined up vertically.

The data transfer section 230 of drive device 200A of the first embodiment (FIG. 16) may be used for the data transfer section provided to correspond to driver output 210 of column electrode drive circuit 204. As one driver output 210 is allocated for three dots lined up vertically, dot data Dd output from data transfer section 230 becomes data for three dots. That is to say, it becomes dot data Dd for every three dots.

Drive device 200E of the fifth embodiment uses 10 V for the select signal output from first, second, and third drivers 500, 502 and 504 of row electrode drive circuit 202 and uses −50 V for the nonselect signal. In addition, drive device 200E may use 0 V for the ON signal output from each of the drivers 210 of column electrode drive circuit 204 and 60 V for the OFF signal.

In operation, a progressive type moving picture signal Sv, such as, for example, an analog moving picture signal, and synchronizing signal Ss from moving picture output device 220 are input to image data processing circuit 224, while synchronizing signal Ss is also input to timing generating circuit 506. Timing generating circuit 506 generates timing sensing signal Sk, which partitions one frame interval into three parts, based on the synchronizing signal Ss input. Image data processing circuit 224 converts the input moving picture signal Sv into digital image data Dv in three primary color units (red, green and blue) based on sensing signal Sk from timing generating circuit 506 and writes to the respective red image memory 222R, green image memory 222G, and blue image memory 222B.

Display controller 228 reads image data Dv from each image memory 222R, 222G, and 222B along with gradation correction data Dc from correction data memory 226, multiplies these, and creates corrected image data Dh (image data in which dot data of six bits is arranged in three dot units). Corrected image data Dh is output in parallel at a data transfer rate of 1 bit/ 1 MHz from output port OP as dot data Db after it has been rearranged to conform to respective output terminals by output port OP and supplied to respective corresponding driver IC's. Then, when 240 bit strings are complete in shift registers 212 (FIG. 16) in each driver IC 210B, these bit strings are sent in parallel to respective corresponding data transfer sections 230. Data transfer section 230, which is provided in three bit units, reads dot data Dd sent from shift registers 212 by a constant clock (Tf/6) to output dot data Dd at a timing corresponding to the initial timing of subfields SF1 through SF6. Every three dots of dot data Dd is supplied to respective corresponding driver outputs 210.

Meanwhile, row electrode drive circuit 202 selects row 3n−2, row 3n−1, and row 3n for each field, in an order based on inputs of sensing signal Sk from timing generating circuit 506. At this time, red light, green light, and blue light is emitted from light source 16 based on the inputs of sensing signals Sk from timing generating circuit 506. Column electrode drive circuit 204 then converts dot data Dd into data signals based on the bit information contained in dot data Dd and outputs this in three dot units lined up vertically through wire 72. That is, while bit information contained in corresponding dot data Dd is synchronized to the initial timing of subfields SF1 through SF6 and incremented, it is supplied to three dots lined up in a vertical direction as a data signal. Of the three dots lined up vertically in the interval of first field (for example, an interval in which red light is emitted), the data signal is supplied to dots of row 3n−2 (the row concerning red) selected by row electrode drive circuit 202. In the succeeding second field interval (for example, an interval emitting green light), a data signal is supplied to row 3n−1 (the row concerning green) dot which was not selected the previous time, and in the third field interval (for example, the interval in which blue is being emitted), a data signal is supplied to the dot of row 3n (the row concerning blue) which was not selected the previous time.

By repeating the above action, a color image corresponding to image data Dv is displayed on display 10. Thus, in driving device 200E of the fifth embodiment, one dot 26 is configured with one or more actuators 22. When one pixel 28 is configured with one or more dots 26, row electrode drive circuit 202 selects pixels of row 3n−2, row 3n−1, and row 3n (n=1, 2, . . . ) in turn. Column electrode drive circuit 204 outputs data signals consisting of a light emitting signal and a light extinguishing signal for pixels of selected rows based on image signal and signal processing circuit 206, which controls row electrode drive circuit 202, and column electrode drive circuit 204. Since signal processing circuit 206 controls column electrode drive circuit 204, which must control gradation by temporal modulation, and row electrode drive circuit 202, there are only two levels of power source voltage that must supply row electrode drive circuit 202. Therefore, customizing the IC of row electrode drive circuit 202 is simple, there is greater freedom of design and manufacture of driving device 200E, and it is possible to make the device consume less electrical power.

In addition, there is no need to have an IC with many features such as PWM modulation, for example, for the column driver IC (column electrode drive circuit 204). Therefore, a multi-output, low cost IC that has only a data input shift register and a level shifter can be used. These features are advantageous for reducing the external dimension sizes of such things as bare chip and TCP etc. Since reducing the space for packaging driver IC is easy, it is easier to make display 10 thinner, thereby reducing the cost of manufacturing display 10.

In particular, since light of the three primary colors is emitted from light source 16, blank brightness (brightness emitted due to faults etc. of the optical wave guide plate other than from the pixel emission section) is one third compared to the use of a white light source used to improve contrast. In addition, when, for example, red light is emitted from light source 16, color purity is improved and image quality is effectively improved.

Figure 40:
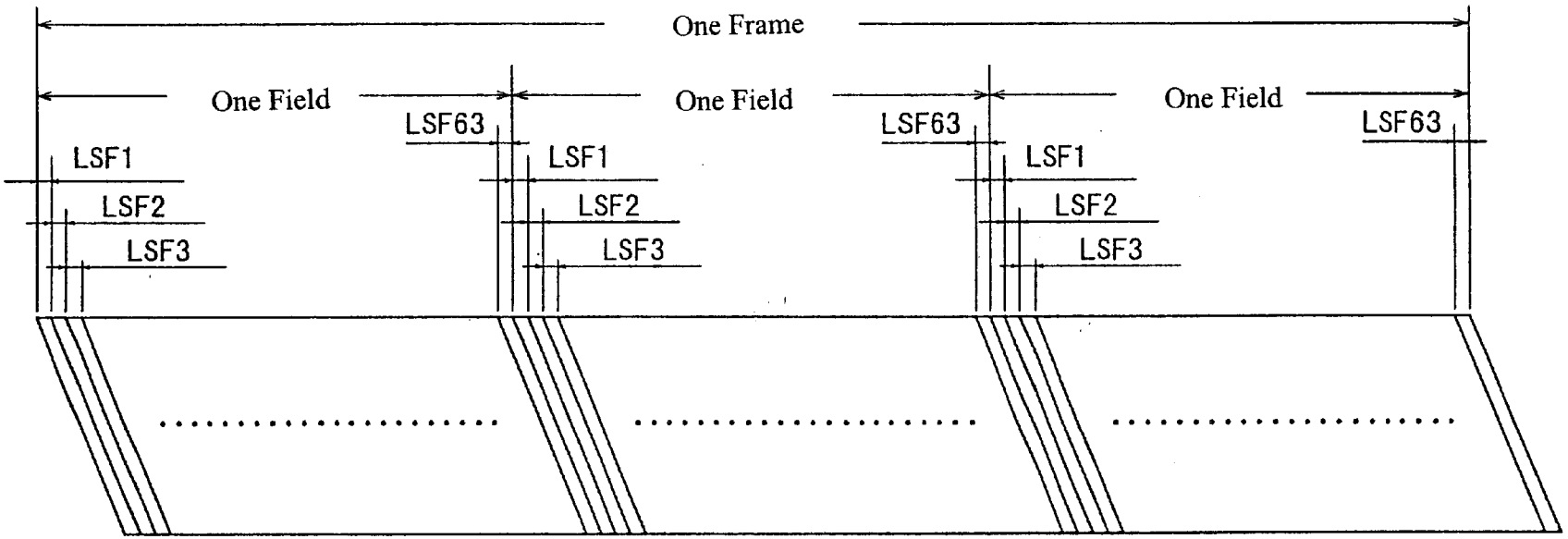
FIG. 40 is a drawing showing an example of one frame divided into three fields and further one field equally divided into numerous linear subfields for the purpose of explaining gradation control in the driving device of the sixth embodiment.
Figure 41:
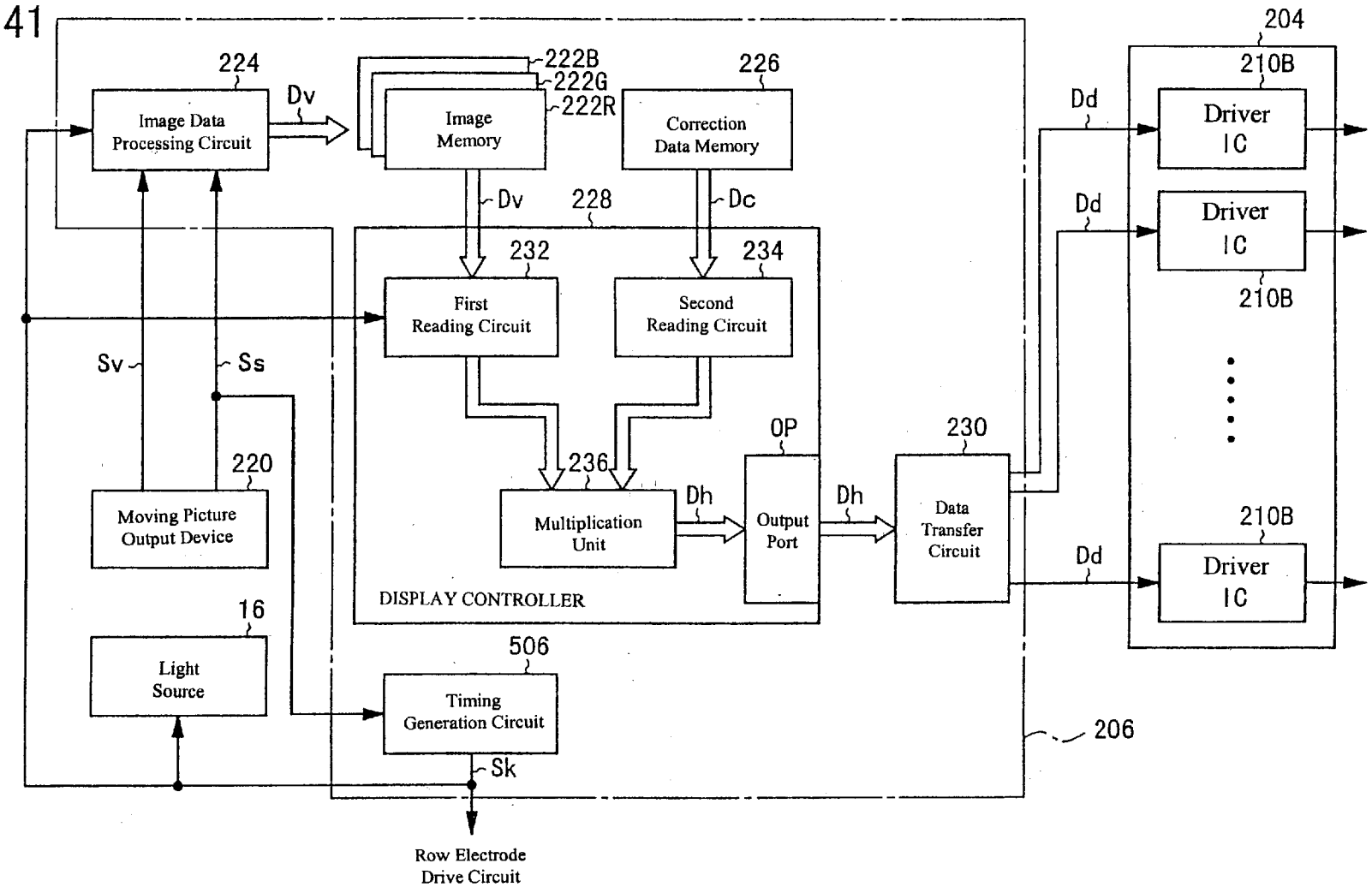
FIG. 41 is a block diagram showing a signal processing circuit in the driving device of the sixth embodiment.
Figure 42A:
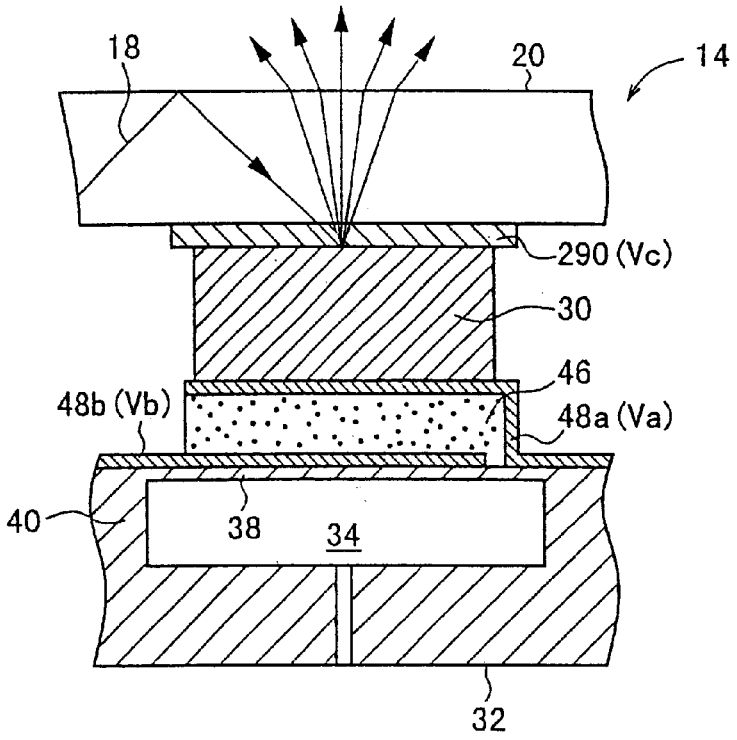
FIG. 42A is a cross-sectional drawing showing the state of light being emitted in an example of a display element which uses static electricity.
Figure 42B:
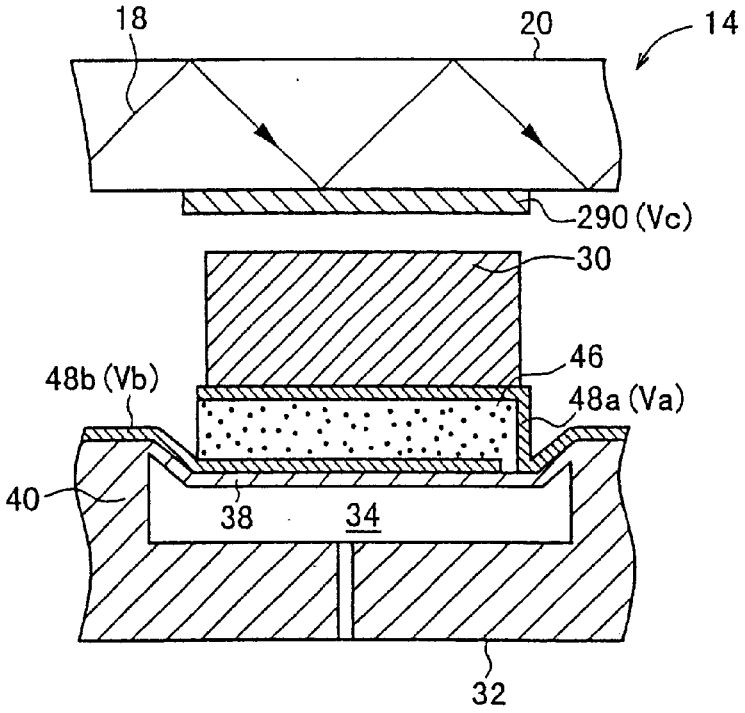
FIG. 42B is a cross section of the state in the example of FIG. 42A when that light is extinguished.

Referring to FIGS. 40–41, a drive device 200F of the sixth embodiment is explained. The drive device of the sixth embodiment partially differs from the other embodiments in the gradation control done by the temporal modulation method by signal processing circuit 206. As FIG. 40 shows, the interval for one image displayed is one frame, with the interval of the frame being separated into three parts known as fields. When a field is equally divided into numerous parts, each part is a linear subfield. Signal processing circuit 206 continuously assigns display times for every three dots corresponding to respective gradation levels to the necessary linear subfields and creates dot data. Signal processing circuit 206 is configured nearly the same as the signal processing circuit 206 of drive device 200D of the fourth embodiment (FIG. 35) but differs in that it has a timing generating circuit 506 which outputs a sensing signal Sk corresponding to the initial timing of field intervals based on a synchronizing signal Ss supplied from moving picture output device 220.

Data transfer section 230 of drive device 200B of the second embodiment (FIG. 16) may be used as a data transfer section which connects to a later stage of display controller 228. Thus, with drive device 200F of the sixth embodiment, customizing IC's of row electrode drive circuit 202 is easy, the degree of freedom in designing and manufacturing drive device 200D can be increased, and it is possible to save on power consumption. For the column driver IC as well, high costs items that have high functionality such as PWM modulation are not necessary in the IC itself. High output, low cost IC's which only have basic data input shift registers and level shifters can be used. These advantages reduce the external dimensions of the packaging of such things as bare chip and TCP etc. Due to the ease of reducing the size of the packaged portion of the driver IC, it is easier to make display 10 thinner, thus reducing the cost of manufacturing display 10.

Referring to FIGS. 42A–43B, display 10 or display elements 14, which are applied in drive devices 200A through 200F of the first through sixth embodiments, emit light when actuator 22 is in its natural state. When a high level electrical potential is applied between row electrode 48*a* and column electrode 48*b* of actuator 22, actuator 22 bends and displaces so that it is convex in chamber 34, thus extinguishing the light. By contacting and separating pixel structural unit 30 with the back of optical wave guide plate 20 at the time actuator 22 is being caused to go ON or OFF, one may apply a voltage to shape retaining layer 46 and also cause static electricity to be generated between the back face of optical wave guide plate 20 and the contact face (end) of pixel structural unit 30, so that in addition to the deformation generated, the attraction and repulsion due to this static electricity is used in the ON/ OFF operation of actuator 22.

As a result, while actuator 22 is driving, it is possible configure it to generate dielectric polarization, utilize the attraction due to static electricity, and enhance the ON characteristics/characteristics of actuator 22 when it is ON, that is, the contact of pixel structural unit 30 and the responsiveness in the contact direction. It is also possible to enhance the OFF characteristics/characteristics of actuator 22 when it is OFF separately from its ON characteristics/ characteristics when it is ON, that is, the separation of pixel structural unit 30 and the responsiveness in the direction of separation. For example, when only enhancing the ON characteristics of actuator 22, it is sufficient merely to apply a coating material to the contact face of pixel structural unit 30 and to the back face of optical wave guide plate 20 or to optical wave guide plate 20 itself and make them polarized dielectrically. In addition, if enhancing both the ON and OFF characteristics of actuator 22, a transparent electrode and thin metallic film may be applied to the back face of optical wave guide plate 20, switching its electrically polarity so that attraction and repulsion due to static electricity are both generated to the contact face of dielectrically polarized pixel structural unit 30.

In the natural state of actuator 22, light is emitted. Row electrode 48*a* is formed in the upper face of shape retaining layer 46 and column electrode 48*b* is formed in the lower face of shape retaining layer 46. In display element 14 shown in FIGS. 42A and 42B, respective transparent electrodes 290 are formed in a position corresponding to actuator 22 in the back face of optical wave guide plate 20. Then when actuator 22 comes ON and light is emitted, a voltage (Vc>Va) is applied between transparent electrode 290 and row electrode 48*a*, so that the voltage between row electrode 48*a* and column electrode 48*b* becomes virtually zero (Va≈Vb). Thus, pixel structural unit 30 is pushed up against optical wave guide plate 20 by virtue of the static electricity attraction between transparent electrode 290 and row electrode 48*a*. Due to this pushing pressure, brightness and response speed are enhanced.

Meanwhile, when actuator 22 is caused to go OFF, thereby extinguishing light, the voltage between transparent electrode 290 and row electrode 48*a* becomes virtually zero (Vc≈Va), and a voltage (Va<Vb) is applied between row electrode 48*a* and column electrode 48*b*. Actuator 22 thereby bends and displaces so that it becomes convex in chamber 34, thus making pixel structural unit 30 separate from optical wave guide plate 20.

While transparent electrode 290 may be formed on either the back side of optical wave guide plate 20 or on the end of pixel structural unit 30, it is preferable to form it on the end of pixel structural unit 30 because the distance to row electrode 48*a* decreases and a stronger static electric charge can be generated. In addition, if transparent electrode 290 is formed on the back face of optical wave guide plate 20, it has the effect of enhancing the separation of pixel structural unit 30. Generally, a localized surface electric charge generated on pixel structural unit 30 and optical wave guide plate 20 occurs due to the contact or separation of pixel structural unit 30. This aids in pixel structural unit 30 contacting optical wave guide plate 20. However, in this case, a problem arises in that it is easy for pixel structural unit 30 to stick to optical wave guide plate 20. Thus, by forming transparent electrode 290 on the back face of optical wave guide plate 20, the occurrence of localized surface electrical charges is moderated, the problem with sticking is overcome, and the separation of pixel structural unit 30 is enhanced.

Figure 43A:
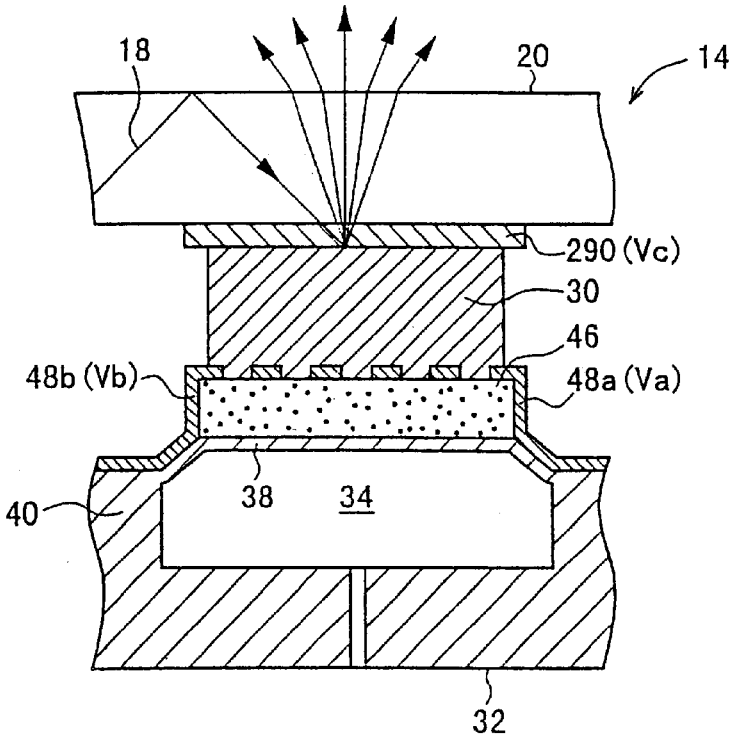
FIG. 43A is a cross-sectional drawing showing the state of light being emitted in another example of a display element which uses static electricity.
Figure 43B:
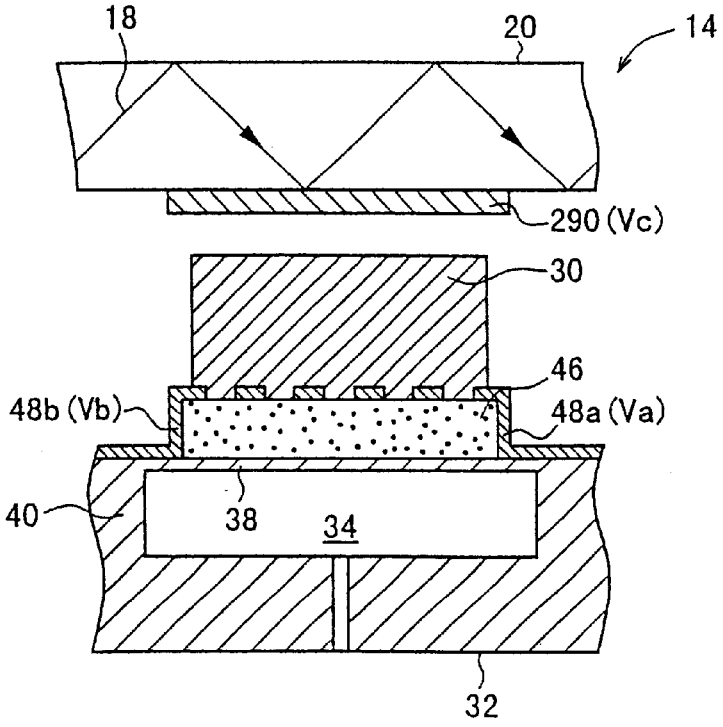
FIG. 43B is a cross section of the state in the example of FIG. 43A when that light is extinguished.

The concept of taking advantage of static electricity with transparent electrode 290 can also be applied to the display element 14 shown in FIGS. 43A and 43B. If transparent electrode 290 is formed on the back face of optical wave guide plate 20 and a voltage (Vc>Va, Vc>Vb) is applied between this transparent electrode 290 and the pair of electrodes 48*a* and 48*b*, static electricity is generated between them. Here, considering that the light is off when actuator 22 is in its natural state, actuator 22 bends and displaces in the direction of optical wave guide plate 20 when actuator 22 goes ON. This is due to the voltage (Va<Vb<Vc) between the pair of electrodes 48*a*, 48*b* and the attraction of static electricity. Pixel structural unit 30 quickly moves toward optical wave guide plate 20 and light is emitted. Conversely, when no voltage is applied between transparent electrode 290 and the pair of electrodes 48*a* and 48*b* ((Va≈Vb≈Vc), actuator 22 goes OFF, and due to the rigidity of actuator 22, pixel structural unit 30 separates from optical wave guide plate 20 and light goes OFF.

A display 10 configured by arranging numerous display elements using static electricity like this can be made to apply drive devices 200A through 200F of the first through sixth embodiments.

Figure 44:
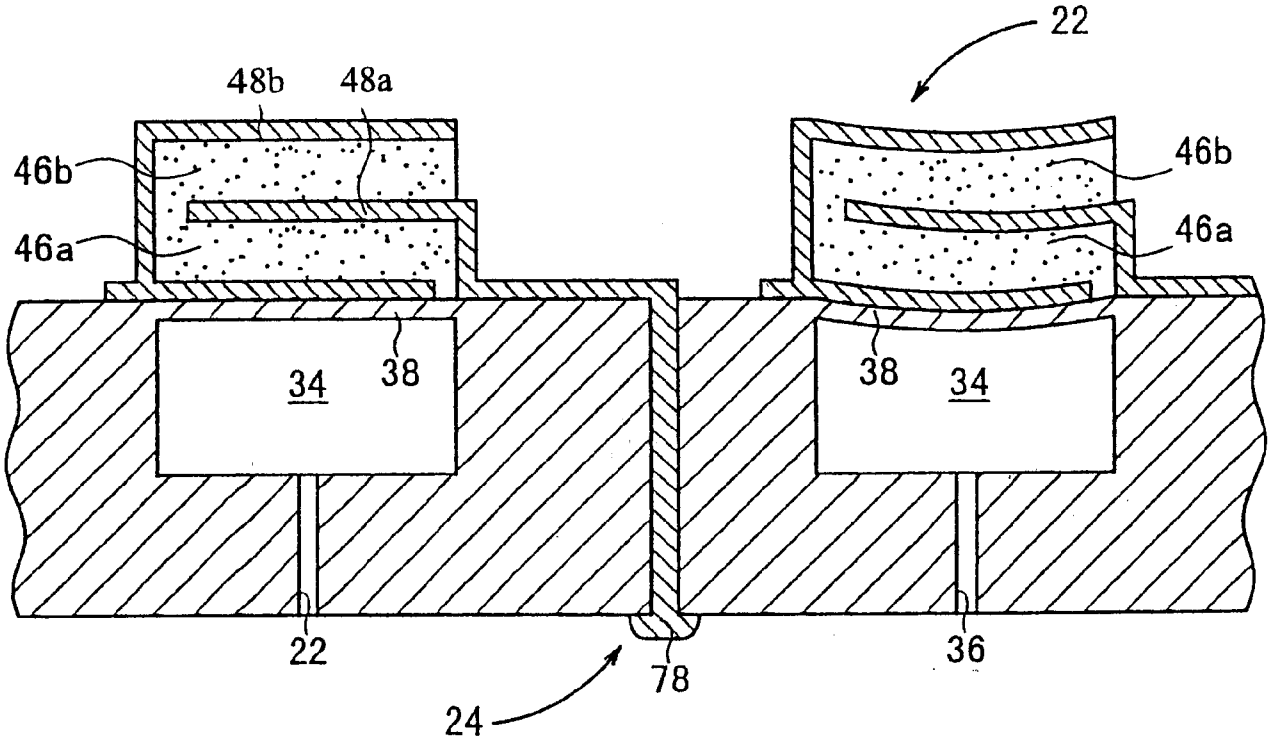
FIG. 44 is a cross-sectional drawing showing another configuration of an actuator.

Referring to FIG. 44, although shape retaining layer 46 is described in the first through sixth embodiments as configured with a single layer, shape retaining layer 46 may have a multiple layer construction so that each layer alternately forms pairs of electrodes 48*a* and 48*b*. The lower face of first shape retaining layer 46*a* and the upper face of second shape retaining layer 46*b* form column electrode 48*b*, while row electrode 48*a* is formed between the first and second layers 46*a*, 46*b*. Thus, the power (displacement power) of actuator 22 can be improved and the separation of pixel structural unit 30 (FIG. 2) can be improved by making shape retaining layer 46 multiple layers and alternately forming pairs of electrodes 48*a* and 48*b*.

Figure 45:
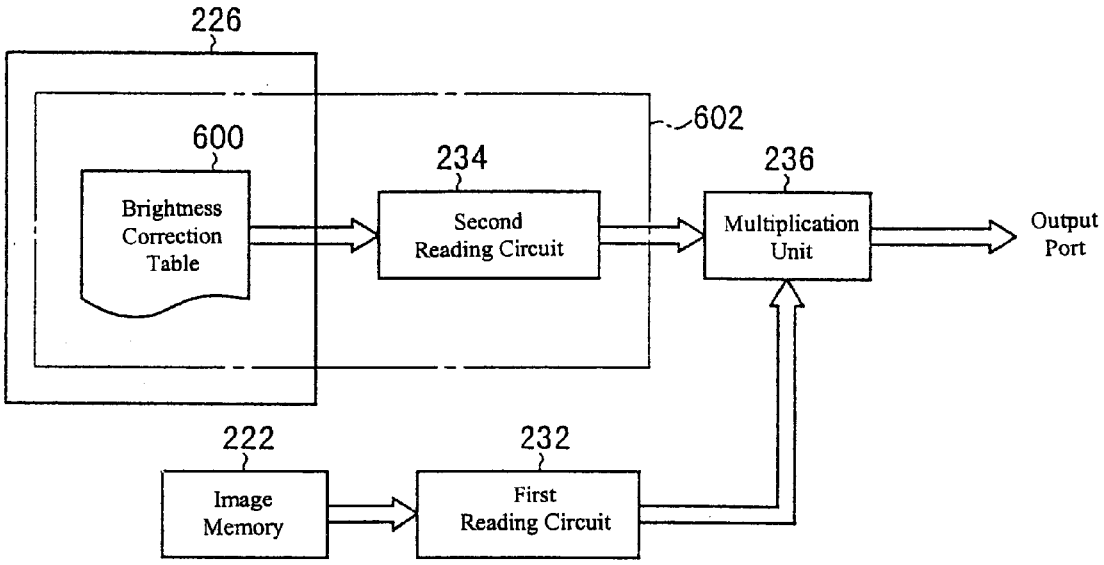
FIG. 45 is a block diagram for explaining a brightness correction mechanism.

Referring to FIG. 45, in driving devices 200 A through 200 F in the previously described first through sixth embodiments, brightness correction table 600 in which brightness correction data is employed to correct at least the brightness variation for each dot may be used as information stored in correction data memory 226 for correction. In this case, brightness correction table 600 is employed in correction data memory 226, and second reading circuit 234 functions as a brightness correction mechanism 602.

Figure 46:
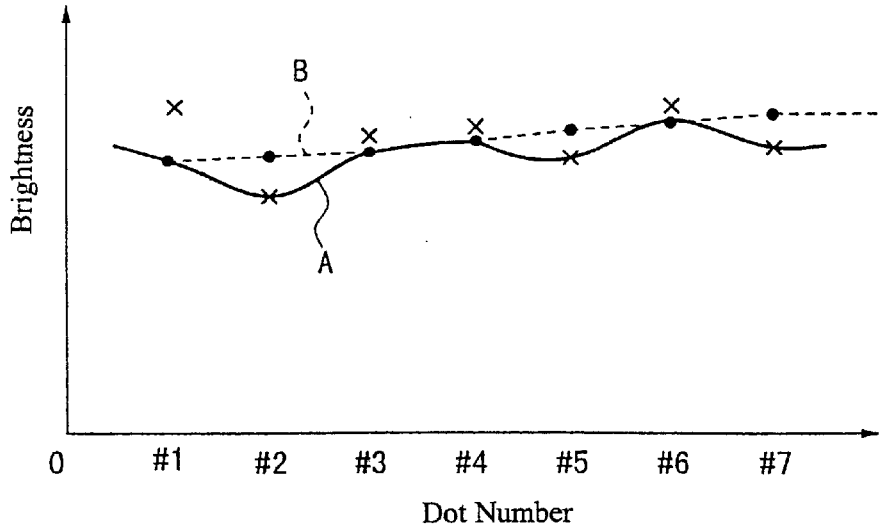
FIG. 46 is a graph showing an example of brightness distribution for each dot.
Figure 47:
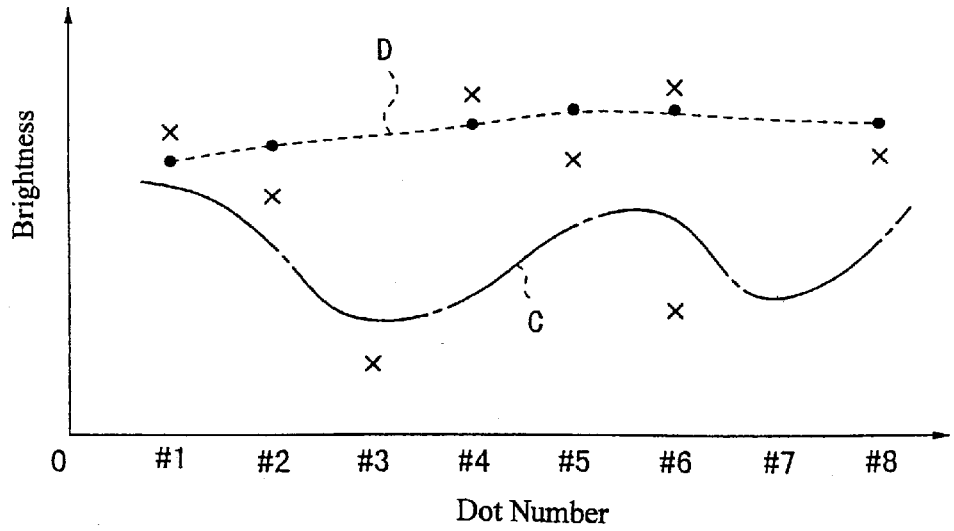
FIG. 47 is a graph showing another example of brightness distribution for each dot.

Referring to FIGS. 46 and 47, the brightness correction feature is explained. Before brightness correction table 600 is created, the brightness variation of each dot of display 10 is measured. Specifically, for example, a medium level signal on the gray scale (for example a gradation level of 128 when the full scale gradation level is 256) with respect to all the dots of display 10 is produced and displayed. The brightness of each dot is measured for all dots with a CCD camera and the actual distribution of brightness is determined. Then, a leveling process of the actual distribution of brightness is performed based on the observed brightness value for each dot to obtain a theoretical brightness distribution. Some examples of leveling processing are averaging processing, the least squares method, and high order curve-fitting, etc.

FIGS. 46 and 47 show brightness distributions for each dot of a line. In these figures, the plot expressed by × is the actually observed brightness distribution while the plot expressed by · (curve B) represents the theoretical brightness distribution. As FIG. 46 shows, the variation of the actually observed brightness for each dot in the observed brightness distribution is small and brightness correction for all dots is performed when the curve becomes a smooth theoretical brightness distribution, such as exemplified by curve B, by virtue of leveling processing.

To explain the preferred specific technique of brightness correction, when the observed brightness value is greater than the theoretical brightness value as shown in dots #1, #3, #4 and #6, a correction coefficient of less than 1 is used. This lowers the brightness values for these dots. The correction coefficient (the observed brightness value × the correction coefficient ≈ the theoretical brightness value) is recorded in brightness correction table 600 as brightness correction data for those dots.

Meanwhile, when the observed brightness value is less than the theoretical brightness value as shown in dots #2, #5, and #7, a correction coefficient of 1 is used, i.e., the brightness values are unchanged, and the correction coefficient is registered in brightness correction table 600 as brightness correction data for those dots. The result is that a more uniform brightness distribution (curve A) is achieved than would be the case with the observed brightness distribution as plotted by the ×.

As FIG. 47 shows, sometimes the actual observed brightness distribution is low in some places with a completed display 10. Dots #3 and #7 in FIG. 47 are extremely low, and in such cases, even though leveling processing is performed, the theoretical brightness distribution will not be level and will cause the mean brightness to be lowered unnecessarily as the brightness corrected curved line C shows. In such cases, a theoretical brightness distribution which has a level curved line is sought by performing leveling processing while ignoring dots which have extremely low observed brightness values. The specific technique for brightness correction is the same as that described earlier. In this way, the variation in brightness of each dot caused by the manufacturing process is absorbed by using brightness correction mechanism 602, thus improving image quality.

Figure 48:
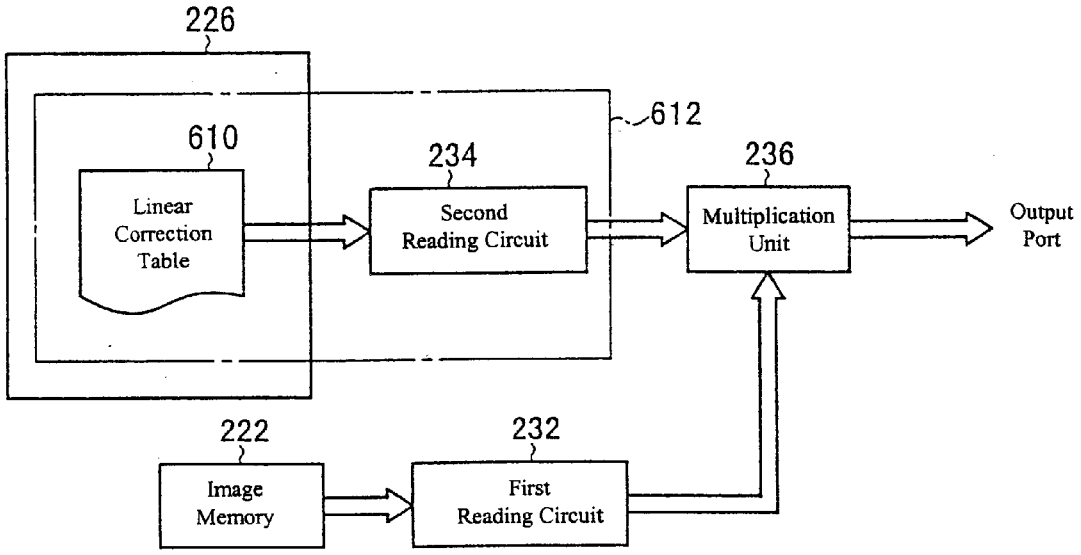
FIG. 48 is a block diagram for explaining a linear correction mechanism.

Referring to FIG. 48, in driving devices 200A through 200F in the first through sixth embodiments, a linear correction table 610 in which linear correction data are employed to make display properties linear with respect to the gradation level for each dot may be used as information stored in correction data memory 226. In this case, linear correction table 610 employed in correction data memory 226 and second reading circuit 234 function as a linear correction mechanism 612.

Figure 49A:
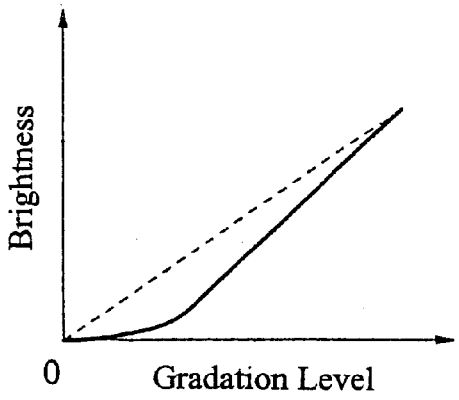
FIG. 49A is drawing showing the brightness properties of a given dot.
Figure 49B:
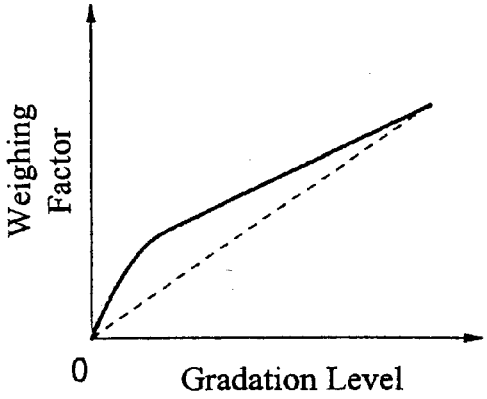
FIG. 49B is a graph showing a weighting factor for making brightness properties linear.
Figure 49C:
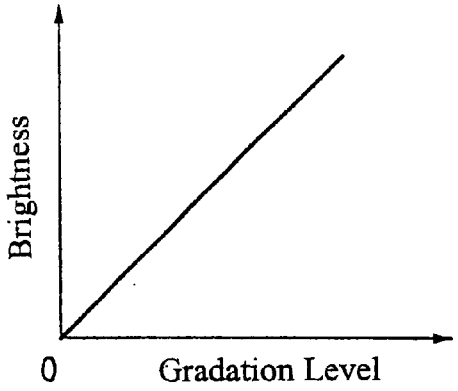
FIG. 49C is a graph showing brightness distribution after making brightness properties linear.

Referring to FIGS. 49A–49C, the linear correction feature is explained. The brightness of each dot of display 10 is measured. Then, linear correction table 610 is created. More specifically, for example, a signal which increases the gray scale in stages is produced for all the dots of display 10, and the brightness variation properties (brightness properties) with respect to the gradations of the gray scale are measured in this state using an imaging device such as a CCD camera. The number of points plotted for each dot is determined corresponding to the correction data memory capacity and computing speed. FIG. 49A shows the brightness properties of a specific dot.

After that, a weighting factor to make the respective brightness properties for each dot linear is obtained based on the brightness properties for each dot. FIG. 49B shows the how the weighting factor varies with respect to the brightness properties for a specific dot. The weighting factor for each dot is sought for only those dots which were plotted when seeking the brightness properties, and the arrangement of these numerous weighting factors is defined as a reference table for making these dots linear. Then, this reference table is applied to each dot and is registered in correction data memory 226 as linear correction table 610. The weighting factor between plots may also sought in the display stage with such things, for example, as a primary approximation (broken line approximation).

In the actual display stage, the input gradation level of a given dot is read via first reading circuit 232. The weighting factor that corresponds to the input gradation level read from the reference tables for a given dot or the weighting factor sought by a primary approximation is read via second reading circuit 234. In multiplication circuit 236, at a later stage, the input gradation level value times the weighting factor is calculated and the product is output as linear gradation data as shown in FIG. 49C. In this way, the accurate display of images is possible, contrast is improved, and the image displayed appears sharp and crisp because the display properties for each dot will vary linearly corresponding to the gradation level by using linear correction mechanism 612.

Figure 50A:
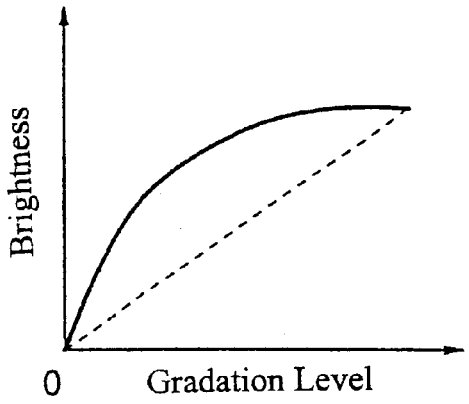
FIG. 50A is a graph showing brightness properties of a television signal that has been gamma corrected.
Figure 50B:
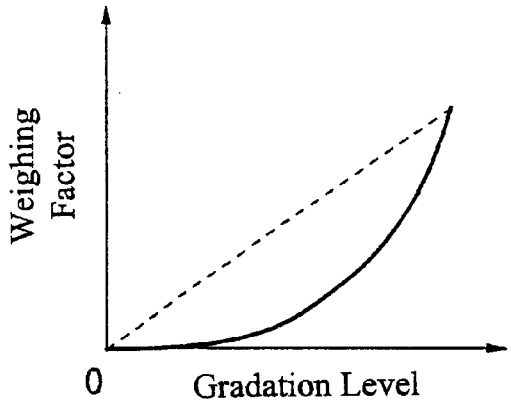
FIG. 50B is a graph showing a weighting factor for deleting gamma correction.
Figure 50C:
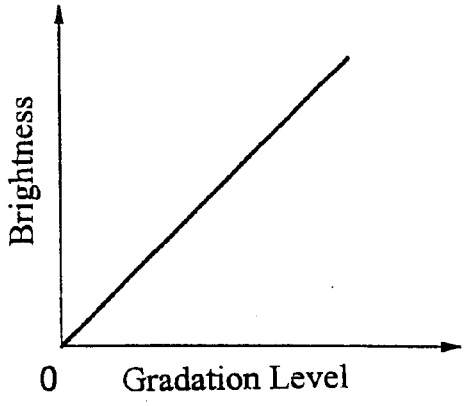
FIG. 50C is a graph showing brightness distribution after making brightness properties linear.

Referring to FIGS. 50A–50C, linear correction processing is performed when displaying the television signal images using display 10. In present color television formats, gamma correction is performed on the image transmission side in order to reduce the cost of receivers. Because this gamma correction is always focused for a Braun tube, it has the brightness properties shown in FIG. 50A. Because of that, if an image of a television signal that has been gamma corrected is displayed with display 10 as is, the resolution of the high saturation portion of the image is degraded, resulting in an image which is not crisp.

Thus, in the embodiment as shown in FIG. 50B, an arrangement of weighting factors that counteract the gamma correction are defined as a reference table for making each dot linear. Thus, as FIG. 50C shows, there no longer is degradation of the resolution of the highly saturated portions of images even when displaying a television signal that has been gamma corrected. It is possible to have crisper, sharper display images because the display properties for the gradation levels in image transmission systems are corrected linearly.

Figure 51:
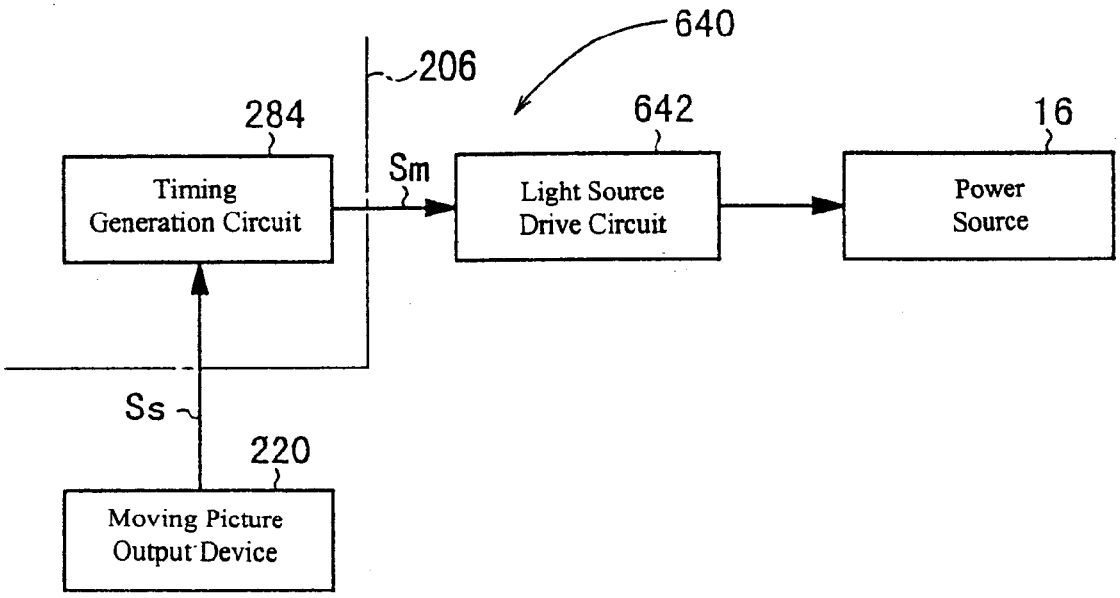
FIG. 51 is a block diagram for explaining a light adjustment control mechanism.

Referring to FIG. 51, driving devices 200A through 200F in the first through sixth embodiments may be fashioned so that they have a light adjustment control mechanism 640 which switches the power of light source 16 in at least two stages at a desired timing within one frame. This switching of the power of light source 16 by light adjustment control mechanism 640 may be performed by a light source drive circuit 642 based on an input of sensing signal Sm from timing generation circuit 284 provided in signal processing circuit 206. Timing generation circuit 284 detects the switch timing of the power of light source 16 based on the synchronization signal Ss provided from moving picture output apparatus 220.

Figure 52A:
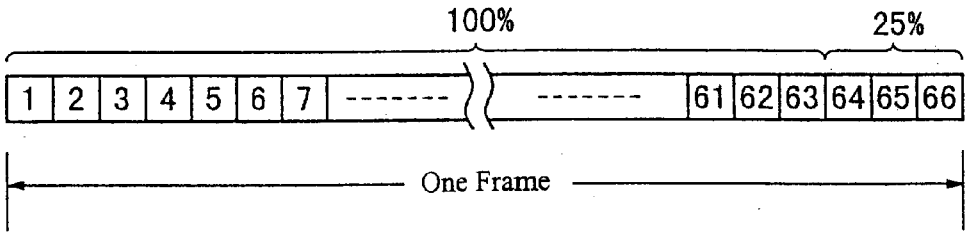
FIG. 52A is a timing chart showing an example of power source switch timing.
Figure 52B:
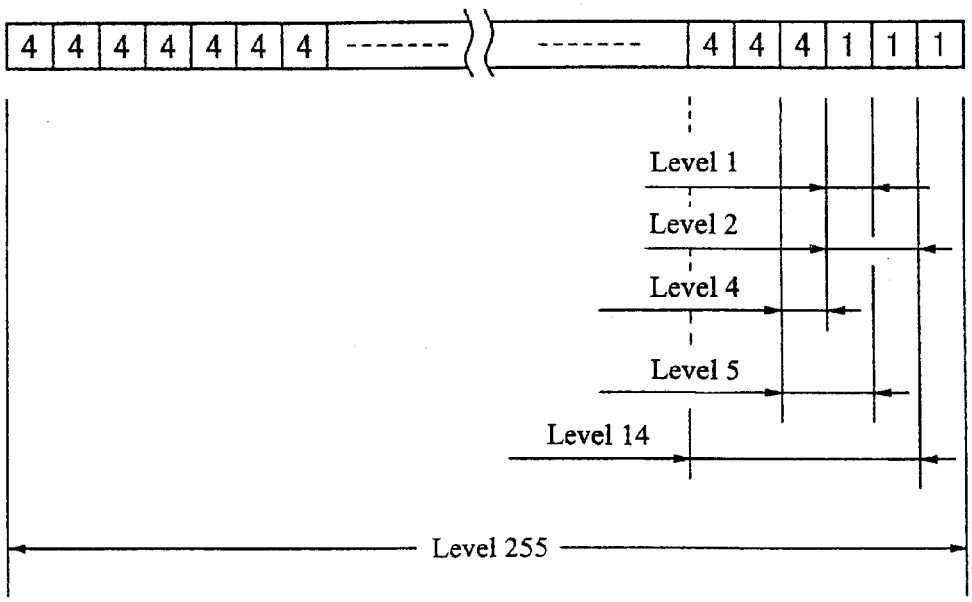
FIG. 52B is a timing chart showing an example of a combination of linear subfields selected corresponding to gradation level.

Referring to FIGS. 52A–52B, for example, if the explanation is based on driving device 200B of the second embodiment (FIG. 21), when a display period of one image is one frame, this single frame is equally partitioned into 63 multiple frames, with one partitioned interval being a linear subfield. Signal processing circuit 206 is such that for each dot, display time corresponding to respective gradation levels is continuously allotted to the necessary linear subfields, creating dot data.

Thus, 3 linear subfields (LSF 64, LSF 65, LSF66) are added following the 63 linear subfields while the power of light source 16 for the period from the first linear subfield (LSF1) to the $63^{rd}$ linear subfield (LSF 63) is 100%, but the power of light source 16 for the period from the $64^{th}$ linear subfield (LSF 64) to the $66^{th}$ linear subfield (LSF 66) is 25%. Therefore, even though the display interval of all linear subfields is the same, each of the linear subfields from LSF 1 to LSF 63 have four times the brightness of each of the linear subfields from LSF 64 to LSF 66.

Thus, as FIG. 52B shows, when expressing gradation level 1, an ON signal output to LSF 64, and when gradation level 2 is expressed, an ON signal is successively output to the $64^{th}$ and $65^{th}$ linear subfields, LSF 64 and LSF 65. Similarly, when expressing gradation level 4, an ON signal is output to the $63^{rd}$ linear subfield, LSF 63, and when gradation level 5 is expressed, an ON signal is successively output to the $63^{rd}$ and $64^{th}$ linear subfields, LSF 63 and LSF 64. To express gradation level 14, an ON signal is successively output to the $61^{st}$ through the $65^{th}$ linear subfields, LSF 61 through LSF 65.

In other words, in this example, merely by adding the 3 linear subfields, LSF 64 through LSF 66, what could heretofore be expressed in only 64 gradations can be expressed in 256 gradations (0–255). In addition, since only 3 linear subfields are added, there is little need to alter the display interval of one linear subfield for frames which are configured with 63 linear subfields, so that there is almost no design change problem. In addition, since the interval when the power of light source 16 is 25% is a short one of 3/66th of one frame, there is almost no degradation of the brightness of blank displays.

Figure 53A:
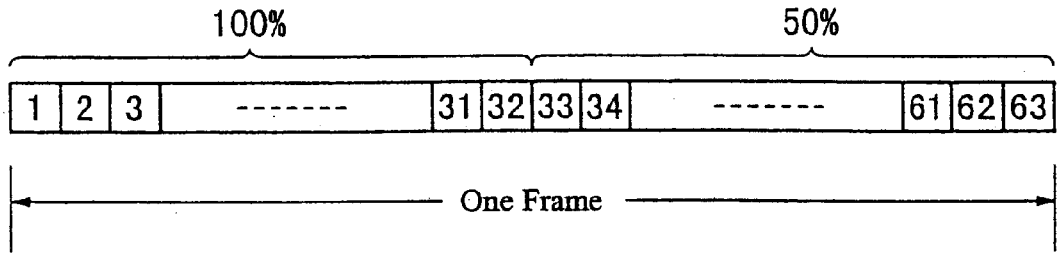
FIG. 53A is a timing chart showing another example of power source switch timing.
Figure 53B:
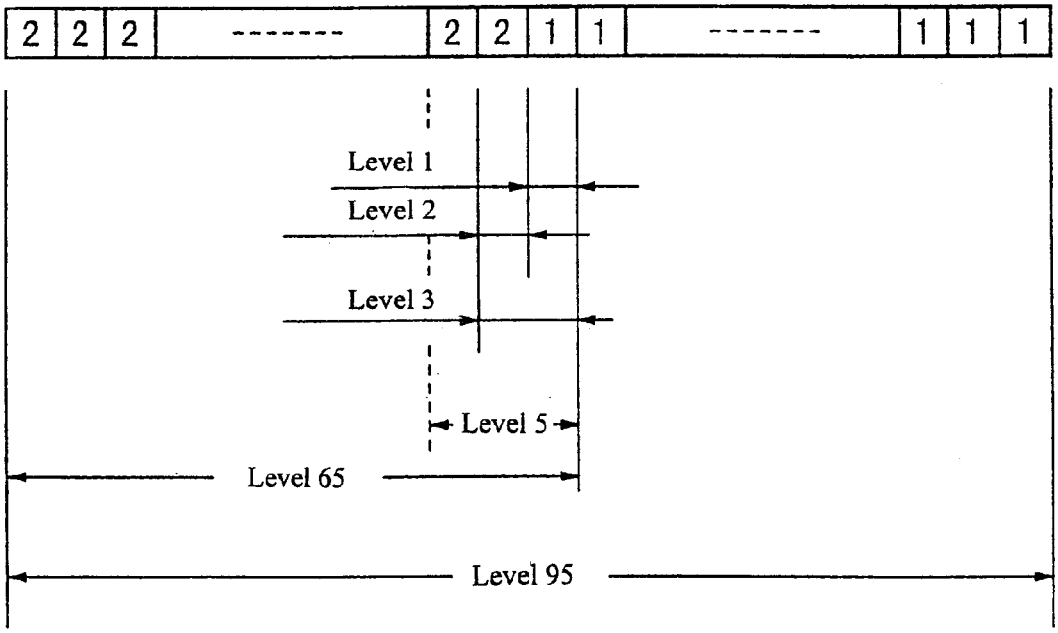
FIG. 53B is a timing chart showing another example of a combination of linear subfields selected corresponding to gradation level.

Referring to FIGS. 53A–53B, an alternate embodiment is shown. In the previously discussed example, three additional linear subfields LSF 64 through LSF 66 were added following linear subfields LSF1 through LSF 63 so that the power of light source 16 would be switched between 100% and 25%. In FIG. 53A, the 32 linear fields of the first half of the 63 linear subfields, i.e., linear subfields LSF 1 through LSF 32, are configured so that they have 100% of the power of light source 16, while the 31 linear subfields of the latter half, linear subfields LSF 33 through LSF 63, are configured so that they have 50% of the power of light source 16.

In this case, despite fact that the display interval of all linear subfields is the same, each of linear subfields LSF1 through LSF 32 has twice the brightness of each of linear subfields LSF 33 through LSF 63. Thus, as FIG. 53B shows, when expressing gradation level 1, an ON signal is output to the $33^{rd}$ linear subfield, LSF 33, and when gradation level 2 is expressed, an ON signal is successively output to the $32^{nd}$ linear subfield, LSF 32. Similarly, when expressing gradation level 3, an ON signal is output to the $32^{nd}$ and $33^{rd}$ linear subfields, LSF 32 and LSF 33, and when gradation level 5 is expressed, an ON signal is successively output to the $31^{st}$ through the $33^{rd}$ linear subfields, LSF 31 through LSF 33.

In other words, in this example, what could heretofore be expressed in only 64 gradations can be expressed in 96 gradations (0–95). In addition, when all of the power of light source 16 is used for the 63 linear subfields, LSF 1 through LSF 63, a smaller amount of electric power is consumed when expressing a low level of gradation, such as in this example, since an interval of 50% of the power of light source 16 is incorporated.

In the present example, the device may be configured so that the average brightness of the image of the next frame accumulated in image memory 222 is evaluated, and if the average brightness of that image is high, the next frame fixes the power of light source 16 at 100% with the gradation control expressed with 63 linear subfields LSF 1 through LSF 63. In this case, this can prevent the appearance of the overall brightness diminishing.

A high speed cold cathode tube with superior response (a starting speed of 0.1 ms or less), an LED (starting speed of 20 ns or less) or a fluorescent tube arranged with a carbon nanotube field emitter for a cathode may be used as light source 16.

Figures 54A, 54B, 54C:
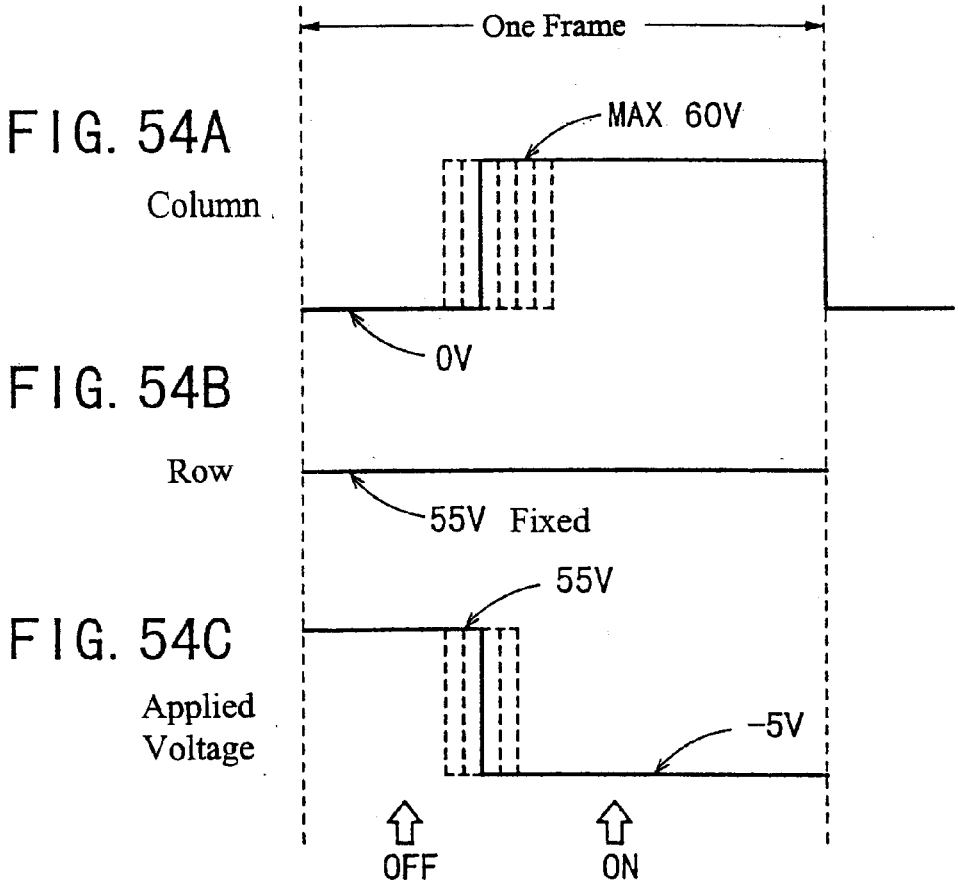
FIG. 54A shows a signal applied to a column electrode in normal driving.
FIG. 54B shows a signal applied to a row electrode.
FIG. 54C shows a voltage applied to a dot.

Referring to FIGS. 54A–54C, the driving method presented below is applicable to driving devices 200A through 200F of the first through sixth embodiments. First, the normal driving method is explained using driving device 200B of the second embodiment as the example. In terms of one dot, there is an interval that an ON signal must be output and an interval that an OFF signal should be output corresponding to the gradation level of the dot. Then, in the interval that the OFF signal is to be output, various voltages are applied, for example, 0 V to column electrode 48*b* as shown in FIG. 54A and 55 V (fixed) to row electrode 48*a* as shown in FIG. 54B, resulting in a difference in electric potential of 55 V applied to the dot as shown in FIG. 54C, thereby effectively extinguishing light.

Then, at the point approaching the interval when an ON signal is to be output, various voltages are applied, for example, 60 V to column electrode 48*b* (FIG. 54A) and 55 V (fixed) to row electrode 48*a* (FIG. 54B), resulting in a difference in electric potential of −5 V (FIG. 54C) applied to the dot, thereby illuminating it.

In this normal operation, because gradation expression is performed for each dot at the point a frame begins, it is necessary for pixel structural unit 30 to be sufficiently separated from optical wave guide 20 at the beginning of each frame however, there is also the possibility that the response of pixel structural unit 30 at the time of separation is slow due to the response of the unit being late or due to pixel structural unit 30 losing its separation over time, or in the worst case scenario, pixel structural element 30 remaining flush against optical wave guide 20 and not separating from it.

FIGS. 55A and 55B show the results of a test which measures the illumination properties of dot 26 in the previously described operation. This test, while measuring the wave form of the applied voltage Vc to a given dot 26 (FIG. 55A), measures the intensity variation (Ld) or light scattered from this dot 26 with an Avalanche Photo Diode (APD). From FIG. 55B, we can tell that these illumination properties gradually approach an OFF state from the beginning of a frame and that the OFF response within a frame is slow.

In order to prevent this, when the voltage applied to row electrode 48*a* is 100 V, for example, the voltage that should be applied to column electrode 48*b* in the ON signal interval must be 105 V in order to realize an illuminated state in the interval that the ON signal is output. In this case, the voltage resistance of Driver IC 210B needs to be increased, and in that respect, Driver IC 210B becomes larger and more expensive.

Figures 56A, 56B, 56C:
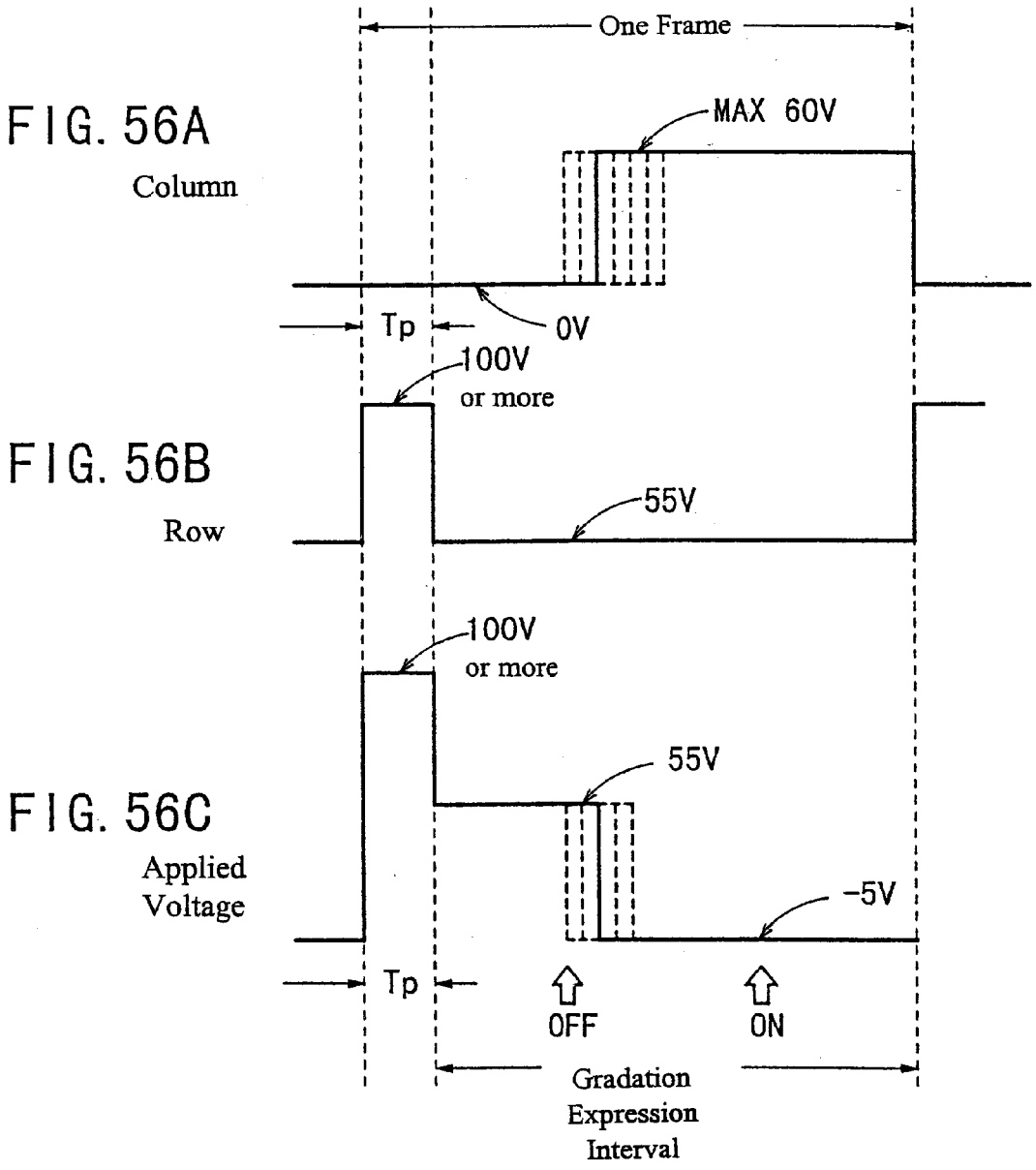
FIG. 56A shows a signal applied to a column electrode when a preliminary interval is provided.
FIG. 56B shows a signal applied to a row electrode.
FIG. 56C shows voltage applied to a dot.

Then, in this embodiment as FIGS. 56A–56C show, in the initial designated interval of one frame (preliminary interval Tp). a voltage (separating voltage) is applied that ensures that all dots separate. This preliminary interval Tp allocates time (for example, 1 msec) to the entire frame (for example 1/60th Hz=16.7 ms) that does not for the most part influence the illumination brightness. Then, for example, the preliminary interval Tp is entered when one frame begins, and as shown in FIG. 56A, a voltage of 0 V is applied to the column electrode 48*b* of all dots, and as shown in FIG. 56B, a separating voltage of 100 V or more is applied to row electrode 48*a*, resulting in this difference in electrical potential being applied to all dots as shown in FIG. 56C. By virtue of this, all dots definitely extinguish light at the beginning of a frame so that the separation of pixel structural unit 30 is improved and the yield of display 10 is improved virtually without adding components.

Figures 57A, 57B:
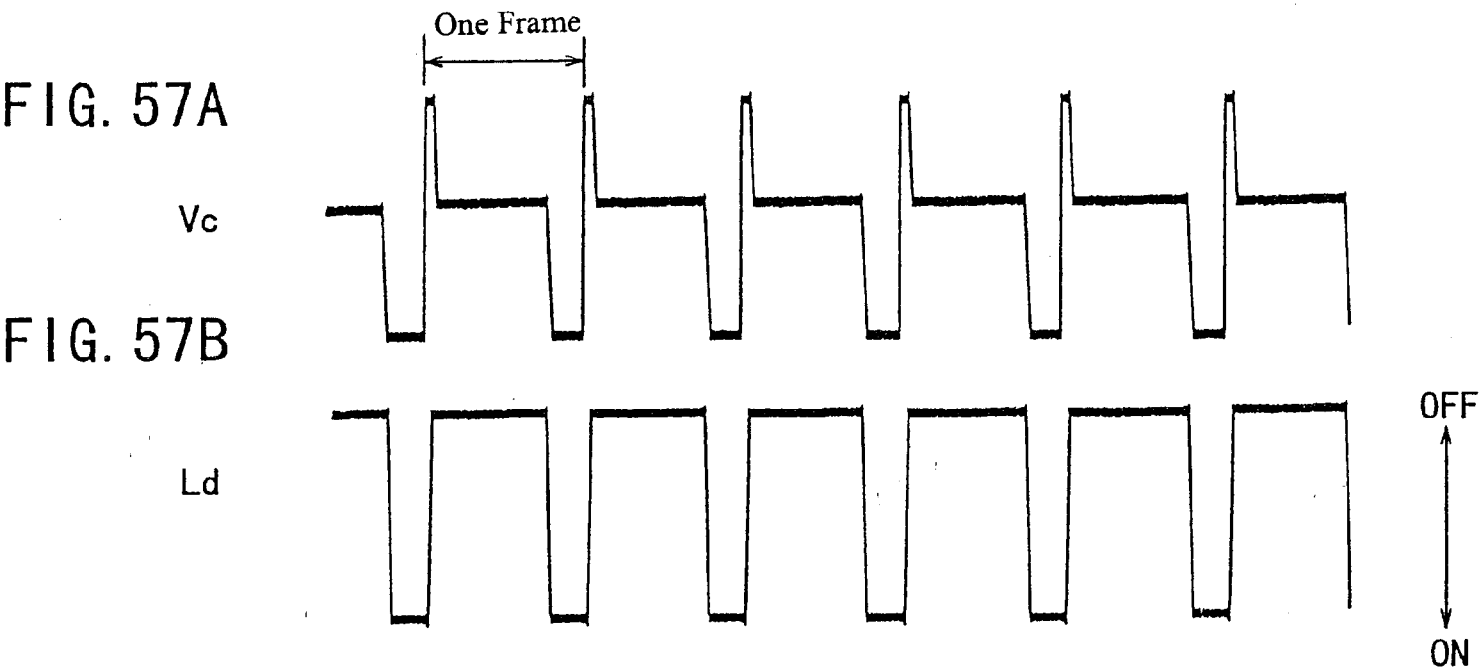
FIG. 57A shows the applied voltage wave form when a preliminary interval is provided.
FIG. 57B shows the light intensity distribution of FIG. 57A.

FIGS. 57A and 57B show the results of a test which measures the illumination properties of dot 26 when the preliminary interval is provided. This test, while measuring the wave form of the applied voltage Vc to a given dot 26 (FIG. 57A), measures the intensity variation (Ld) or light scattered from this dot 26 with an Avalanche Photo Diode (APD). From FIG. 57B we can tell that these illumination properties quickly approach an OFF state from the time a frame begins and that the OFF response within a frame is extremely rapid.

The separating voltage applied to preliminary interval Tp can set a voltage equal to or greater than the resistance voltage of driver IC 210B, or more specifically, a voltage that sufficiently displaces pixel structural unit in a separating direction because it is generated by row drivers. Thus, there is no need to change driver IC 210B.

Figure 58:
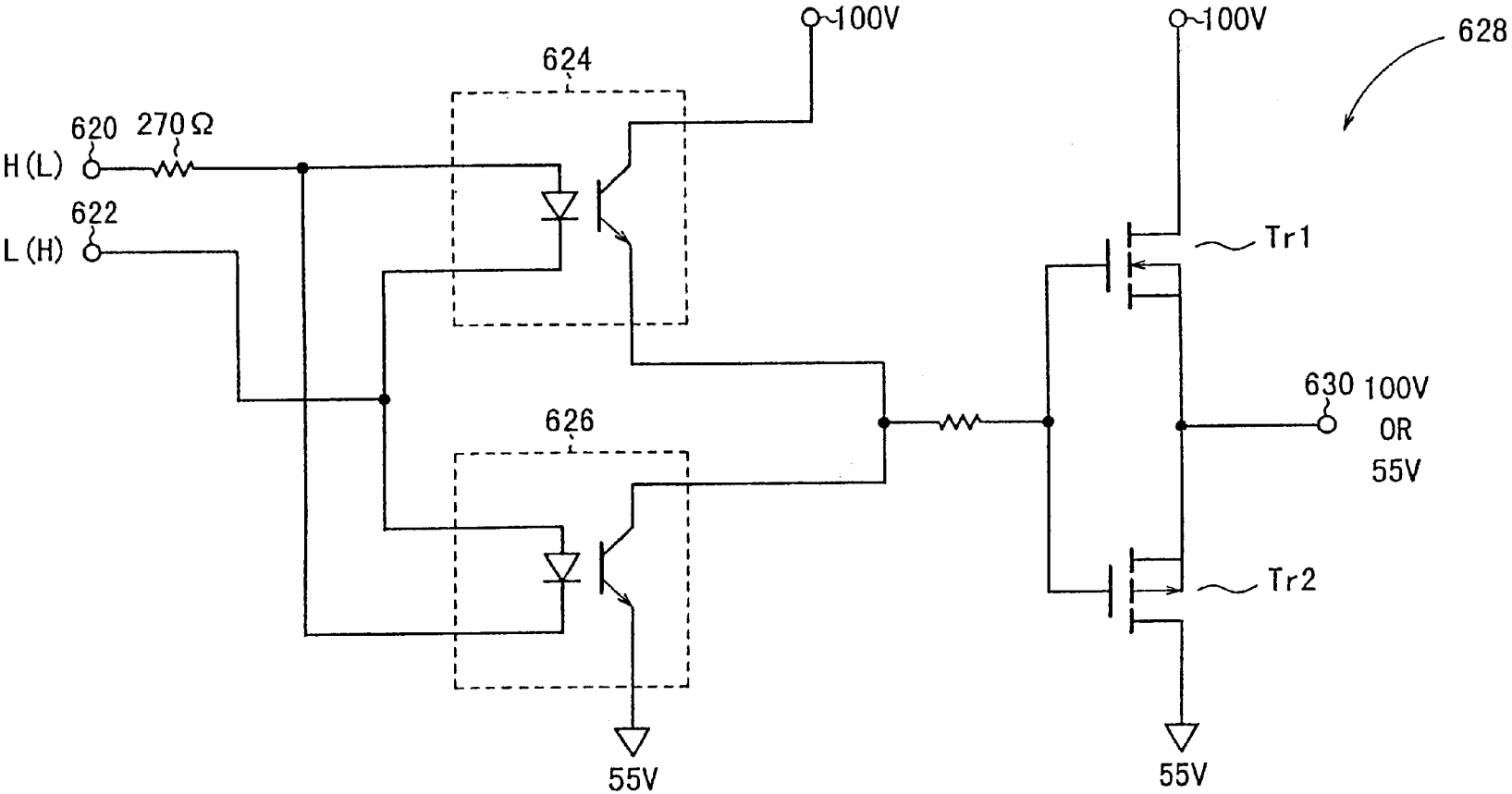
FIG. 58 shows an example of circuits used in row electrode drive circuits.

Referring to FIG. 58, row electrode drive circuit 202 is a circuit that can drive all dots together, and moreover can be realized inexpensively. To explain the operation of the circuits shown in FIG. 58 in brief, in preliminary interval Tp, a high level signal is input to a first input pin 620 and a low level signal is input to a second input pin 622. By virtue of this, a first photocoupler 624 goes ON and a second photocoupler 626 goes OFF, a high level signal is applied to each gate of later stage CMOS transistor 628, and the result is that NMOS transistor Tr1 goes ON and a high level signal (100 V) is output from an output pin 630.

Meanwhile, in the intervals other than preliminary interval Tp, a low level signal is input to first input pin 620 and a high level signal is input to second input pin 622. By virtue of this, first photocoupler 624 goes OFF and second photocoupler 626 goes ON, a low level signal is applied to each gate of later stage CMOS transistor 628, and the result is that PMOS transistor Tr2 goes ON and a low level signal 55 V) is output from output pin 630.

Further, by adding multiplication of gradations with image processing, such as, for example, the error diffusion method and the dithering method, the number of gradations that can be expressed can be increased in the subfield driving that driving devices 200A, 200C and 200E show and in the linear subfield driving that driving devices 200B, 200D and 200F show.

In addition, by merely using gradation expression by image processing, a static image that does not consume much electric power can be displayed without using the subfield driving and linear subfield driving methods that were previously explained, because each dot becomes fixed by an ON or OFF state. For example, this embodiment is suitable for use as electric posters. In this case, because dots are displacement driven only when recasting the static image displayed to another image, the amount of electrical power consumed is significantly reduced.

There are occasions when an area displaying a static image and an area displaying a moving image coexist. The electric power consumed by mixed displays of moving and static images of this type are significantly reduced by providing two systems for coping with these types of display patterns for the display controller, (1) a system for handling moving pictures (subfield driving and linear subfield driving), and (2) a system for handling static images (gradation expression with image processing only). These display formats are suitable for displaying advertisements or notices etc. which disseminate content, either digital content or analog content, from ground waves, the Internet, telephone lines, via satellite, or from central facilities in cable television.

Dissemination from a central content disseminating facility for disseminating compressed static images or moving picture files is particularly desirable when using the Internet. Files disseminated from a central facility are decoded at an Internet connected display and become display data. In this case, it is preferable to provide a compressed file decoder in the initial stage of image data processing circuit 224. In addition, the device should be configured so that, by providing an external storage device such as a hard disk on the display side (content receiving side), image content is stored and at the time of display image content is read from this external storage device. In this case, content disseminated from a central facility can be accumulated in a display side external storage device.

With these types of methods, by connecting multiple displays and central facilities with the Internet etc., display of the most suitable content from a central facility conforming to the display location and time zone can be centrally managed in a consolidated manner.

Figure 59:
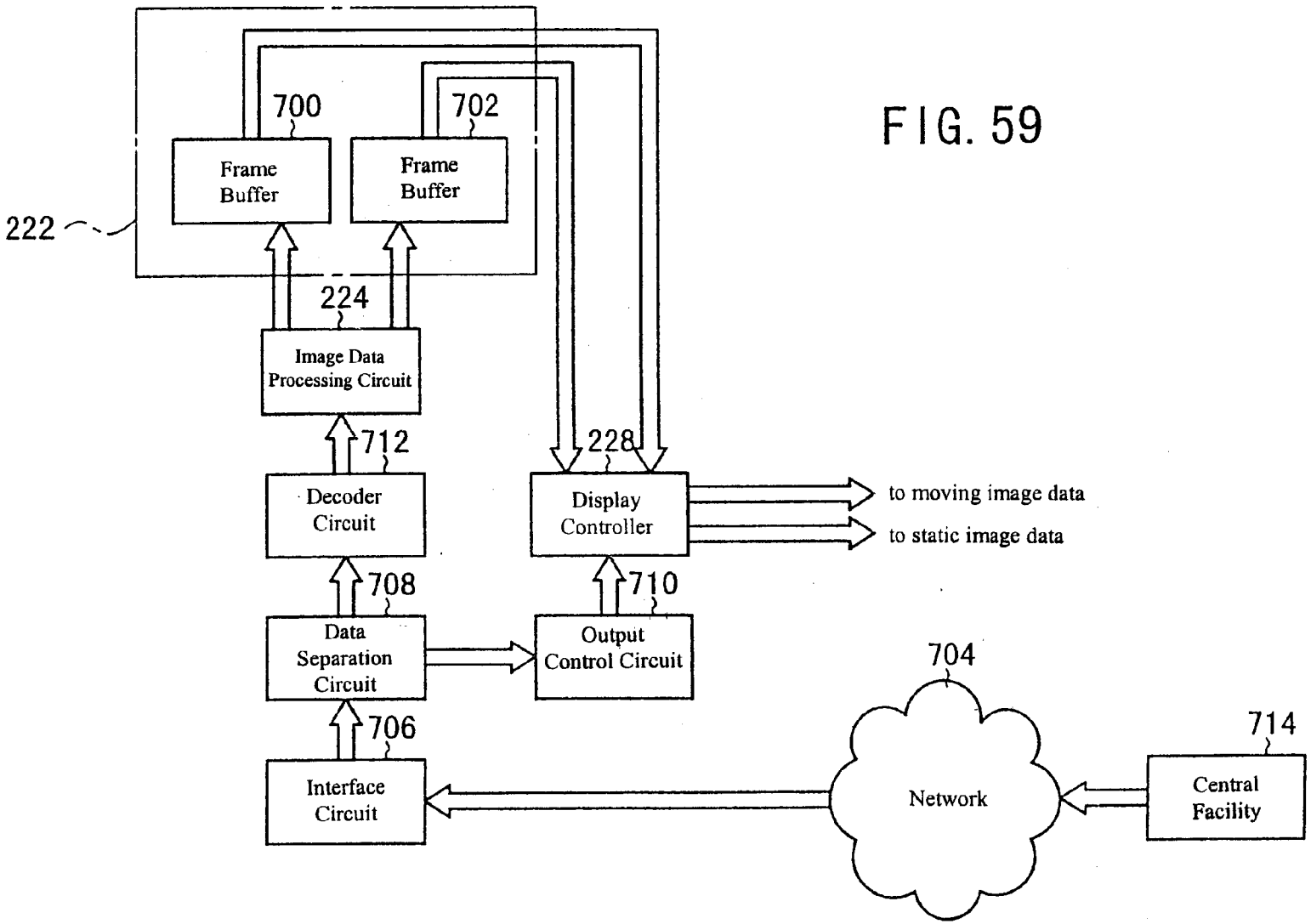
FIG. 59 is a block diagram showing the first specific example of a form of use.

Referring to FIG. 59, we explain the first specific example of how this embodiment is used realizing the features explained above. A static image frame buffer 700 and a moving image frame buffer 702 are installed for image memory 222. Then the embodiment is realized by providing, for example, an interface circuit 706 which receives various types of data and outputs it to later stage circuit systems, a data separation circuit 708 which separates control data from files (static image files and moving image files) concerning images output from interface circuit 706, an output control circuit 710 which performs control (control handling static images and control handling moving images) of display controller 228 in display element 14 units based on control data from data separation circuit 708, and a compressed file decoder circuit 712 which is installed in the initial stage of image data processing circuit 224 for decoding files concerning compressed images and restoring static image data and moving image data.

By virtue of this, data received by interface circuit 706 via a network 704 from a central facility 714 is separated into files concerning images and control data by separating circuit 708, and these separate files are supplied to compressed file decoder 712 and output control circuit 710 respectively.

Compressed file decoder circuit 712 decodes files concerning images that are supplied, restores static image data and moving image data, and outputs these to later stage image data processing circuit 224. Image processing circuit 224 stores restored static image data in static image frame buffer 700 and stores moving image data in moving image frame buffer 702. Meanwhile, output control circuit 710 controls display controller 228 based on control data from data separation circuit 708. Here, as control data, it may use such things as the address for display element 14 which displays static image data. Output control circuit 710 separates data in first and second reading circuits 232, 234 (e.g., FIG. 41) in display controller 228 and data transfer portion 230 (e.g., FIG. 23) into those for use with static images and those for use with moving images based on this control data.

By virtue of this, among the display controllers 228, static image data from static image frame buffer 700 is read by circuit systems allocated for use with static images and static images are displayed through numerous display elements 14 that indicate address data. Moving image data from moving image frame buffer 702 is read by circuits allocated for use with moving images and moving images are displayed through numerous display elements 14 other than the numerous display elements 14 which indicate address data.

Figure 60:
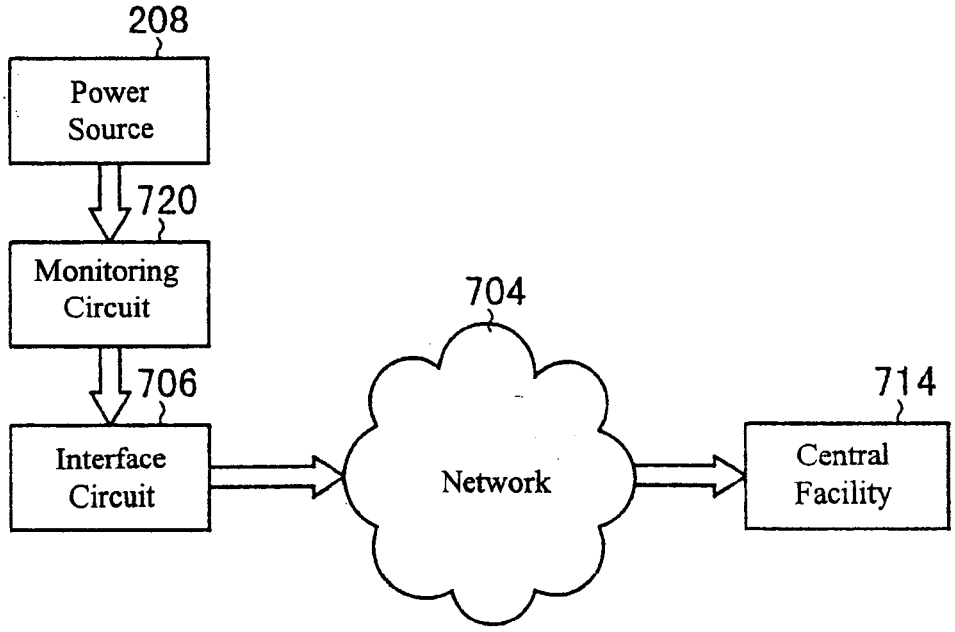
FIG. 60 is a block diagram showing the second specific example of a form of use.

Referring to FIG. 60, we explain a second specific example of how this embodiment is used. The device may be configured so that the power source current in each individual display 10 is monitored, thereby resulting in status information for each respective display 10 being periodically sent to central facility 714. In this case, a monitoring circuit 720 is provided in power source 208 and its output is realized as status information and sent by interface circuit 706. By virtue of this, it becomes possible to manage from central facility 714 whether or not numerous displays 10 in distant locations are functioning.

Figure 61:
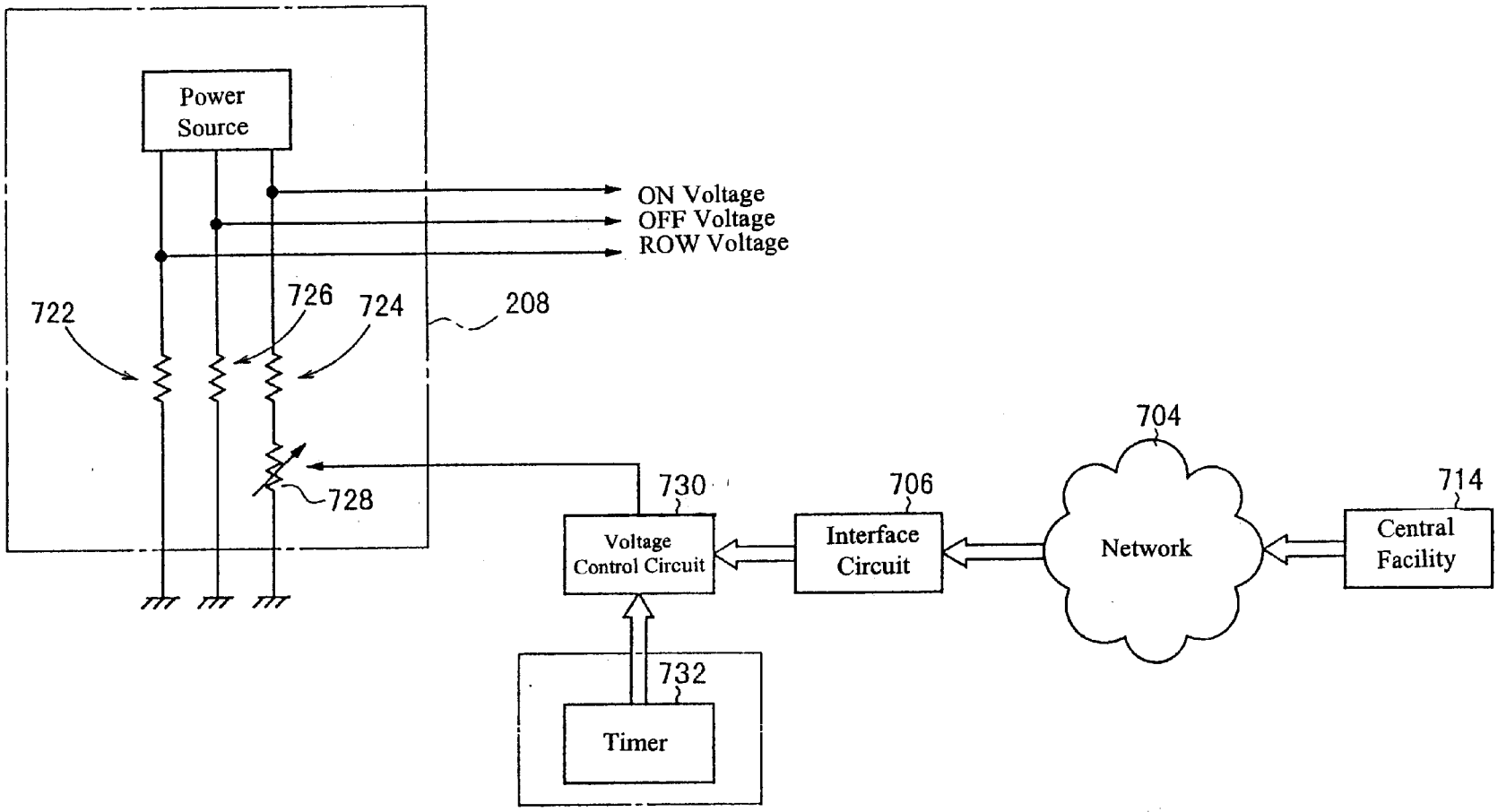
FIG. 61 is a block diagram showing the third specific example of a form of use.

Referring to FIG. 61, the third specific example of how this embodiment is used to correct the deterioration of brightness which comes with changes over time. In brief, if a display is driven over an extended period of time, the ON properties of the dots (the contacting properties of pixel construct 30 with the main face of optical wave guide 20) deteriorate and there is a concern that this brings about a deterioration of display brightness. By decreasing the ON voltage of a dot (increasing the absolute value), the display brightness can be maintained at nearly the same level as the initial stage in order to prevent this from occurring.

Power source 208 can be configured in a number of ways. For example, a row voltage generating system 722 generates row voltage which is applied to row electrode 48*a*. An ON voltage generating system 724 generates ON voltage which is applied to column electrode 48*b*. An OFF voltage generating system 726 generates OFF voltage which is also applied to column electrode 48*b*. Alternatively, variable voltage can be generated in ON voltage generating circuit 724, such as, for example, with a variable resistor 728 as shown in the embodiment of FIG. 61. Interface circuit 706, which receives information concerning changes in voltage from central facility 714, and a voltage control circuit 730, which controls variable resistor 728 and sets the ON voltage at a desired voltage based on the information from interface circuit 706, are then provided and configured in a prior stage of power source 208.

The factory then manages the results of measuring the displays 10 which are used to monitor the deterioration of brightness at a central facility 714 and sends information through network 704 concerning voltage changes for applicable displays 10 installed in various areas which have reached the period when brightness begins to deteriorate. Displays 10 receive the information from central facility 714 via interface circuit 706 and change the ON voltage generated by ON voltage generating system to the desired voltage.

For example, when the row voltage is 50 V and the ON voltage is 50 V at the time of installation, 0 V is applied to dots which operate ON. Then, when brightness begins to deteriorate over time, the ON voltage is changed to 52 V by furnishing voltage modification information. By doing this, a −2 V lower than zero V is applied to the dots which operate ON, causing pixel construct 30 once again to displace toward optical wave guide plate 20, and the brightness when ON improves.

When more time has passed and brightness has deteriorated, the ON voltage is again modified to 54 V, for example, by once again furnishing voltage modification information. By doing this, a −4 V lower than zero V is applied to the dots which operate ON, and pixel construct 30 once again displaces toward optical wave guide plate 20, so that the brightness when ON improves.

As described above, the period when brightness will deteriorate is calculated using displays 10 for monitoring at a factory, but an alternate method may be adopted whereby on-site managers notify the central facility by electronic mail, telephone, etc. that brightness of a display is deteriorating. Voltage modification information about that display 10 is then sent from central facility 714.

Although remotely operated examples using network 704 are given in the above example, display 10 itself may be configured to have a voltage modification feature. For example, time information indicating that brightness will deteriorate and voltage values to variable resistor 728 are supplied in advance to numerous registers installed in voltage control circuit 730. When the information from a timer 732 which is connected to a prior stage of voltage control circuit 730 matches time information in the register, deterioration of brightness can be counteracted by controlling variable resistor 728 with the voltage value stored in this register and setting a desired ON voltage.

As another example, a dummy actuator 22 may be created among numerous display elements, such as, for example, display elements arranged in the vicinity of a display screen, and the displacement status of actuator 22 is sensed by a sensor such as a strain gauge. Then, whether or not brightness has deteriorated is ascertained based on the displacement of dummy actuator 22 in ON operation.

Figure 62:
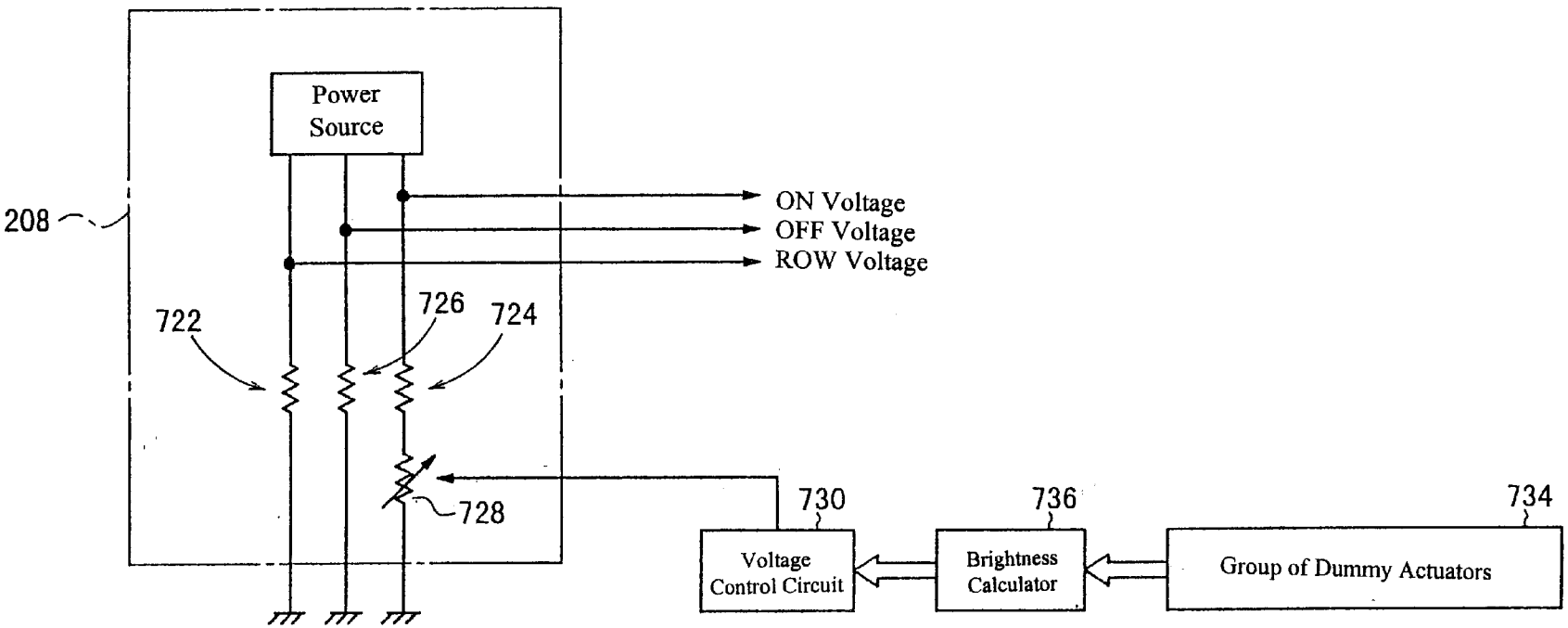
FIG. 62 is a block diagram showing a first variation of the third specific example of a form of use.

Referring to FIG. 62, a sensing signal output via various sensors from group 734 of numerous dummy actuators 22 is supplied to brightness calculator 736, which is made to calculate an approximation of overall brightness of display screens from a bundle of the sensing signals. Meanwhile, a threshold value is stored in the registers in voltage control circuit 730. Then, when the approximated value from brightness calculator 736 falls below this threshold value, a deterioration of the overall brightness is controlled by variable resistor 728 of ON voltage generating system 724, and a desired ON voltage is set. By doing this, the initial state of brightness is maintained.

Figure 63:
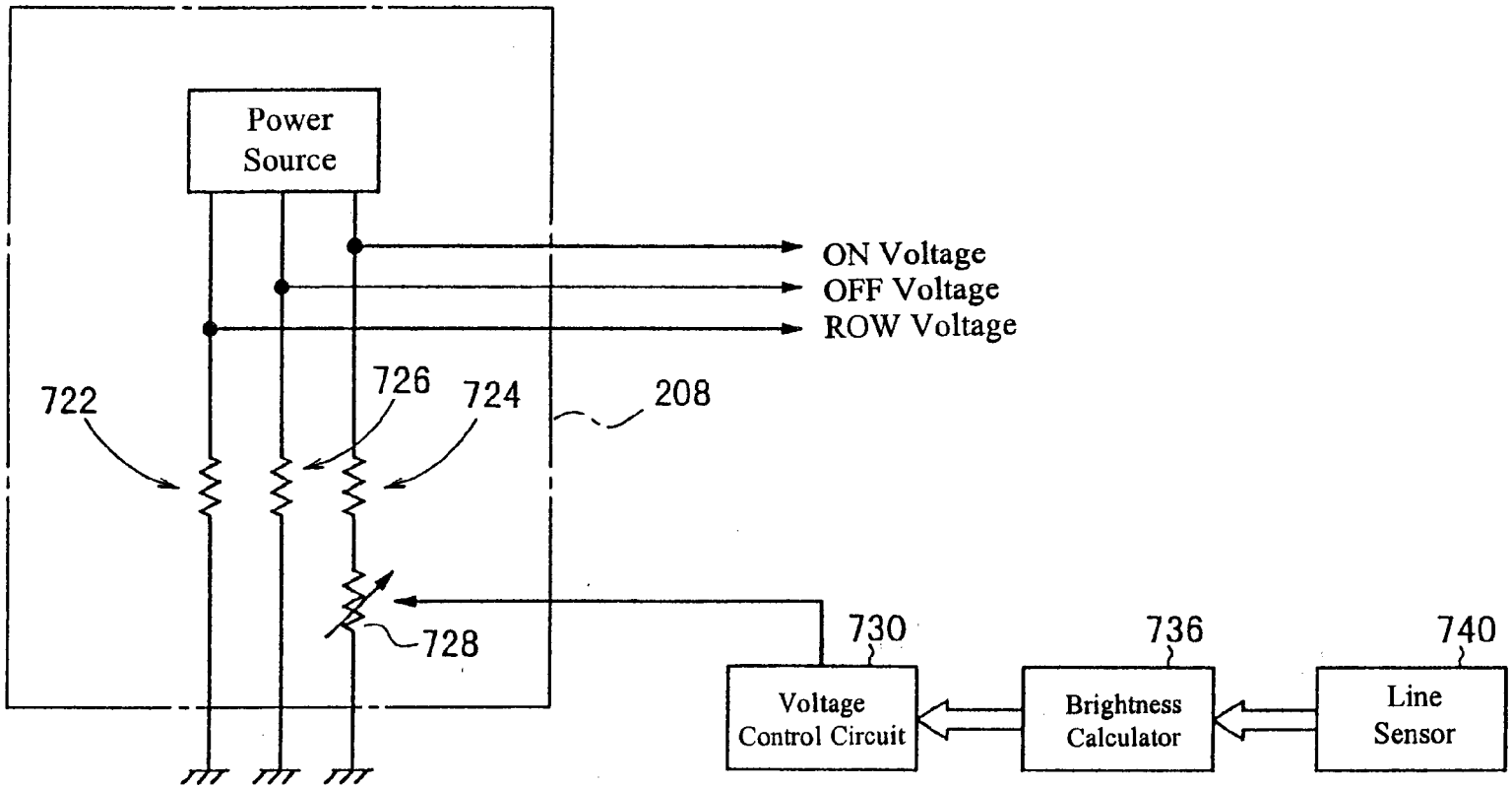
FIG. 63 is a block diagram showing a second variation of the third specific example of a form of use.

Referring to FIG. 63, another example of a method may be adopted as shown in which a line sensor 740 which moves left and right on the display surface of display 10 is driven periodically while display 10 has a blank display and senses the brightness. In this case, image signals successively output from line sensor 740 are supplied to brightness calculator 736 and the overall brightness is calculated based on a continuously supplied image signal in brightness calculator 736. A threshold value is stored in the registers in voltage control circuit 730. Then, when the approximated value from brightness calculator 736 falls below this threshold value due to the deterioration of overall brightness, variable resistor 728 of ON voltage generating system 724 is controlled and a desired ON voltage set. By doing this, the initial state of brightness is maintained.

Figure 64:
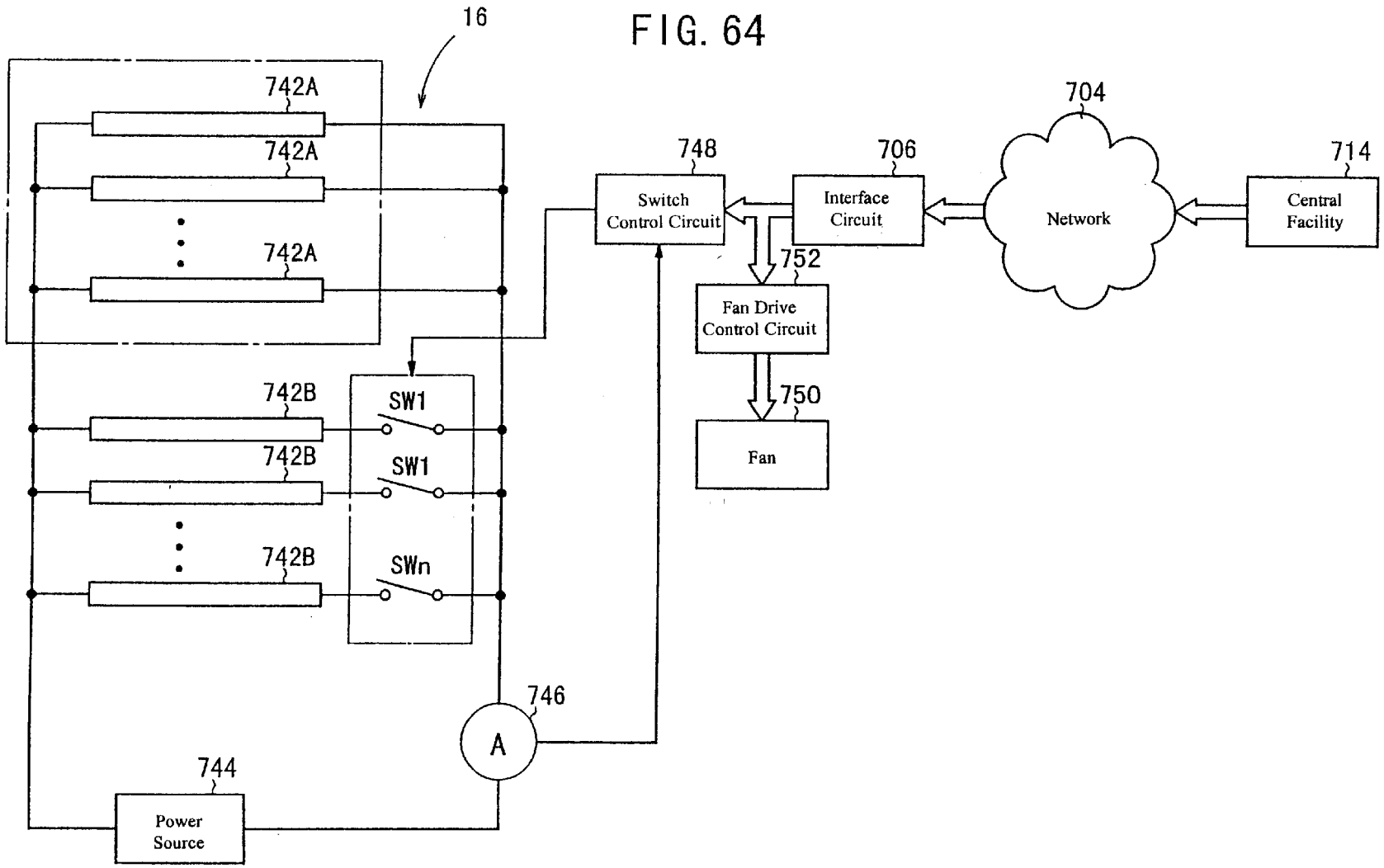
FIG. 64 is a block diagram showing the fourth specific example of a form of use.

Referring to FIG. 64, the above examples are cases where brightness correction is performed by controlling the ON voltage applied to column electrode 48*b*, but brightness correction may also be realized by controlling light source 16 as well. When cold cathode tubes etc. are used for light source 16, numerous cold cathode tubes 742 are bundled and installed in a reflector (not shown) to configure one light source 16. In this case, in addition to the prescribed number of cold cathode tubes 742A (e.g., 12), numerous reserve cold cathode tubes 742B are installed and switches Sw 1, Sw 2 . . . Swn are inserted between reserve cold cathode tubes 742B and a power source 744 to connect them. Then, an electric current sensing mechanism 746, which senses the current of light source 16, is used to monitor the current and ascertain whether the amount of light generated from light source 16 has diminished or not based on the current value from electric current sensing mechanism 746. If it has diminished, a switch corresponding to a designated number of the reserve cold cathode tubes 742B (for example, Sw 1) is turned ON via a switching control circuit 748 and the amount of light increased.

Of course, brightness correction by means of this light source 16 may use the following method. First, a local manager notifies central facility 714 that brightness has deteriorated, after which information that will correct the brightness is sent from central facility 714 via network 704 based on this notification. The relevant display 10 receives this information via interface circuit 706 and furnishes it to switching control circuit 748. Switching control circuit 748 places switches corresponding to a designated number (for example, 1) of cold cathode tubes from among the reserve cold cathode tubes 742B ON. The amount of light from light source 16 increases and brightness improves by virtue of this.

However, fading of the fluorescent pigments of color filters occurs dependent on the amount of time they are used and it is known that fading of blue filters is pronounced. Therefore the device may be configured with at least one cold cathode tube which generates blue light as a reserve cold cathode tube 742B so that, based on notification from the site that blue has faded, a blue cold cathode tube is lit as the reserve.

In addition to the volitional lighting of a reserve cold cathode tube 742B, the device may be configured so that the output of a fan 750 which cools light source 16 may be regulated. This prevents abrupt changes in temperature so that the tubes can be used for longer periods of time, and also reduces unevenness of brightness which coincides with temperature changes. In this case, as FIG. 64 shows, a fan driving control circuit 752 which drives control of fan 750 based on information concerning volitional lighting from interface circuit 706 is provided.

Figure 65:
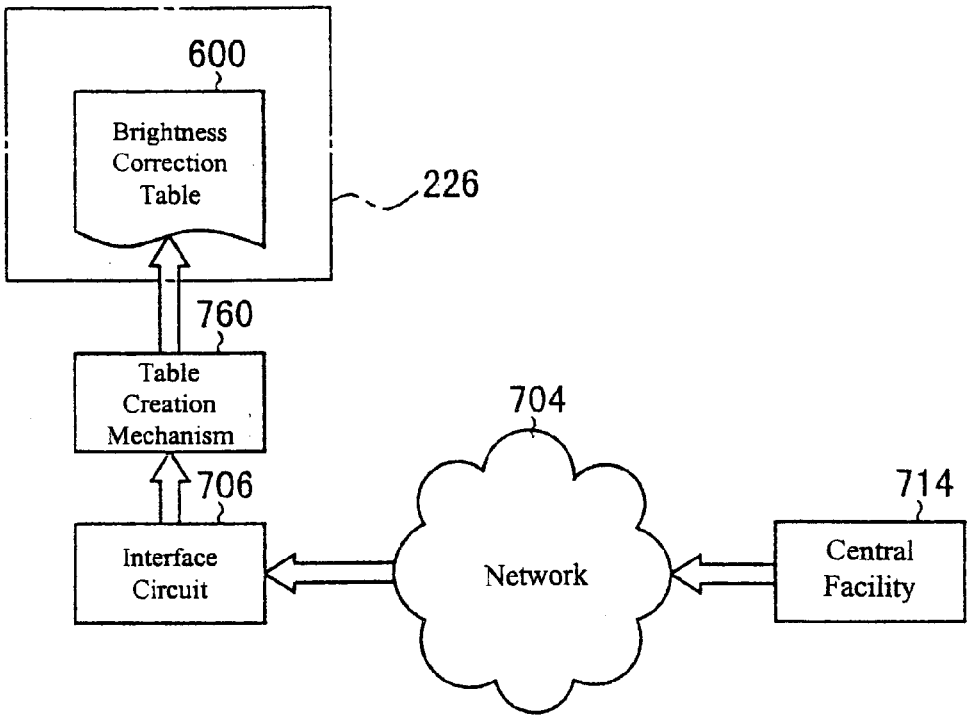
FIG. 65 is a block diagram showing the fifth specific example of a form of use.

Referring to FIG. 65, brightness may be adjusted by altering a value in brightness correction table 600 which is assigned logically in correction data memory 226 of display controller 228. In this case, when the brightness of a certain display 10 has deteriorated, a group of brightness correction values is sent via network 704 to the display 10 from a central facility 714. At display 10, a correction value from central facility 714 is received via interface circuit 706. A later stage table creation mechanism 760 creates a new brightness correction table on the basis of the received brightness correction value, and writes it to brightness correction table 600 which is stored in correction data memory 226.

Display brightness can be maintained at nearly the same level as the initial brightness because each dot operates to minimize deterioration of brightness by various types of brightness correction values from a new brightness correction table 600. This method of overwriting brightness correction table 600, instead of being furnised from a central facility 714, may be configured such that the device creates a new brightness correction table 600 in table creation mechanism 760 based on time information from timer 732 (FIG. 61), or configured such that the device creates a new brightness correction table 600 in table creation mechanism 760 based on group 734 of dummy actuators 22 (FIG. 62) or a computed value output via a brightness calculator 736 from line sensor 740 (FIG. 63).

The re-writing of brightness correction table 600 not only compensates for deteriorating of brightness, but can also compensate the entire white balance to keep it from fading. For example, when blue fades, by re-writing the brightness correction factor so that only the brightness level of blue is improved, the white balance can be maintained at nearly the initial levels. In this way, by employing the uses of the examples as shown in FIGS. 60–65, it becomes possible for to maintain display 10 by using network 704 or by automatically performing self diagnosis. In normal maintenance for displays 10 which have numerous display elements 14 arranged, maintenance personnel are generally dispatched to perform repairs on-site even for simple tasks. The costs for such maintenance are enormous because of this.

However, by employing the uses as shown in FIGS. 60–65, simple maintenance tasks such as brightness correction etc. can be performed automatically, and significant reduction in costs for maintenance can be achieved. In addition, by designating maintenance charges corresponding to each type of use such as one brightness adjustment, accurate and detailed maintenance service can be provided, which can support a proliferation of displays 10.

Hence, if the display principle of the present invention is used, a light switch that turns light output ON and OFF and selectively outputs light can be configured. More specifically, the display of the present invention includes an optical wave guide unit that functions as an optical wave guide in which light is introduced, which transmits it without leakage, and a drive portion is provided opposite one end of the optical wave guide unit, in which a number of actuators corresponding to one or more light switch contacts are arranged and control the displacement motion in contact/separation directions of the actuators with respect to the optical wave guide unit in response to a light switch control signal which is input, and by controlling leakage light of a set part of the optical wave guide unit, can configure the light switch which turns the light output ON and OFF, thereby selectively producing only a specific output of light.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A display driving device for a display, comprising:

an optical wave guide plate which introduces light to said display;

a drive section disposed opposite one face of said optical wave guide plate, said drive section including a plurality of actuators arranged corresponding to a plurality of pixels which in turn correspond to a plurality of dots, said drive section controlling a displacement of said plurality of actuators in contacting and separating directions with respect to said optical wave guide plate, said displacement corresponding to attributes of an input image signal, thereby causing an image to be displayed on said optical wave guide plate corresponding to said image signal by controlling a leakage light from specified parts of said optical wave guide plate;

a first drive circuit which applies an offset potential to all of said actuators;

a second drive circuit which outputs a data signal for each dot, said data signal being based on said image signal, said data signal comprising one of a light emitting signal and a light extinguishing signal; and a signal processing circuit which controls said first and second drive circuits wherein one dot is configured by one or more actuators and one pixel is configured by one or more dots, and wherein said second drive circuit controls gradation by at least a temporal modulation method.

2. A display driving device as described in claim 1 wherein:

a display interval for one image is one frame, and said frame includes a plurality of subfields; and each subfield is designated a time duration corresponding to a unit gradation level assigned to that subfield.

3. A display driving device as described in claim 2 wherein:

a timing of said second drive circuit is controlled by said signal processing circuit so that a display time for each dot is allocated to necessary subfields corresponding to respective gradation levels; and created dot data is output as data signals to actuators associated with said dots.

4. A display driving device as described in claim 3 wherein said signal processing circuit includes:

a data creating mechanism which obtains dot data that is to be allocated to all dots based on said input image signal; and a data transfer section which is provided for each dot and outputs said dot data for corresponding dots in conformance with an initial timing of corresponding subfields.

5. A display driving device as described in claim 4 wherein said data transfer section includes:

a first shift register which accepts dot data by bit shift action based on constant timing; and a second shift register which accepts dot data stored in said first shift register in parallel and successively outputs bit information of said dot data based on timing corresponding to time duration of corresponding subfields.

6. A display driving device as described in claim 1 wherein a display interval for one image is one frame, and said frame includes a plurality of linear subfields of equal length; and a timing of said second drive circuit is controlled by said signal processing circuit so that for each dot, display time corresponding to respective gradation levels is continuously allotted to necessary linear subfields and created dot data are output to actuators corresponding to said dots.

7. A display driving device as described in claim 6 wherein said signal processing circuit includes:

a data creating mechanism which obtains dot data that is to be allotted to all dots based on said input image signal; and a data transfer section which outputs bit information configuring said dot data to corresponding dots in conformance with an initial timing of said linear subfields.

8. A display driving device as described in claim 7 wherein:

said second drive circuit includes multiple driver IC's;

said data transfer portion includes one first data output circuit and a plurality of second data output circuits corresponding to a number of output terminals of said first data output circuit;

said first data output circuit outputs data sets in dot succession with each specified timing in each output terminal, said data sets allotted to each output terminal in each frame and configured by k×m×n, where (k) is a number of outputs per said driver IC, (m) is a number of driver IC's allotted, and (n) is a number of bits corresponding to a maximum gradation level; and said second data output circuit includes output terminals corresponding to said number of driver IC's allotted, and outputting data from said first data output circuit in parallel to allotted driver IC's via said output terminals.

9. A display device as described in claim 1, wherein said signal processing circuit includes means for correcting brightness to compensate for brightness variations between each of said dots.

10. A display driving device as described in claim 1, wherein said signal processing circuit includes linear correction means for making display properties of said dots linear with respect to said gradation.

11. A display driving device as described in claim 10 wherein said display properties are at least display properties with respect to a gradation level in a transmission system of said input image signal.

12. A display driving device as described in claim 1 further comprising a light adjustment control mechanism which switches power of a light source in at least two stages at a desired timing in one frame when a display interval of one image is one frame.

13. A display driving device as described in claim 1 further comprising a preliminary interval which separates all dots in one frame with respect to said optical wave guide plate when a display interval of one image is one frame.

14. A display driving device as described in claim 13 wherein said preliminary interval is formed coinciding with variations in an output level of said first drive circuit.

15. A display driving device for a display, comprising:

an optical wave guide plate which introduces light to said display;

a drive section disposed opposite one face of said optical wave guide plate, said drive section including a plurality of actuators arranged corresponding to a plurality of pixels which in turn correspond to a plurality of dots, said drive section controlling a displacement of said plurality of actuators in contacting/separating directions with respect to said optical wave guide plate, said displacement corresponding to attributes of an input image signal, thereby causing an image to be displayed on said optical wave guide plate corresponding to said image signal by controlling a leakage light from specified parts of said optical wave guide plate;

a first drive circuit which alternately selects pixels for odd numbered rows and even numbered rows;

a second drive circuit which outputs a data signal for each dot, said data signal being based on image signal, said data signal including one of a light emitting signal and a light extinguishing signal; and a signal processing circuit which controls said first and second drive circuits, wherein one dot is configured by one or more actuators and one pixel is configured by one or more dots, and wherein said signal processing circuit controls at least said second drive circuit which in turn controls gradation at least by a temporal modulation method.

16. A display driving device as described in claim 15 wherein:

a display interval for one image is one frame, said frame is divided into two fields, and each field includes a plurality of subfields; and each subfield is designated a time duration corresponding to a unit gradation level assigned to that subfield.

17. A display driving device as described in claim 16 wherein:

a timing of said second drive circuit is controlled by said signal processing circuit so that a display time for each dot in rows selected by said first drive circuit is allocated to necessary subfields corresponding to respective gradation levels; and created dot data is output to actuators corresponding to said dots.

18. A display driving device as described in claim 17 wherein said signal processing circuit includes:

a data creating mechanism which obtains dot data that is to be allocated to dots associated with said selected rows based on said input image signal; and a data transfer section which is provided for each dot which is selected in an interval of one field and which outputs said dot data for selected dots in conformance with an initial timing of corresponding subfields.

19. A display driving device as described in claim 18 wherein said data transfer section includes:

a first shift register which accepts dot data by bit shift action based on constant timing; and a second shift register which accepts dot data stored in said first shift register in parallel and which successively outputs bit information of said dot data based on timing corresponding to time duration of corresponding subfields.

20. A display driving device as described in claim 15 wherein:

a display interval for one image is one frame, said frame is divided into two fields, and each field includes a plurality of linear subfields;

a timing of said second drive circuit being controlled by said signal processing circuit so that for each dot selected by said first drive circuit, display time corresponding to respective gradation levels is continuously allotted to necessary linear subfields so that created dot data is output to at least one actuator associated with said dots.

21. A display driving device as described in claim 20 wherein said signal processing circuit includes:

a data creating mechanism which obtains dot data to be allotted to all dots selected in one field based on said input image signal; and a data transfer section which outputs bit information configuring said dot data to corresponding dots in line with an initial timing of corresponding linear subfields.

22. A display driving device as described in claim 21 wherein:

said second drive circuit includes multiple driver IC's, said data transfer section includes one first data output circuit and a plurality of second data output circuits corresponding to a number of output terminals of said first data output circuit, said first data output circuit outputs data sets in dot succession with each specified timing in each output terminal, said data sets allotted to each output terminal in each field and configured by k×m×n, where (k) is a number of outputs per said driver IC, (m) is a number of driver IC's allotted, and (n) is a number of bits corresponding to a maximum gradation level; and said second data output circuit includes output terminals corresponding to said number of driver IC's allotted, and outputting data from said first data output circuit in parallel to allotted driver IC's via said output terminals.

23. A display device as described in claim 15, wherein said signal processing circuit includes means for correcting brightness to compensate for brightness variations between each of said dots.

24. A display driving device as described in claim 15, wherein said signal processing circuit includes linear correction means for making display properties of said dots linear with respect to said gradation.

25. A display driving device as described in claim 24 wherein said display properties are at least display properties with respect to a gradation level in a transmission system of said input image signal.

26. A display driving device as described in claim 15 further comprising a light adjustment control mechanism which switches power of a light source in at least two stages at a desired timing in one field when a display interval of one image is one frame and one frame consists of two fields.

27. A display driving device as described in claim 15 further comprising a preliminary interval which separates all dots in one field with respect to said optical wave guide plate when a display interval of one image is one frame and one frame consists of two fields.

28. A display driving device as described in claim 27 wherein said preliminary interval is formed coinciding with variations in an output level of said first drive circuit.

29. A method of driving displays, comprising the steps of:

introducing light in an optical wave guide plate;

providing a plurality of actuators arranged corresponding to a plurality of pixels which in turn correspond to a plurality of dots;

providing a drive section disposed opposite one face of said optical wave guide plate which controls a displacement of said actuators in contacting/separating directions with respect to said optical wave guide plate corresponding to attributes of an input image signal, thereby causing an image to be displayed on said optical wave guide plate corresponding to said input image signal by controlling leakage light of specified parts of said optical wave guide plate;

configuring each dot by at least one actuator;

configuring each pixel by at least one dot;

applying an offset potential to said plurality of dots;

outputting a data signal comprising a light emitting signal and a light extinguishing signal for each dot based on said input image signal; and controlling gradation by at least a temporal modulation method.

30. A method as described in claim 29 further comprising:

setting a display interval for one image as one frame, wherein said frame includes a plurality of subfields; and designating a time duration for each subfield corresponding to a unit gradation level assigned to that subfield.

31. A method as described in claim 30 further comprising:

controlling timing so that a display time for each dot is allocated to necessary subfields corresponding to respective gradation levels; and outputting created dot data to actuators associated with said dots.

32. A method as described in claim 31, further comprising:

obtaining dot data that is to be allocated to all dots based on said input image signal; and outputting, for all dots, said dot data to corresponding dots in conformance with an initial timing of corresponding subfields.

33. A method as described in claim 32, further comprising:

accepting dot data by bit shift action based on constant timing; and successively outputting bit information of said dot data after said dot data is accepted in parallel, wherein said outputting is based on timing corresponding to time duration of corresponding subfields.

34. A method as described in claim 29, further comprising:

setting a display interval for one image as one frame, wherein said frame is equally divided into a plurality of linear subfields; and continuously allotting display time corresponding to respective gradation levels to each dot; and controlling timing so that created dot data is output to each actuator corresponding to said dots.

35. A method as described in claim 34, further comprising:

obtaining dot data that is to be allotted to all dots based on said input image signal; and outputting bit information configuring said dot data to corresponding dots in conformance with an initial timing of corresponding linear subfields.

36. A method as described in claim 35, further comprising:

allotting a plurality of driver IC's to control said plurality of actuators;

dividing all dots into groups of multiple dots;

allocating data sets configured by k×m×n to each group in one frame period, wherein (k) is a number of outputs per said driver IC, (m) is a number of driver IC's allotted, and (n) is a number of bits corresponding to a maximum gradation level; and outputting said data sets in dot succession in each group with each specified timing.

37. A method as described in claim 29, further comprising the step of performing brightness correction processing to correct brightness variations for each dot.

38. A method as described in claim 29, further comprising performing linear correction processing for making display properties of said dots linear with respect to said gradation.

39. A method as described in claim 38, in which said display properties are at least display properties with respect to a gradation level in a transmission system of said input image signal.

40. A method as described in claim 29, further comprising the step of performing light adjustment control processing which switches power of a light source in at least two stages at a desired timing in one frame when a display interval of one image is one frame.

41. A method as described in claim 29, further comprising the step of providing an interval which separates all dots in one frame with respect to said optical waveguide plate when a display interval of one image is one frame.

42. A method of driving displays, comprising the steps of:

introducing light in an optical wave guide plate;

providing a plurality of actuators arranged corresponding to a plurality of pixels which in turn correspond to a plurality of dots;

providing a drive section disposed opposite one face of said optical wave guide plate which controls a displacement of said actuators in contacting/separating directions with respect to said optical wave guide plate corresponding to attributes of an input image signal, thereby causing an image to be displayed on said optical wave guide plate corresponding to said input image signal by controlling leakage light of specified parts of said optical wave guide plate;

configuring each dot by at least one actuator;

configuring each pixel by at least one dot;

alternately selecting pixels of odd number rows and even number rows;

outputting display information to pixels of said selected rows for each dot based on said input image signal, wherein said display information includes a light emitting signal and a light extinguishing signal; and controlling gradation by at least a temporal modulation method.

43. A method as described in claim 42, further comprising:

setting a display interval for one image as one frame, and partitioning said frame into two fields, wherein each field includes a plurality of subfields; and designating a time duration for each subfield corresponding to a unit gradation level assigned to that subfield.

44. A method as described in claim 43, further comprising:

allocating display time for each dot of selected rows to necessary subfields corresponding to respective gradation levels; and controlling timing so that created dot data output is output to actuators associated with said dots.

45. A method as described in claim 44, further comprising:

obtaining, based on said input image signal, dot data that is to be allocated to dots corresponding to said selected rows; and outputting said dot data to selected dots in conformance with an initial timing of a corresponding subfield for dots which are selected in an interval of one field.

46. A method as described in claim 45, further comprising:

accepting dot data by bit shift action based on constant timing; and successively outputting, based on timing corresponding to time duration of said subfields, bit information of said dot data after said dot data is accepted in parallel.

47. A method as described in claim 46, further comprising:

setting a display interval for one image as one frame, and partitioning said frame into two fields, wherein each field is divided into a plurality of linear subfields; and controlling timing so that, for each dot of selected rows, display time corresponding to respective gradation levels is continuously allotted to necessary linear subfields so that created dot data is output to said actuators associated with said dots.

48. A method as described in claim 47, further comprising:

obtaining dot data that is to be allotted to all dots selected in an interval of one field based on said input image signal; and outputting bit information configuring said dot data to corresponding dots in conformance with an initial timing of corresponding linear subfields.

49. A method as described in claim 48, further comprising:

allotting a plurality of driver IC's to control said plurality of actuators;

dividing dots selected in an interval of one field into groups of multiple dots;

configuring in k×m×n data sets to each group allocated in one field interval, wherein a number of outputs per said driver IC is (k), a number of driver IC's allotted in one group is (m), and a number of bits corresponding to the maximum gradation level is (n); and outputting said data sets with specified timing in dot succession in each group.

50. A method as described in claim 42, further comprising the step of performing brightness correction processing to correct brightness variations for each dot.

51. A method as described in claim 42, further comprising performing linear correction processing for making display properties of said dots linear with respect to said gradation.

52. A method as described in claim 51, in which said display properties are at least display properties with respect to a gradation level in a transmission system of said input image signal.

53. A method as described in claim 42, further comprising the step of performing light adjustment control processing which switches power of a light source in at least two stages at a desired timing in one field when a display interval of one image is one frame and one frame consists of two fields.

54. A method as described in claim 42, further comprising the step of providing an interval which separates all dots in one field with respect to said optical wave guide plate when a display interval of one image is one frame and one frame consists of two fields.

55. A display driving device for a display, comprising:

an optical wave guide plate which introduces light to said display;

a drive section disposed opposite one face of said optical wave guide plate, said drive section including a plurality of actuators arranged corresponding to a plurality of pixels which in turn correspond to a plurality of dots, said drive section controlling a displacement of said plurality of actuators in contacting/separating directions with respect to said optical wave guide plate, said displacement corresponding to attributes of an input image signal, thereby causing an image to be displayed on said optical wave guide plate corresponding to said image signal by controlling a leakage light from specified parts of said optical wave guide plate;

a first drive circuit which selects dots of designated rows for said plurality of pixels;

a second drive circuit which outputs a data signal for each dot, said data signal being based on said input image signal, said data signal including one of a light emitting signal and a light extinguishing signal; and a signal processing circuit which controls said first and second drive circuits, wherein one dot is configured by two or more actuators and one pixel is configured by one or more dots, and wherein said signal processing circuit controls said first and second drive circuits which in turn control gradation by at least a temporal modulation method, wherein a display interval for one image is one frame, said frame is divided into a plurality of fields, one field per designated row, and each field includes a plurality of subfields, and each subfield is designated a time duration corresponding to a unit gradation level assigned to that subfield.

56. A display driving device as described in claim 55, wherein said designated rows are three rows matching three primary colors.

57. A display driving device as described in claim 56 wherein a color emitted by said light source is switched in synchronization with a selection of said dots.

58. A display driving device as described in claim 55, wherein:

a timing of said second drive circuit is controlled by said signal processing circuit so that display time for each dot of rows selected by said first drive circuit is allocated to necessary subfields corresponding to respective gradation levels; and created dot data is output to actuators associated with said dots.

59. A display driving device as described in claim 58, further comprising:

a data creating mechanism in said signal processing circuit which obtains dot data that is to be allocated to dots associated with said selected rows based on said input image signal; and a data transfer section which corresponds to a number of dots which are selected in an interval of one field and outputs said dot data for selected dots in conformance with an initial timing of a corresponding subfield.

60. A display driving device as described in claim 59 wherein said data transfer section includes:

a first shift register which accepts dot data by bit shift action based on constant timing; and a second shift register which accepts dot data stored in said first shift register in parallel and successively outputs bit information of said dot data based on timing corresponding to a time duration of said subfields.

61. A display driving device for a display, comprising:

an optical wave guide plate which introduces light to said display;

a drive section disposed opposite one face of said optical wave guide plate, said drive section including a plurality of actuators arranged corresponding to a plurality of pixels which in turn correspond to a plurality of dots, said drive section controlling a displacement of said plurality of actuators in contacting/separating directions with respect to said optical wave guide plate, said displacement corresponding to attributes of an input image signal, thereby causing an image to be displayed on said optical wave guide plate corresponding to said image signal by controlling a leakage light from specified parts of said optical wave guide plate;

a first drive circuit which selects dots of designated rows for said plurality of pixels;

a second drive circuit which outputs a data signal for each dot, said data signal being based on said input image signal, said data signal including one of a light emitting signal and a light extinguishing signal; and a signal processing circuit which controls said first and second drive circuits, wherein one dot is configured by two or more actuators and one pixel is configured by one or more dots, and wherein said signal processing circuit controls said first and second drive circuits which in turn control gradation by at least a temporal modulation method, wherein a display interval for one image is one frame, said frame is divided into a plurality of fields, with one field per designated row, and each field is equally divided into a plurality of linear subfields, and a timing of said second drive circuit is controlled by said signal processing circuit so that for each dot selected by said first drive circuit, display time corresponding to respective gradation levels is continuously allotted to necessary linear subfields so that created dot data is output to said actuators associated with said dots.

62. A display driving device as described in claim 61 wherein said signal processing circuit includes:

a data creating mechanism which obtains dot data that is to be allotted to all dots selected in one field based on said input image signal; and a data transfer section which outputs bit information configuring said dot data to corresponding dots with an initial timing of corresponding linear subfields.

63. A display driving device as described in claim 62, wherein:

said second drive circuit includes multiple driver IC's, said data transfer section includes one first data output circuit and a plurality of second data output circuits corresponding to a number of output terminals of said first data output circuit, said first data output circuit outputs data sets in dot succession with each specified timing in each output terminal, said data sets allotted to each output terminal in each field and configured by k×m×n, where (k) is a number of outputs per said driver IC, (m) is a number of driver IC's allotted, and (n) is a number of bits corresponding to a maximum gradation level; and said second data output circuit includes output terminals corresponding to said number of driver IC's allotted, and outputting data from said first data output circuit in parallel to allotted driver IC's via said output terminals.

64. A display driving device as described in claim 55, wherein said signal processing circuit includes means for correcting brightness to compensate for brightness variations between each of said dots.

65. A display driving device as described in claim 55, wherein said signal processing circuit includes linear correction means for making display properties of said dots linear with respect to said gradation.

66. A display driving device as described in claim 65 wherein said display properties are at least display properties with respect to a gradation level in a transmission system of said input image signal.

67. A display driving device as described in claim 55, further comprising a light adjustment control mechanism which switches power of a light source in at least two stages at a desired timing in one field when a display interval of one image is one frame and one frame consists of a plurality of fields.

68. A display driving device as described in claim 55, further comprising a preliminary interval which separates all dots in one field with respect to said optical wave guide plate when a display interval of one image is one frame an one frame consists of a plurality of fields.

69. A display driving device as described in claim 68 wherein said preliminary interval is formed coinciding with variations in an output level of said first drive circuit.

70. A method of driving displays, comprising the steps of:

introducing light in an optical wave guide plate;

providing a plurality of actuators arranged corresponding to a plurality of pixels which in turn correspond to a plurality of dots;

providing a drive section disposed opposite one face of said optical wave guide plate which controls a displacement of said actuators in contacting/separating directions with respect to said optical wave guide plate corresponding to attributes of an input image signal, thereby causing an image to be displayed on said optical wave guide plate corresponding to said input image signal by controlling leakage light of specified parts of said optical wave guide plate;

configuring each dot by at least two actuators;

configuring each pixel by at least one dot;

selecting, in turn, dots of all pixels in designated rows;

outputting a data signal comprising a light emitting signal and a light extinguishing signal for each dot based on said input image signal;

controlling gradation by at least a temporal modulation method; and setting a display interval for one image as one frame, partitioning said frame into a plurality of fields corresponding to a number of said designated rows, and each field includes a plurality of subfields, and designating a time duration for each subfield corresponding to a unit gradation level assigned to that subfield.

71. A method of driving displays as described in claim 70, wherein said designated rows are three rows matching three primary colors.

72. A method of driving displays as described in claim 70, further comprising switching a color emitted by said light source in synchronization with said step of selecting said dots.

73. A method of driving displays as described in claim 72, further comprising:

controlling timing so that display time for each dot of selected rows is allocated to necessary subfields corresponding to respective gradation levels; and outputting created dot data to said actuators associated with said dots.

74. A method of driving displays as described in claim 73, further comprising:

obtaining dot data that is to be allocated to dots associated with said selected rows based on said input image signal;

outputting dot data to selected dots in conformance with an initial timing of a corresponding subfield for dots which are selected in an interval of one field.

75. A method of driving displays as described in claim 74, further comprising:

accepting dot data by virtue of bit shift action based on constant timing; and successively outputting bit information of said dot data, after said dot data is accepted in parallel, based on timing corresponding to time duration of said subfields.

76. A method of driving displays, comprising the steps of:

introducing light in an optical wave guide plate;

providing a plurality of actuators arranged corresponding to a plurality of pixels which in turn correspond to a plurality of dots;

providing a drive section disposed opposite one face of said optical wave guide plate which controls a displacement of said actuators in contacting/separating directions with respect to said optical wave guide plate corresponding to attributes of an input image signal, thereby causing an image to be displayed on said optical wave guide plate corresponding to said input image signal by controlling leakage light of specified parts of said optical wave guide plate;

configuring each dot by at least two actuators;

configuring each pixel by at least one dot;

selecting, in turn, dots of all pixels in designated rows;

outputting a data signal comprising a light emitting signal and a light extinguishing signal for each dot based on said input image signal;

controlling gradation by at least a temporal modulation method;

setting a display interval for one image as one frame, and partitioning said frame into a plurality of fields conforming to a number of designated rows, wherein each field is equally divided into a plurality of linear subfields; and controlling timing so that for each dot of selected rows, display time corresponding to respective gradation levels is continuously allotted to necessary linear subfields so that created dot data is output to said actuators associated with said dots.

77. A method of driving displays as described in claim 76, further comprising:

obtaining dot data that is to be allotted to all dots selected in an interval of one field based on said input image signal; and outputting bit information configuring said dot data to corresponding dots in conformance with an initial timing of corresponding linear subfields.

78. A method of driving displays as described in claim 77, further comprising:

allotting a plurality of driver IC's to control said plurality of actuators;

dividing dots selected in an interval of one field into groups of multiple dots;

configuring in k×m×n data sets to each group allocated in one field interval, wherein a number of outputs per said driver IC is (k), a number of driver IC's allotted in one group is (m), and a number of bits corresponding to the maximum gradation level is (n); and outputting said data sets with specified timing in dot succession in each group.

79. A method as described in claim 70, further comprising the step of performing brightness correction processing to correct brightness variations for each dot.

80. A method as described in claim 70, further comprising performing linear correction processing for making display properties of said dots linear with respect to said gradation.

81. A method as described in claim 80, in which said display properties are at least display properties with respect to a gradation level in a transmission system of said input image signal.

82. A method as described in claim 70, further comprising the step of performing light adjustment control processing which switches power of a light source in at least two stages at a desired timing in one field when a display interval of one image is one frame and one frame consists of a plurality of fields.

83. A method as described in claim 70, further comprising the step of providing an interval which separates all dots in one field with respect to said optical wave guide plate when a display interval of one image is one frame and one frame consists of a plurality of fields.

84. A display driving device for a display, comprising:

an optical wave guide plate which introduces light to said display;

a drive section disposed opposite one face of said optical wave guide plate, said drive section including a plurality of actuators arranged corresponding to a plurality of pixels which in turn correspond to a plurality of dots, said drive section controlling a displacement of said plurality of actuators in contacting and separating directions with respect to said optical wave guide plate, said displacement corresponding to attributes of an input image signal, thereby causing an image to be displayed on said optical wave guide plate corresponding to said image signal by controlling a leakage light from specified parts of said optical wave guide plate;

a first drive circuit which applies an offset potential to all of said actuators;

a second drive circuit which outputs a data signal for each dot, said data signal being based on said image signal, said data signal comprising one of a light emitting signal and a light extinguishing signal;

a signal processing circuit which controls said first and second drive circuits wherein one dot is configured by one or more actuators and one pixel is configured by one or more dots;

wherein said signal processing circuit includes means for controlling gradation; and wherein said signal processing means includes correction means for correcting brightness to compensate for brightness variations between each of said dots.

85. A display driving device as described in claim 84, wherein said signal processing circuit includes linear correction means for making display properties of said dots linear with respect to said gradation.

86. A display driving device as described in claim 85 wherein said display properties are at least display properties with respect to a gradation level in a transmission system of said input image signal.

87. A display driving device as described in claim 84 further comprising a light adjustment control mechanism which switches power of a light source in at least two stages at a desired timing in one frame when a display interval of one image is one frame.

88. A display driving device as described in claim 84 further comprising a preliminary interval which separates all dots in one frame with respect to said optical wave guide plate when a display interval of one image is one frame.

89. A display driving device as described in claim 88 wherein said preliminary interval is formed coinciding with variations in an output level of said first drive circuit.

90. A method of driving displays, comprising the steps of:

introducing light in an optical wave guide plate;

providing a plurality of actuators arranged corresponding to a plurality of pixels which in turn correspond to a plurality of dots;

providing a drive section disposed opposite one face of said optical wave guide plate which controls a displacement of said actuators in contacting/separating directions with respect to said optical wave guide plate corresponding to attributes of an input image signal, thereby causing an image to be displayed on said optical wave guide plate corresponding to said input image signal by controlling leakage light of specified parts of said optical wave guide plate;

configuring each dot by at least one actuator;

configuring each pixel by at least one dot;

applying an offset potential to said plurality of dots;

outputting a data signal comprising a light emitting signal and a light extinguishing signal for each dot based on said input image signal;

controlling gradation; and performing brightness correction processing to correct brightness variations between each of said dots.

91. A method as described in claim 90, further comprising performing linear correction processing for making display properties of said dots linear with respect to said gradation.

92. A method as described in claim 91, in which said display properties are at least display properties with respect to a gradation level in a transmission system of said input image signal.

93. A method as described in claim 91, further comprising the step of performing light adjustment control processing which switches power of a light source in at least two stages at a desired timing in one frame when a display interval of one image is one frame.

94. A method as described in claim 90, further comprising the step of providing an interval which separates all dots in one frame with respect to said optical wave guide plate when a display interval of one image is one frame.

95. A display driving device for a display, comprising:

an optical wave guide plate which introduces light to said display;

a drive section disposed opposite one face of said optical wave guide plate, said drive section including a plurality of actuators arranged corresponding to a plurality of pixels which in turn correspond to a plurality of dots, said drive section controlling a displacement of said plurality of actuators in contacting and separating directions with respect to said optical wave guide plate, said displacement corresponding to attributes of an input image signal, thereby causing an image to be displayed on said optical wave guide plate corresponding to said image signal by controlling a leakage light from specified parts of said optical wave guide plate;

each of said actuators including a shape retaining portion consisting of at least first and second layers, wherein said first and second layers are partially separated by a row electrode, and wherein said shape retaining portion is bounded on an upper and lower side by a column electrode;

a first drive circuit which applies an offset potential to all of said actuators;

a second drive circuit which outputs a data signal for each dot, said data signal being based on said image signal, said data signal comprising one of a light emitting signal and a light extinguishing signal; and a signal processing circuit which controls said first and second drive circuits, wherein one dot is configured by two or more actuators and one pixel is configured by one or more dots.

96. A display driving device as described in claim 61, wherein said designated rows are three rows matching three primary colors.

97. A display driving device as described in claim 61, wherein a color emitted by said light source is switched in synchronization with a selection of said dots.

98. A display driving device as described in claim 61, wherein:

each subfield is designated a time duration corresponding to a unit gradation level assigned to that subfield.

99. A display driving device as described in claim 61, further comprising:

a data creating mechanism in said signal processing circuit which obtains dot data that is to be allocated to dots associated with said selected rows based on said input image signal; and a data transfer section which corresponds to a number of dots which are selected in an interval of one field and outputs said dot data for selected dots in conformance with an initial timing of a corresponding subfield.

100. A display driving device as described in claim 99, wherein said data transfer section includes:

a first shift register which accepts dot data by bit shift action based on constant timing; and a second shift register which accepts dot data stored in said first shift register in parallel and successively outputs bit information of said dot data based on timing corresponding to a time duration of said subfields.

101. A display driving device as described in claim 61, wherein said signal processing circuit includes means for correcting brightness to compensate for brightness variations between each of said dots.

102. A display driving device as described in claim 61, wherein said signal processing circuit includes linear correction means for making display properties of said dots linear with respect to said gradation.

103. A display driving device as described in claim 102, wherein said display properties are at least display properties with respect to a gradation level in a transmission system of said input image signal.

104. A display driving device as described in claim 61, further comprising a light adjustment control mechanism which switches power of a light source in at least two stages at a desired timing in one field when a display interval of one image is one frame and one frame consists of a plurality of fields.

105. A display driving device as described in claim 61, further comprising a preliminary interval which separates all dots in one field with respect to said optical wave guide plate when a display interval of one image is one frame and one frame consists of a plurality of fields.

106. A display driving device as described in claim 105, wherein said preliminary interval is formed coinciding with variations in an output level of said first drive circuit.

107. A method of driving displays as described in claim 76, wherein said designated rows are three rows matching three primary colors.

108. A method of driving displays as described in claim 76, further comprising switching a color emitted by said light source in synchronization with said step of selecting said dots.

109. A method of driving displays as described in claim 76, further comprising:

designating a time duration for each subfield corresponding to a unit gradation level assigned to that subfield.

110. A method of driving displays as described in claim 76, further comprising:

obtaining dot data that is to be allocated to dots associated with said selected rows based on said input image signal; and outputting dot data to selected dots in conformance with an initial timing of a corresponding subfield for dots which are selected in an interval of one field.

111. A method of driving displays as described in claim 110, further comprising:

accepting dot data by virtue of bit shift action based on constant timing; and successively outputting bit information of said dot data, after said dot data is accepted in parallel, based on timing corresponding to time duration of said subfields.

112. A method as described in claim 76, further comprising the step of performing brightness correction processing to correct brightness variations for each dot.

113. A method as described in claim 76, further comprising performing linear correction processing for making display properties of said dots linear with respect to said gradation.

114. A method as described in claim 113, in which said display properties are at least display properties with respect to a gradation level in a transmission system of said input image signal.

115. A method as described in claim 76, further comprising the step of performing light adjustment control processing which switches power of a light source in at least two stages at a desired timing in one field when a display interval of one image is one frame and one frame consists of a plurality of fields.

116. A method as described in claim 76, further comprising the step of providing an interval which separates all dots in one field with respect to said optical wave guide plate when a display interval of one image is one frame and one frame consists of a plurality of fields.

* * * * *